US010328318B2

(12) United States Patent
Onuki et al.

(10) Patent No.: US 10,328,318 B2
(45) Date of Patent: Jun. 25, 2019

(54) GOLF CLUB

(71) Applicant: SUMITOMO RUBBER INDUSTRIES, LTD., Kobe-shi, Hyogo (JP)

(72) Inventors: Masahide Onuki, Kobe (JP); Hiroshi Hasegawa, Kobe (JP); Naruhiro Mizutani, Kobe (JP); Yuki Motokawa, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/996,071

(22) Filed: Jun. 1, 2018

(65) Prior Publication Data

US 2018/0345088 A1 Dec. 6, 2018

(30) Foreign Application Priority Data

Jun. 2, 2017 (JP) ..... 2017-110201

(51) Int. Cl.

*A63B 53/02* (2015.01)
*A63B 53/06* (2015.01)
*A63B 53/04* (2015.01)

(52) U.S. Cl.

CPC ..... *A63B 53/02* (2013.01); *A63B 53/06* (2013.01); *A63B 53/047* (2013.01); *A63B 53/0466* (2013.01); *A63B 53/0487* (2013.01); *A63B 2053/023* (2013.01); *A63B 2053/0491* (2013.01)

(58) Field of Classification Search

CPC ... A63B 53/02; A63B 53/06; A63B 2053/023; A63B 53/047; A63B 2053/0491; A63B 53/0466; A63B 53/0487

See application file for complete search history.

(56) References Cited

U.S. PATENT DOCUMENTS 2,425,808 A * 8/1947 Jakosky ..... A63B 53/06 473/246
6,270,425 B1 * 8/2001 Dyer ..... A63B 53/02 473/307
7,980,959 B2 7/2011 Morris et al.
(Continued)

FOREIGN PATENT DOCUMENTS

GB 1125478 A * 8/1968 ..... A63B 53/02
JP 60-108888 U 7/1985
JP 2006-42950 A 2/2006

*Primary Examiner* — Stephen L Blau

(74) *Attorney, Agent, or Firm* — Birch, Stewart, Kolasch & Birch, LLP

(57) ABSTRACT

A golf club 100 includes a tip engagement part RT having a reverse-tapered shape and being disposed at a tip end portion of a shaft 300, and a screw member 600. The tip engagement part RT includes a sleeve 400 fixed to the tip end portion of the shaft 300. The sleeve 400 has a sleeve-side connection part 410. The screw member 600 has a screw-side connection part 602 that can be detachably connected to the sleeve-side connection part 410, and a male screw part 604. The head 200 has a female screw part 220. When the screw member 600 is rotated in a first direction, the screw member 600 presses the tip engagement part RT in an engaging direction. When the screw member 600 is rotated in a second direction, the screw member 600 pulls the tip engagement part RT in an engagement releasing direction.

8 Claims, 35 Drawing Sheets

(56) References Cited

U.S. PATENT DOCUMENTS

| | | | | |
|---|---|---|---|---|
| 8,715,104 | B1 * | 5/2014 | Wall, Jr. | A63B 53/06 473/309 |
| 2009/0325725 | A1 * | 12/2009 | Womersley | A63B 53/02 473/254 |
| 2010/0148455 | A1 * | 6/2010 | Taguchi | B23B 31/201 279/48 |
| 2010/0197423 | A1 | 8/2010 | Thomas et al. | |
| 2013/0017901 | A1 | 1/2013 | Sargent et al. | |
| 2013/0210539 | A1 * | 8/2013 | Baumann | A63B 53/02 473/319 |
| 2015/0258390 | A1 * | 9/2015 | DeFrancesco, Jr. | A63B 53/02 473/313 |
| 2017/0209749 | A1 * | 7/2017 | Brady | A63B 53/02 |

* cited by examiner

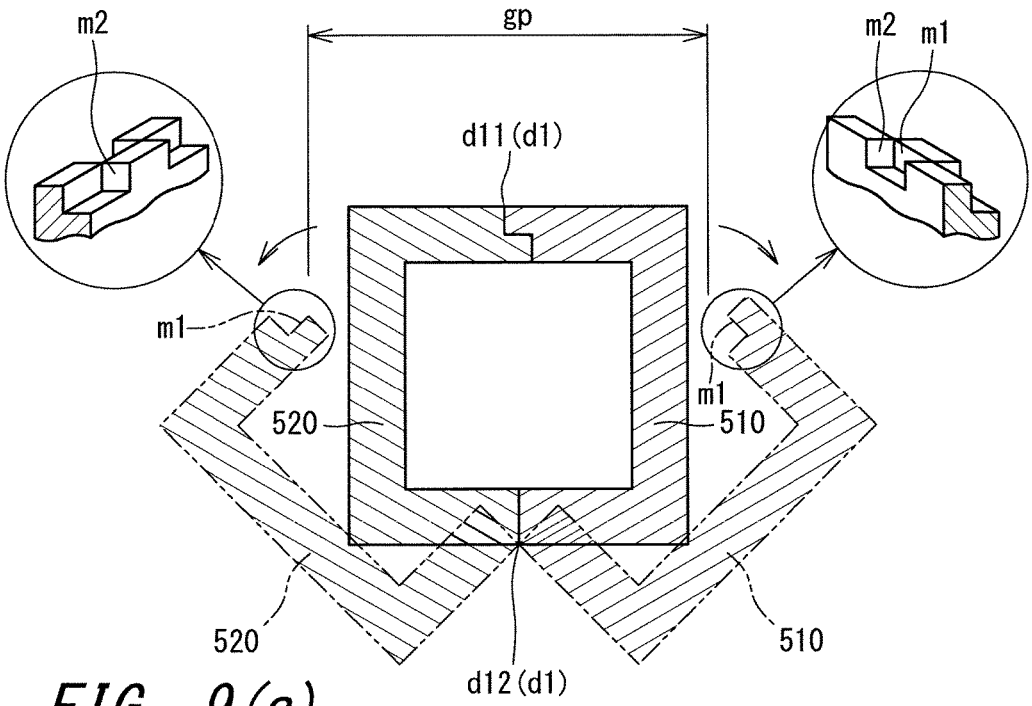
FIG. 9(a)
FIG. 9(b)
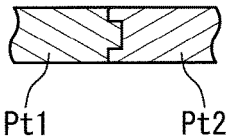
FIG. 9(c)
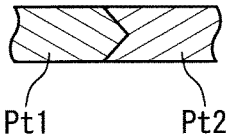

GOLF CLUB

The present application claims priority on Patent Application No. 2017-110201 filed in JAPAN on Jun. 2, 2017, the entire contents of which are hereby incorporated by reference.

BACKGROUND OF THE INVENTION

Field of the Invention

The present invention relates to a golf club.

Description of the Related Art

A golf club including a head and a shaft detachably attached to the head has been proposed.

Each of US2013/0017901 and U.S. Pat. No. 7,980,959 discloses a golf club including a head and a shaft detachably attached to the head. In these golf clubs, a sleeve is attached to a tip end portion of the shaft, and a shaft hole provided in the sleeve is inclined. In these golf clubs, an inclination direction of a shaft axis is changed depending on a fixed position of the sleeve in a circumferential direction. This change enables a loft angle, a lie angle, and a face angle to be adjusted.

Japanese patent No. 5645936 (US2010/0197423) discloses a golf club having a shaft adapter and a head adapter. The degree of freedom of an inclination direction of a shaft axis can be improved by the shaft adapter and the head adapter.

Japanese Patent Application Publication No. 2006-42950 discloses a golf club including: a retaining part bonded to a tip end portion of a shaft; a pair of angle adjustment parts which externally surround the retaining part, and a fixing nut which is screw-connected to male screw parts formed on upper end portions of the angle adjustment parts.

SUMMARY OF THE INVENTION

In a conventional technique, a sleeve is fixed to a head by using a screw that is screw-connected to the sleeve. The screw requires high strength. In addition, the conventional technique places a significant burden on the screw. Furthermore, the degree of freedom of angle adjustment is limited.

A possible solution for these problems is to use a configuration using reverse-tapered fitting. However, the reverse-tapered fitting may cause backlash. Tightening the reverse-tapered fitting to solve the problem of backlash makes it difficult to release the fitting.

It is an object of the present disclosure to provide a golf club capable of enjoying the advantage of the reverse-tapered fitting while solving the problem thereof.

In one aspect, a golf club may include: a head having a hosel part; a shaft; a tip engagement part having a reverse-tapered shape and being disposed at a tip end portion of the shaft; and a screw member. The tip engagement part may include a sleeve having a reverse-tapered shape and being fixed to the tip end portion of the shaft. The hosel part may include a hosel hole. The hosel hole may include a reverse-tapered hole having a shape corresponding to a shape of an outer surface of the tip engagement part. The tip engagement part may be fitted to the reverse-tapered hole. The sleeve may have a sleeve-side connection part at a tip end portion thereof. The screw member may have a screw-side connection part that can be detachably connected to the sleeve-side connection part, and a male screw part. The head may have, on a lower side of the hosel hole, a female screw part that can be screw-connected to the male screw part. When the male screw part is rotated in a first direction with respect to the female screw part, the screw member may press the tip engagement part in an engaging direction. When the male screw part is rotated in a second direction with respect to the female screw part while maintaining connection between the sleeve-side connection part and the screw-side connection part, the screw member may pull the tip engagement part in an engagement releasing direction.

In another aspect, by the rotation in the first direction, the screw member may press the tip engagement part in the engaging direction, and the sleeve-side connection part may be inserted to the screw-side connection part. The connection may be automatically completed by the sleeve-side connection part being inserted to the screw-side connection part.

In another aspect, the screw member may include: a screw body having the male screw part; a first member constituting an outer circumferential surface of the screw-side connection part; a second member positioned inside the first member; a third member positioned inside the second member; a first elastic body that is disposed between the first member and the second member, and biases the first member to a sleeve side with respect to the second member; a second elastic body that biases the third member to the sleeve side; and an engagement ball disposed in a ball housing hole penetrating between an inner surface and an outer surface of the second member. The sleeve-side connection part may have an engagement recess. In a non-connected state, the engagement ball may be projected outside the second member by the third member being positioned inside the engagement ball, and, by the projected engagement ball, the first member may be located at a first position at which movement thereof to the sleeve side is regulated. In a connected state in which the connection has been achieved, the third member may be moved to a position at which the third member is removed from inside of the engagement ball by the sleeve-side connection part, the engagement ball may fall in the engagement recess of the sleeve-side connection part, and the movement regulation on the first member by the engagement ball may be released, whereby the first member may be moved to a second position at which the projection of the engagement ball to the outside is prevented.

In another aspect, the screw member may include: a screw body part having the male screw part; an elastic deformation part extending from the screw body part to a sleeve side and constituting the screw-side connection part; and a rotating engagement part to which a wrench for rotating the screw member can be inserted. The rotating engagement part may have a through hole penetrating the screw body part, and an inner surface of the elastic deformation part that extends continuously with the through hole. The elastic deformation part may have an engagement projection at an end portion thereof on a sleeve side, and the end portion on the sleeve side is a free end. The sleeve-side connection part may have a hollow portion opened on a side of the screw member, an inner surface defining the hollow portion, and an engagement recess provided on the inner surface. In a natural state, the elastic deformation part including the engagement projection may exhibit a shape that can be inserted to the hollow portion with rotation of the screw member in the first direction. When the wrench is inserted to a position at which the wrench abuts on the inner surface of the elastic deformation part, the elastic deformation part may be elastically deformed so as to be positioned at a position at which the engagement projection of the elastic deformation part can be engaged with the engagement recess.

In one aspect, a screw member may be used for a golf club including: a head having a hosel part; a shaft; and a tip engagement part having a reverse-tapered shape and being disposed at a tip end portion of the shaft. The tip engagement part may include a sleeve having a reverse-tapered shape and being fixed to the tip end portion of the shaft. The hosel part may include a hosel hole. The hosel hole may include a reverse-tapered hole having a shape corresponding to a shape of an outer surface of the tip engagement part. The tip engagement part may be fitted to the reverse-tapered hole. The sleeve may have a sleeve-side connection part at a tip end portion thereof. The screw member may have a screw-side connection part that can be detachably connected to the sleeve-side connection part, and a male screw part. The head may have, on a lower side of the hosel hole, a female screw part that can be screw-connected to the male screw part. When the male screw part is rotated in a first direction with respect to the female screw part, the screw-side connection part may be connected to the sleeve-side connection part with progression of the screw-connection. When the male screw part is rotated in a second direction with respect to the female screw part, while maintaining connection between the sleeve-side connection part and the screw-side connection part, the screw member may pull the tip engagement part in an engagement releasing direction.

BRIEF DESCRIPTION OF THE DRAWINGS

FIG. 5 is the sectional view at a hosel part;

FIG. 9(*a*) is a sectional view of the spacer in FIG. 8, FIG. 9(*b*) is a partial sectional view of a spacer of a modification example, and FIG. 9(*c*) is a partial sectional view of a spacer of a modification example;

FIG. 12 to FIG. 15 show 16 kinds of constitutions which can be set when the number of spacers is one;

FIG. 13 is also plan views showing the position of the lower end surface of the tip engagement part, and shows variations of the position of the center line of the shaft;

FIG. 14 is also plan views showing the position of the lower end surface of the tip engagement part, and shows variations of the position of the center line of the shaft;

FIG. 15 is also plan views showing the position of the lower end surface of the tip engagement part, and shows variations of the position of the center line of the shaft;

FIG. 16 and FIG. 17 show 8 kinds out of 64 kinds of constitutions which can be set when the number of spacers is two;

FIG. 17 is also plan views showing the position of the lower end surface of the tip engagement part, and shows variations of the position of the center line of the shaft;

FIG. 25 is also a sectional view taken along line A-A in FIG. 24(*b*);

FIG. 26 shows a most difficult situation for inserting the sleeve into the hosel hole;

FIG. 30 is a sectional view in a non-connected state;

FIG. 34 is sectional views for illustrating movements of the movable connection part.

DESCRIPTION OF THE PREFERRED EMBODIMENTS

Hereinafter, preferred embodiments will be described in detail with appropriate references to the accompanying drawings.

Unless otherwise described, "a circumferential direction" in the present application means a circumferential direction of a shaft. Unless otherwise described, "an axial direction" in the present application means a direction of a center line of the shaft or a hosel hole. Unless otherwise described, "an axial perpendicular direction" in the present application means a direction orthogonally crossing the axial direction of the shaft. Unless otherwise described, a section in the present application means a section along a plane perpendicular to the center line of the shaft. Unless otherwise described, a grip side is defined as an upper side, and a sole side is defined as a lower side.

Figure 1:
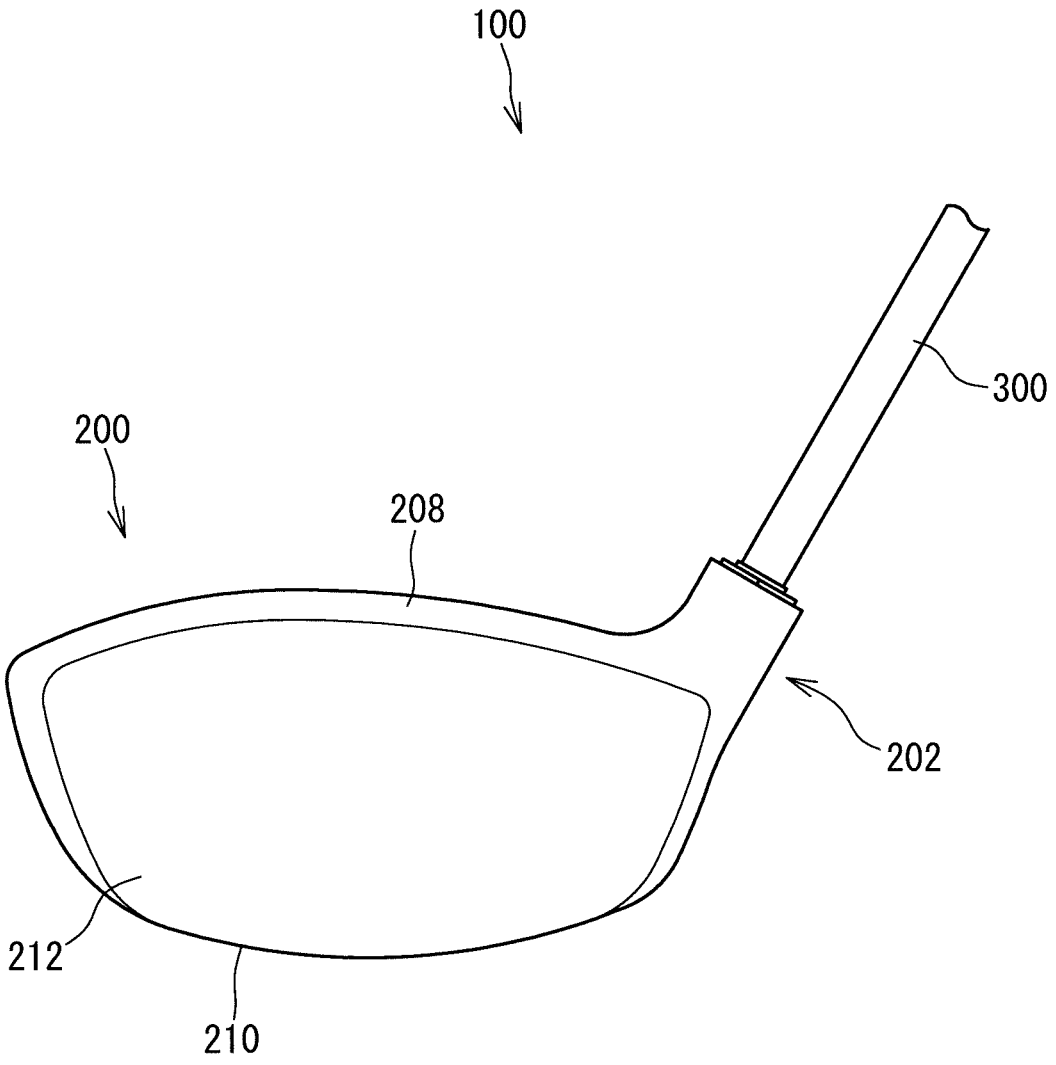
FIG. 1 is a front view of a golf club according to a first embodiment.
Figure 2:
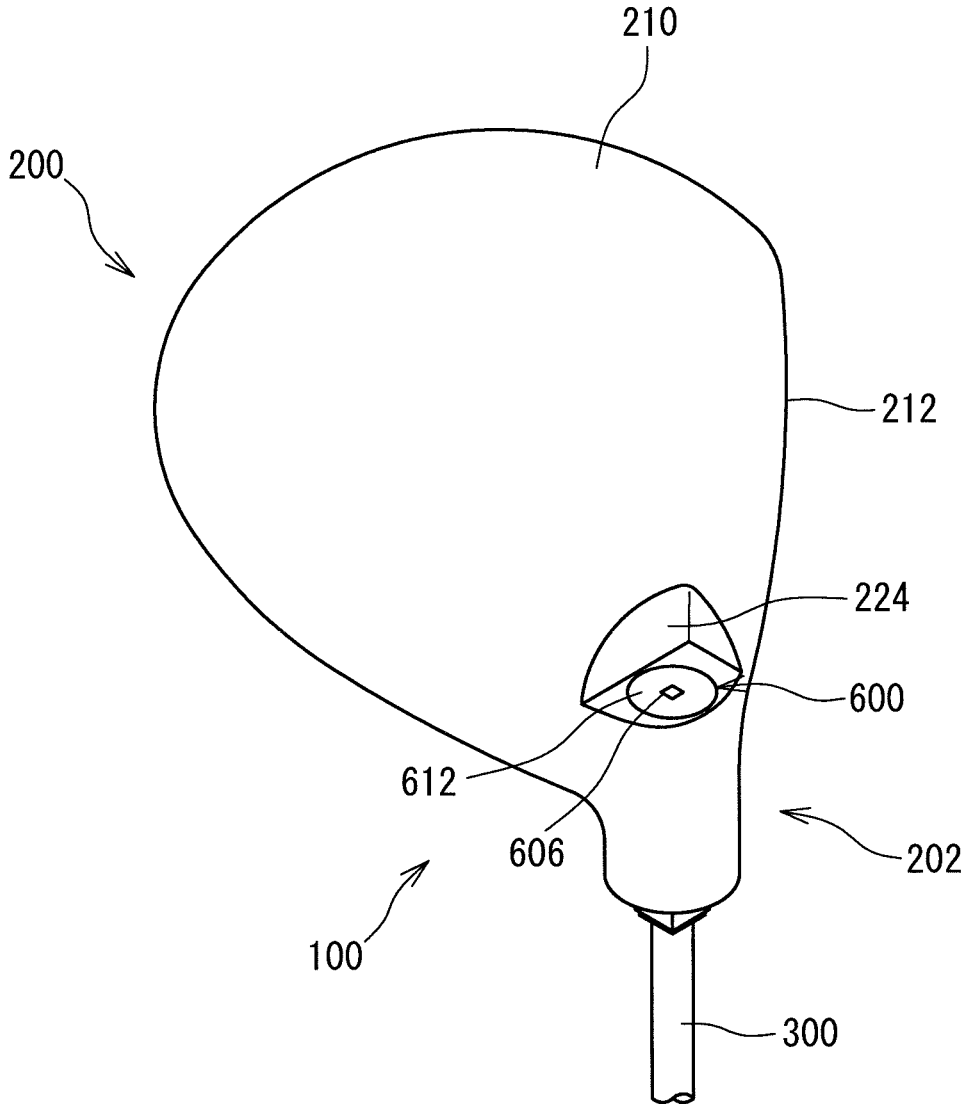
FIG. 2 is a perspective view of the golf club in FIG. 1 as viewed from a sole side.
Figure 3:
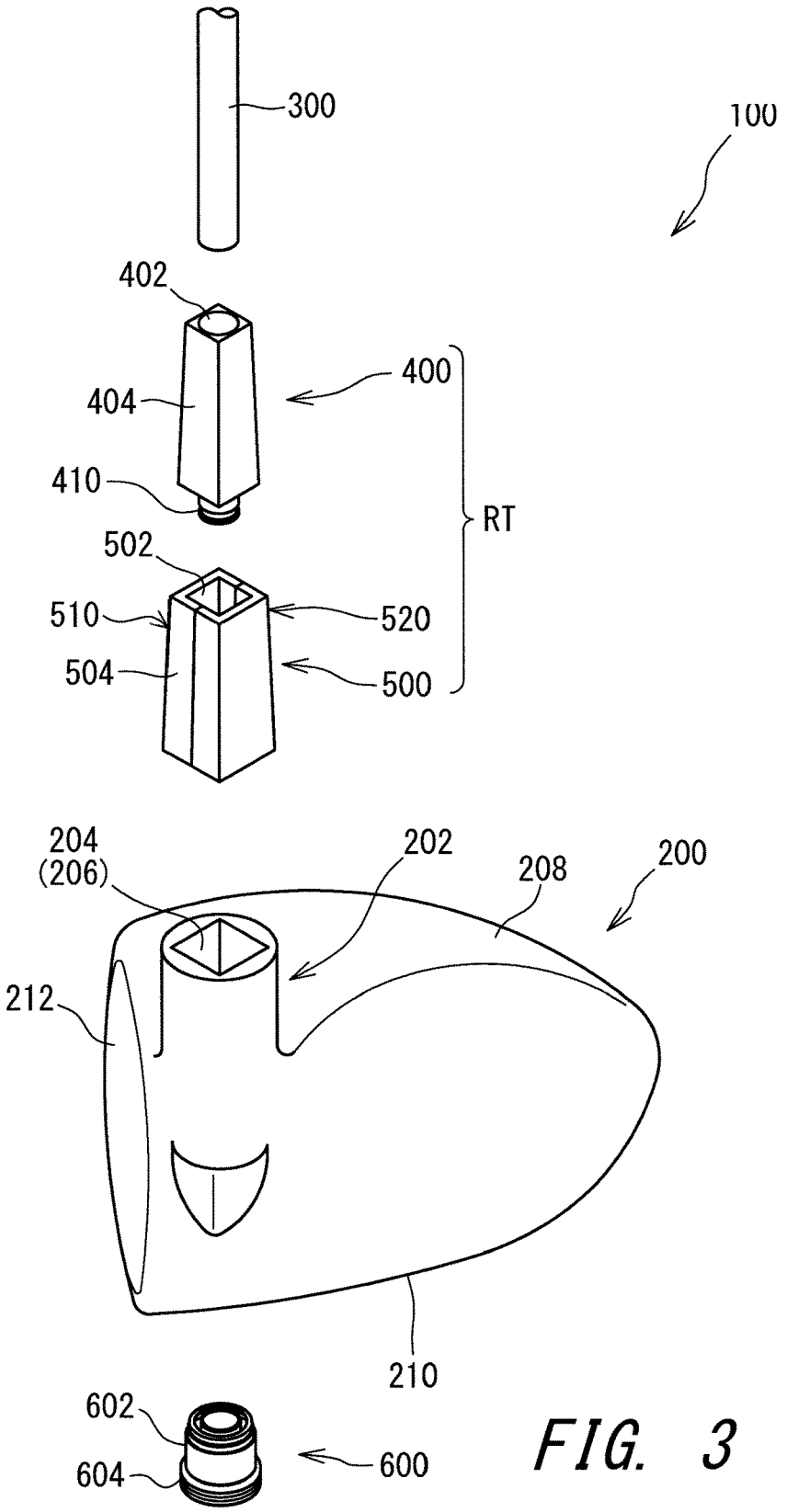
FIG. 3 is an exploded perspective view of the golf club in FIG. 1.

FIG. 1 shows a golf club 100 which is a first embodiment. FIG. 1 shows only the vicinity of a head of the golf club 100. FIG. 2 is a perspective view of the golf club 100 as viewed from a sole side. FIG. 3 is an exploded perspective view of the golf club 100.

The golf club 100 has a head 200, a shaft 300, a sleeve 400, a spacer 500, and a grip (not shown in the drawings). The sleeve 400 and the spacer 500 constitute the tip engagement part RT. The tip engagement part RT is disposed at a tip end portion of the shaft 300. An outer surface of the tip engagement part RT is formed by the spacer 500.

The type of the head 200 is not limited. The head 200 of the present embodiment is a wood type head. The head 200 may be a hybrid type head, an iron type head, a putter head or the like. The wood type head may be a driver head, or may be a head of a fairway wood.

The shaft 300 is not limited, and a commonly used shaft may be used. For example, a carbon shaft and a steel shaft may be used.

Although not shown in the drawings, the shaft 300 has a diameter varying with an axial direction position thereof. The diameter of the shaft 300 is increased toward the grip side. The sleeve 400 is fixed to the tip end portion of the shaft 300. The tip end portion of the shaft 300 is the thinnest portion in the shaft 300.

In the present embodiment, the number of the spacers 500 is one. The spacer 500 may not be present. The number of the spacers may be two. That is, two spacers may be stacked. In other words, the spacer may be double-layered. The number of the spacers may be three or more. For example, three spacers may be stacked. In other words, the spacer may be triple-layered.

The head 200 has a hosel part 202. The hosel part 202 has a hosel hole 204. The hosel hole 204 has a reverse-tapered hole 206. The shape of the reverse-tapered hole 206 corresponds to the shape of the outer surface of the tip engagement part RT. The shape of the reverse-tapered hole 206 corresponds to the shape of the outer surface of the spacer 500. In an engagement state, the outer surface of the tip engagement part RT (the outer surface of the spacer 500) is brought into surface-contact with the reverse-tapered hole 206. The outer surface of the tip engagement part RT has a plurality of (four) planes, and all of the planes are brought into surface-contact with the reverse-tapered hole 206.

The hosel part 202 (reverse-tapered hole 206) exists over the whole circumferential direction. The hosel part 202 (reverse-tapered hole 206) is continuous without a gap in the whole circumferential direction. The hosel part 202 is not split in the circumferential direction. The hosel part 202 does not have a slit (hosel slit) formed such that a part of the hosel part in the circumferential direction is lacking. The hosel part may have the slit. An embodiment having the slit will be described later.

As with a usual head, the head 200 has a crown 208, a sole 210, and a face 212 (see FIGS. 1 to 3).

As shown in FIG. 3, the sleeve 400 has an inner surface 402 and an outer surface 404. The inner surface 402 forms a shaft hole. The sectional shape of the inner surface 402 is a circle. The shape of the inner surface 402 corresponds to the shape of an outer surface of the shaft 300. The inner surface 402 is fixed to the tip end portion of the shaft 300. That is, the sleeve 400 is fixed to the tip end portion of the shaft 300. An adhesive is used for the fixation.

The outer surface 404 is a pyramid surface. The outer surface 404 is a four-sided pyramid surface. The sectional shape of the outer surface 404 is a non-circle. The sectional shape of the outer surface 404 is a polygon (regular polygon). The sectional shape of the outer surface 404 is a tetragon. The sectional shape of the outer surface 404 is a square. The area of a figure formed by a sectional line of the outer surface 404 is increased toward a tip side of the shaft 300. That is, the sleeve 400 has a reverse-tapered shape.

The sleeve 400 has a sleeve-side connection part 410. The sleeve-side connection part 410 is provided at a tip end portion (lower end portion) of the sleeve 400. The sleeve-side connection part 410 has a cylindrical shape as a whole. The sleeve-side connection part 410 has an engagement recess 412. The engagement recess 412 is provided on an outer circumferential surface of the sleeve-side connection part 410. The engagement recess 412 is a circumferential groove.

As shown in FIG. 3, the spacer 500 has an inner surface 502 and an outer surface 504. The inner surface 502 forms a sleeve hole. The sectional shape of the inner surface 502 corresponds to the sectional shape of the outer surface 404 of the sleeve 400. The outer surface 404 of the sleeve 400 is fitted to the inner surface 502. In other words, the sleeve 400 is fitted inside the spacer 500. The spacer 500 is not bonded to the sleeve 400. The spacer 500 merely abuts on the sleeve 400.

The shape of the inner surface 502 corresponds to the shape of the outer surface 404 of the sleeve 400. The inner surface 502 is a pyramid surface. The inner surface 502 is a four-sided pyramid surface. The sectional shape of the inner surface 502 is a non-circle. The sectional shape of the inner surface 502 is a polygon (regular polygon). The sectional shape of the inner surface 502 is a tetragon. The sectional shape of the inner surface 502 is a square. The area of a figure formed by a sectional line of the inner surface 502 is increased toward the tip side of the shaft 300.

The shape of the outer surface 504 (outer surface of the tip engagement part RT) corresponds to the shape of the reverse-tapered hole 206. The outer surface 504 is a pyramid surface. The outer surface 504 is a four-sided pyramid surface. The sectional shape of the outer surface 504 is a non-circle. The sectional shape of the outer surface 504 is a polygon (regular polygon). The sectional shape of the outer surface 504 is a tetragon. The sectional shape of the outer surface 504 is a square. The area of a figure formed by a sectional line of the outer surface 504 is increased toward the tip side of the shaft 300. That is, the spacer 500 has a reverse-tapered shape. The sleeve 400 and the spacer 500 constitute the tip engagement part RT.

The golf club 100 has a screw member 600. The screw member 600 has a screw-side connection part 602 and a male screw part 604. The screw-side connection part 602 is positioned on the sleeve side (upper side) of the male screw part 604. The male screw part 604 constitutes a rear end portion (lower end portion) of the screw member 600. The screw-side connection part 602 can be detachably connected to the sleeve-side connection part 410. As a result, the screw member 600 can be detachably connected to the sleeve 400.

The connection between the sleeve 400 and the screw member 600 can be easily made. The connection can be achieved by simply pressing the screw member 600 against the sleeve 400. In other words, the screw member 600 can be connected to the sleeve 400 by a one-touch operation. The connection is automatically completed by simply inserting the sleeve-side connection part 410 to the screw-side connection part 602. In addition, the connection can be easily released. The screw member 600 can also be easily removed from the sleeve 400. The details of the connecting mechanism between the sleeve 400 and the screw member 600 will be described later.

Figure 4:
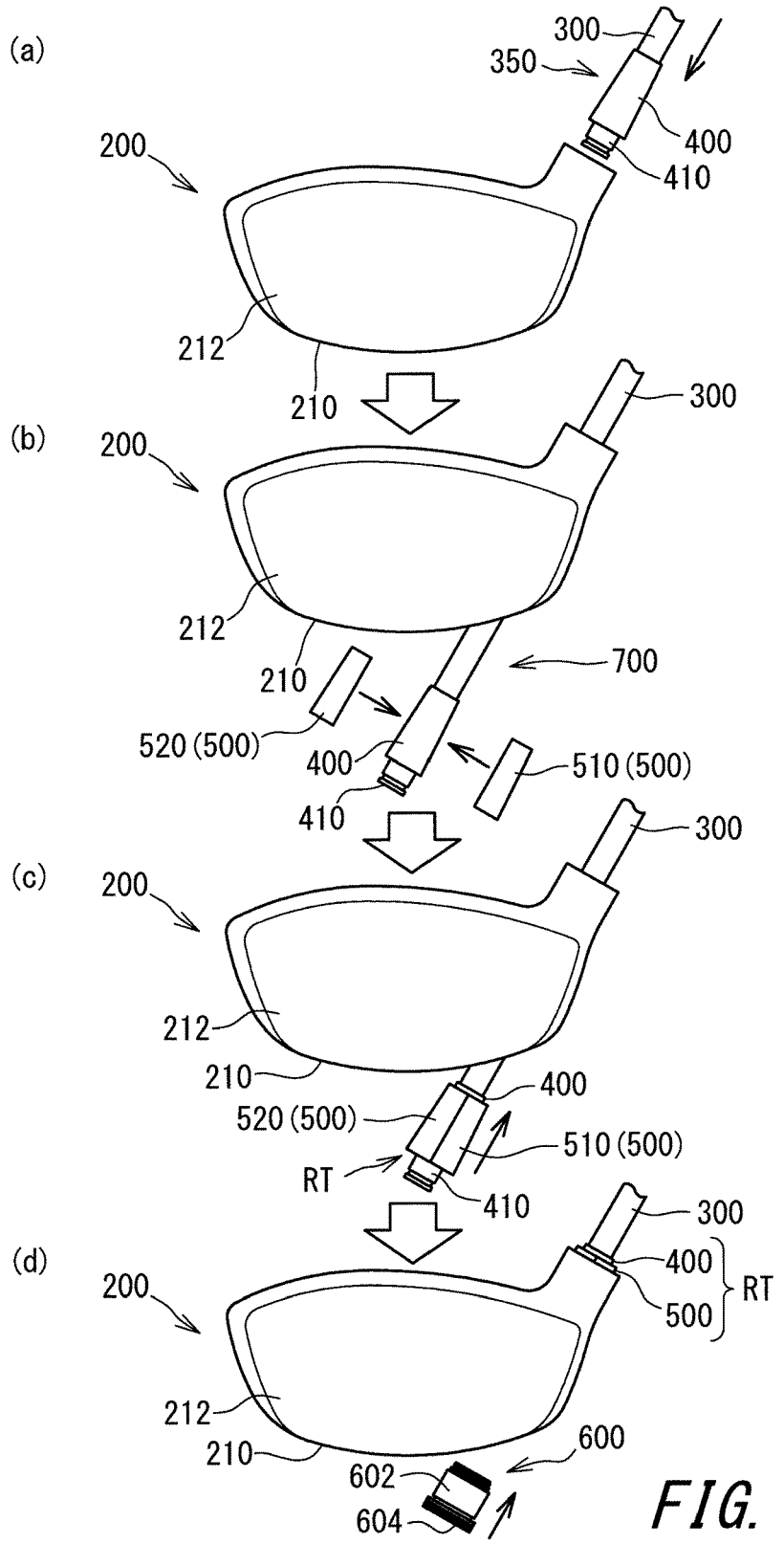
FIG. 4 is an assembling process view of the golf club in FIG. 1.

FIG. 4 shows a procedure of mounting the shaft 300 to the head 200.

In the mounting procedure, an intermediate body 350 is first prepared (step (a) in FIG. 4). The intermediate body 350 has a shaft 300 and a sleeve 400. In the intermediate body 350, the sleeve 400 is fixed (bonded) to the tip end portion of the shaft 300.

Next, the sleeve 400 of the intermediate body 350 is made to pass through the hosel hole 204 (step (b) in FIG. 4). The sleeve 400 is made to completely pass through the hosel hole 204. The sleeve 400 is inserted to the hosel hole 204 from the upper side and is made to come out from the lower side of the hosel hole 204. The sleeve 400 is moved to a lower side of the sole 210 by the passing (step (b) in FIG. 4).

Next, the spacer 500 is attached to the sleeve 400 (step (b) in FIG. 4). The spacer 500 is attached to the sleeve 400 in a state where the sleeve 400 has passed through the hosel hole 204. The spacer 500 is externally attached to the sleeve 400. The spacer 500 is attached to externally cover the sleeve 400. The tip engagement part RT is completed by attaching the spacer 500 to the sleeve 400. As described later, the spacer 500 has a divided structure. This divided structure makes it possible to attach the spacer 500 externally to the sleeve 400.

Next, the intermediate member 350 is moved to the upper side with respect to the head 200, whereby the tip engagement part RT (spacer 500) is fitted to the reverse-tapered hole 206 (step (c) in FIG. 4). As a result, the shaft 300 is attached to the head 200. The mounting of the shaft 300 to the head 200 is achieved by the fitting. In other words, an engagement state is achieved by the fitting. The engagement state is a state where the shaft 300 is fixed to the head 200. In the engagement state, the golf club 100 can be used. In the engagement state, all reverse-tapered fittings are achieved. All reverse-tapered fittings mean: a fitting between the outer surface 404 and the inner surface 502; and a fitting between the outer surface 504 and the reverse-tapered hole 206.

Next, the screw member 600 is attached to a head 200 (step (d) in FIG. 4). The screw member 600 is attached to the head 200 from the lower side. The screw member 600 is rotated in a first direction, and is screwed into a female screw part of the head 200. For the rotation, a tool such as a wrench may be used. The first direction is a direction in which the screw member 600 is fastened. As the screw-connection progresses, the screw member 600 is moved to a direction (the upper side) approaching the hosel hole 204. With this movement, the screw member 600 presses the tip engagement part RT in an engaging direction (to the upper side). The pressing ensures the above-described engagement state. The pressing makes it possible to eliminate backlash.

The screw member 600 has a rotating engagement part 606 for engaging the tool (see FIG. 2). The rotating engagement part 606 is a non-circular hole.

Thus, the shaft 300 is easily attached to the head 200.

As described above, the screw member 600 presses the tip engagement part RT. Simultaneously with the pressing, the screw member 600 is connected to the sleeve 400. When the screw member 600 is moved toward the tip engagement part RT, the sleeve-side connection part 410 is inserted to the screw-side connection part 602 of the screw member 600. By this insertion, the sleeve-side connection part 410 is automatically connected to the screw-side connection part 602. As a result, the sleeve 400 is connected to the screw member 600.

The connection between the sleeve 400 and the screw member 600 facilitates the removal of the shaft 300. To detach the shaft 300 from the head 200, the above-described procedure is performed in the reverse order. In the reverse procedure, first, the screw member 600 is rotated in a second direction. The second direction is a direction opposite to the first direction. The second direction is a direction in which the screw member 600 is loosened. By this rotation, the screw member 600 is moved to the lower side. The screw member 600 is moved in a direction away from the hosel hole 204. At this time, the connection between the sleeve 400 and the screw member 600 is maintained. While maintaining the connection between the sleeve 400 and the screw member 600, the screw member 600 is rotated in the second direction. By this movement, the screw member 600 pulls the tip engagement part RT in an engagement releasing direction. The tip engagement part RT is pulled out from the hosel hole 204 by the screw member 600.

Thus, the shaft 300 can also be removed from the head 200 easily.

As described above, in the golf club 100, the shaft 300 is detachably attached to the head 200. The shaft 300 can be removed and attached easily.

Figure 5:
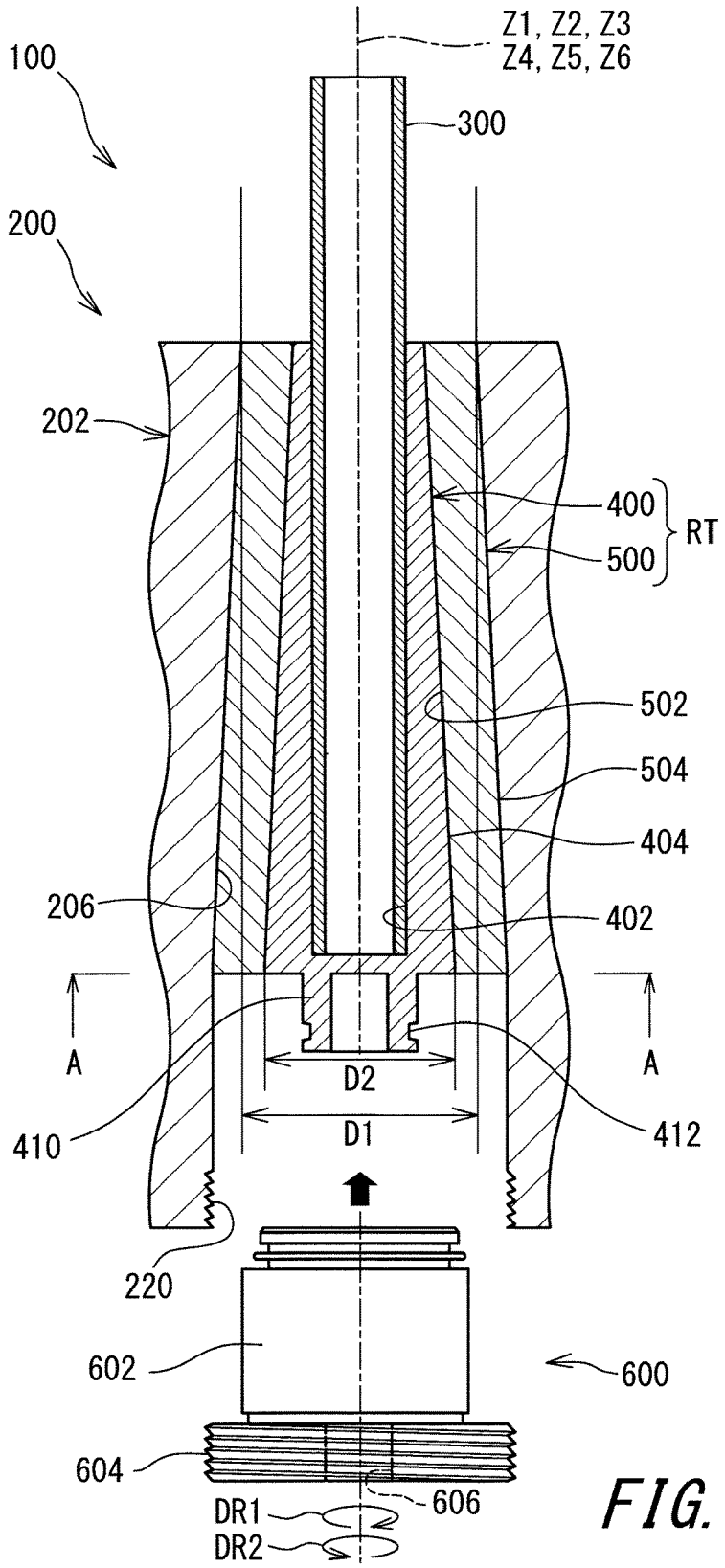
FIG. 5 is a sectional view of the golf club in FIG. 1.
Figure 6:
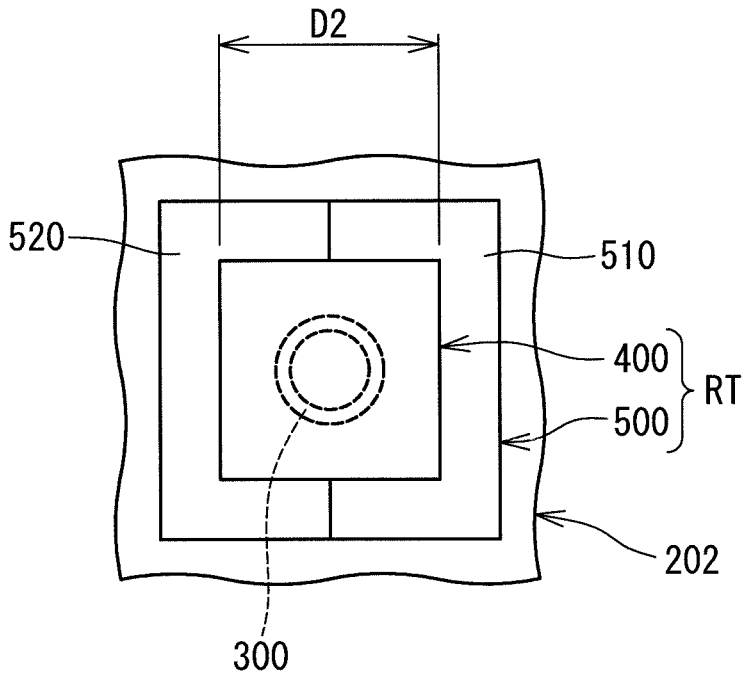
FIG. 6 is a bottom view in the vicinity of a tip engagement part according to a first embodiment.

FIG. 5 is a sectional view of the golf club 100 taken along the axial direction. FIG. 5 is an enlarged sectional view of the vicinity of the tip engagement part RT. FIG. 6 is a sectional view taken along line A-A in FIG. 5. In FIG. 6, the hatching is omitted.

As shown in FIG. 5, the head 200 has a female screw part 220. The female screw part 220 is coaxial with the reverse-tapered hole 206. That is, the center line of the female screw part 220 coincides with a center line Z6 of the reverse-tapered hole 206. The male screw part 604 of the screw member 600 is screw-connected to the female screw part 220. The details of the screw-connection will be described later.

As described above, in order to press the sleeve 400 in the engaging direction by the screw member 600, the screw member 600 is rotated in a first direction DR1, whereby the screw member 600 is screwed into the female screw part 220 (see FIG. 5). In contrast, in order to pull the sleeve 400 in the engagement releasing direction by the screw member 600, the screw member 600 is rotated in a second direction DR2.

In the present embodiment, a center line Z1 of the inner surface 402 of the sleeve 400 is not inclined with respect to a center line Z2 of the outer surface 404 of the sleeve 400. The center line Z1 conforms to the center line Z2. A center line Z3 of the shaft 300 is not inclined with respect to the center line Z2 of the outer surface 404 of the sleeve 400. The center line Z3 conforms to the center line Z2. A center line Z4 of the inner surface 502 of the spacer 500 is not inclined with respect to a center line Z5 of the outer surface 504 of the spacer 500. The center line Z4 conforms to the center line Z5. The center line Z4 of the inner surface 502 of the spacer 500 is not inclined with respect to a center line Z6 of the reverse-tapered hole 206 of the head 200. The center line Z4 conforms to the center line Z6. The center line Z3 of the shaft 300 is not inclined with respect to the center line Z6 of the reverse-tapered hole 206 of the head 200. The center line Z3 conforms to the center line Z6.

A double-pointed arrow D1 in FIG. 5 shows the minimum width of the hosel hole 204. In the present embodiment, the sectional shape of the hosel hole 204 is a square, and the minimum width D1 is the length of one side of the square at the upper end surface of the hosel hole 204.

A double-pointed arrow D2 in FIG. 5 shows the maximum width of the sleeve 400. In the present embodiment, the sectional shape of the outer surface 404 of the sleeve 400 is a square, and the maximum width D2 is the length of one side of the square at the lower end surface of the sleeve 400.

In the present embodiment, the minimum width D1 is larger than the maximum width D2. In other words, the minimum value of the sectional area of the hosel hole 204 is larger than the maximum value of the sectional area of the sleeve 400. The lower end of the sleeve 400 can pass through an opening of the upper end of the hosel hole 204. As a result, the sleeve 400 can pass through the hosel hole 204. The sleeve 400 can be inserted to the hosel hole 204 from the upper side, pass through the hosel hole 204, and come out from the lower side of the hosel hole 204. The thickness of the spacer 500 is set such that the minimum width D1 is larger than the maximum width D2.

Figure 7:
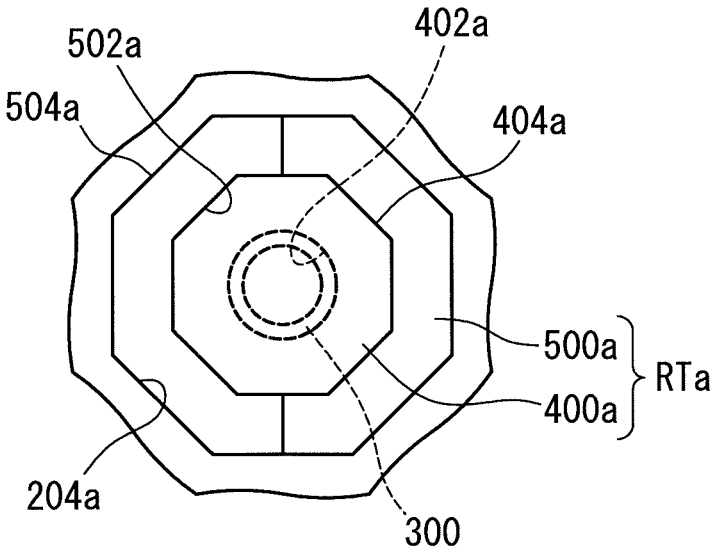
FIG. 7 is a bottom view of the vicinity of a tip engagement part according to a modification example.

FIG. 7 is a sectional view of a head having a tip engagement part RTa according to a modification example. FIG. 7 is a sectional view corresponding to FIG. 6. In FIG. 7, the hatching is also omitted. The tip engagement part RTa has a sleeve 400*a* and a spacer 500*a*. The sleeve 400*a* and the spacer 500*a* constitute the tip engagement part RTa.

The sleeve 400*a* has an inner surface 402*a* and an outer surface 404*a*. The inner surface 402*a* forms a shaft hole. The sectional shape of the inner surface 402*a* is a circle. The shape of the inner surface 402*a* corresponds to the shape of the outer surface of the shaft 300. The inner surface 402*a* is fixed to the tip end portion of the shaft 300. That is, the sleeve 400*a* is fixed to the tip end portion of the shaft 300. An adhesive is used for the fixation.

The outer surface 404*a* is a pyramid surface. The outer surface 404*a* is an eight-sided pyramid surface. The sectional shape of the outer surface 404*a* is a non-circle. The sectional shape of the outer surface 404*a* is a polygon (regular polygon). The sectional shape of the outer surface 404*a* is an octagon. The sectional shape of the outer surface 404*a* is a regular octagon. The area of a figure formed by a sectional line of the outer surface 404*a* is increased toward the tip side of the shaft 300. That is, the sleeve 400*a* has a reverse-tapered shape.

The spacer 500*a* has an inner surface 502*a* and an outer surface 504*a*. The inner surface 502*a* forms a sleeve hole. The sectional shape of the inner surface 502*a* corresponds to the sectional shape of the outer surface 404*a* of the sleeve 400*a*. The outer surface 404*a* of the sleeve 400*a* is fitted to the inner surface 502*a*. In other words, the sleeve 400*a* is fitted inside the spacer 500*a*. The spacer 500*a* is not bonded to the sleeve 400*a*. The spacer 500*a* is merely brought into contact with the sleeve 400*a*.

The shape of the inner surface 502*a* corresponds to the shape of the outer surface 404*a* of the sleeve 400*a*. The inner surface 502*a* is a pyramid surface. The inner surface 502*a* is an eight-sided pyramid surface. The sectional shape of the inner surface 502*a* is a non-circle. The sectional shape of the inner surface 502*a* is a polygon (regular polygon). The sectional shape of the inner surface 502*a* is an octagon. The sectional shape of the inner surface 502*a* is a regular octagon. The area of a figure formed by a sectional line of the inner surface 502*a* is increased toward the tip side of the shaft 300.

The shape of the outer surface 504*a* (outer surface of the tip engagement part RTa) corresponds to the shape of a reverse-tapered hole. The outer surface 504*a* is a pyramid surface. The outer surface 504*a* is an eight-sided pyramid surface. The sectional shape of the outer surface 504*a* is a non-circle. The sectional shape of the outer surface 504*a* is a polygon (regular polygon). The sectional shape of the outer surface 504*a* is an octagon. The sectional shape of the outer surface 504*a* is a regular octagon. The area of a figure formed by a sectional line of the outer surface 504*a* is increased toward the tip side of the shaft 300.

Figure 8:
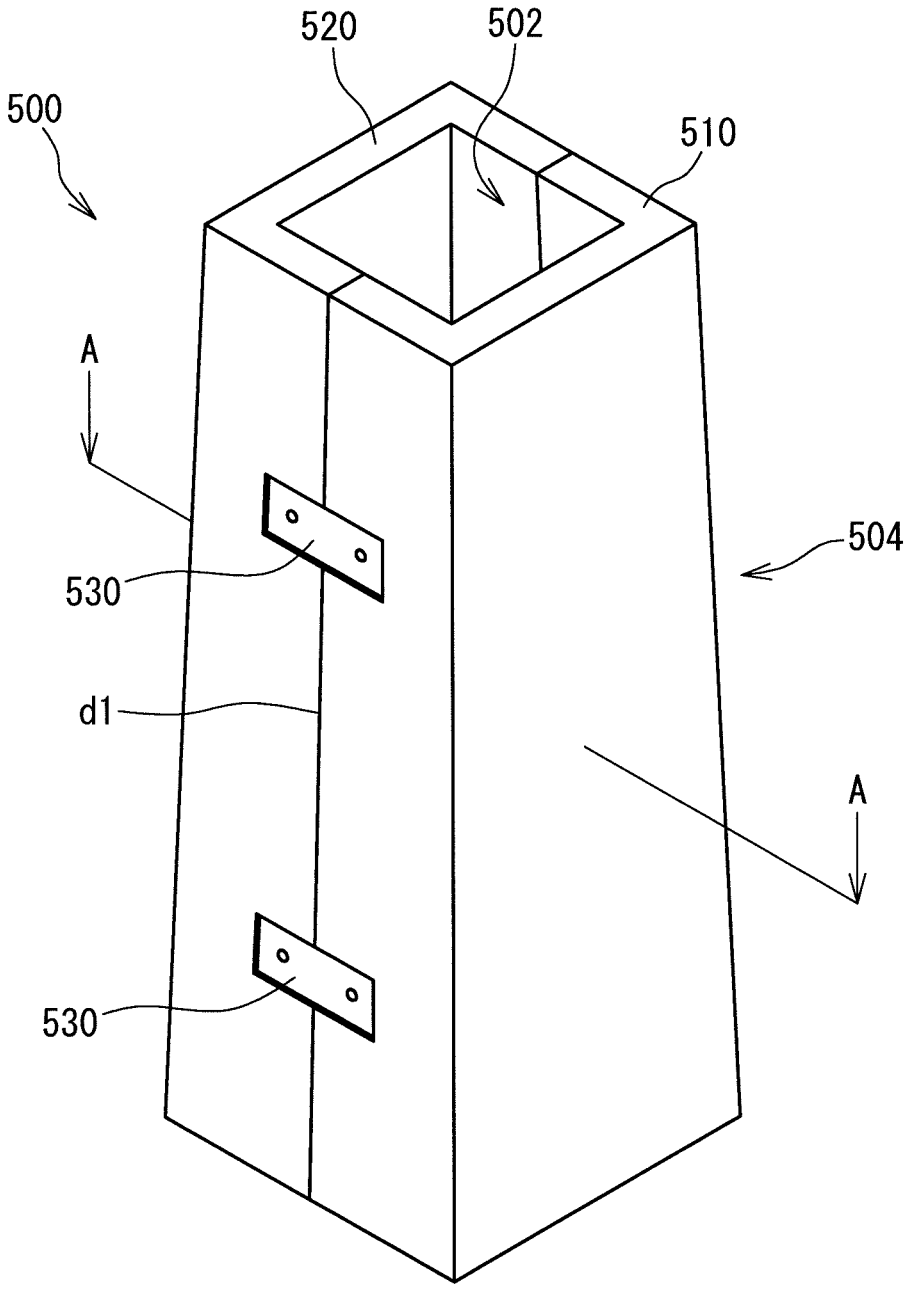
FIG. 8 is a perspective view of a spacer.

FIG. 8 is a perspective view of the spacer 500. FIG. 9(*a*) is a sectional view taken along line A-A in FIG. 8. As described above, the spacer 500 has the inner surface 502 and the outer surface 504.

The spacer 500 has a divided structure. The spacer 500 has a first divided body 510 and a second divided body 520. A divisional line d1 is shown in FIG. 8. The divisional line d1 is a boundary between the first divided body 510 and the second divided body 520.

The spacer 500 has a connecting part 530, although not shown in the drawings except FIG. 8. In the present embodiment, the connecting part 530 is a plate spring. The plate spring is an elastic body. In the present embodiment, two connecting parts 530 are provided. One side of each of the connecting parts 530 is fixed to the first divided body 510, and the other side of each of the connecting parts 530 is fixed to the second divided body 520.

The connecting parts 530 are housed in respective recessed parts provided on the outer surface 504. The connecting parts 530 are not projected outside the outer surface 504. The connecting parts 530 do not hamper contact between the reverse-tapered hole 206 and the outer surface 504.

Although the step (b) in FIG. 4 shows that the first divided body 510 and the second divided body 520 are separated from each other, the spacer 500 is actually configured to open and close. The connecting parts 530 play the role of a hinge. The spacer 500 opens on the connecting parts 530. The spacer 500 opens by applying an external force. This opened state is shown by two-dot chain lines in FIG. 9(*a*). The spacer 500 opens by bending the connecting parts 530 (plate springs). In this opened state, a gap gp is produced between the first divided body 510 and the second divided body 520. The sleeve 400 can be put inside the spacer 500 through the gap gp. The spacer 500 is closed in a state where the sleeve 400 is put inside the spacer. The plate springs 530 bias the spacer 500 so that the spacer 500 is in a closed state. Therefore, the spacer 500 is (automatically) closed if the external force is lost.

The connecting parts 530 can maintain a connected state in which the first divided body 510 is connected to the second divided body 520. The spacer 500 is in the connected state when an external force does not act on the spacer 500. The connected state is a state of the spacer 500 in the golf club 100 usable as a club.

The spacer 500 has a position adjusting structure to prevent a positional displacement between the first divided body 510 and the second divided body 520. As the position adjusting structure, a plate splicing structure may be applied.

The embodiment of FIG. 9(*a*) includes an example of the position adjusting structure. In the position adjusting structure, the first divided body 510 has an abutting surface m1 which prevents the positional displacement in a thickness direction, and an abutting surface m2 which prevents the positional displacement in an axial direction. Similarly, the second divided body 520 has the abutting surface m1 which prevents the positional displacement in the thickness direction, and the abutting surface m2 which prevents the positional displacement in the axial direction. In the spacer 500 in the closed state, the abutting surface m1 of the first divided body 510 abuts on the abutting surface m1 of the second divided body 520, and the abutting surface m2 of the first divided body 510 abuts on the abutting surface m2 of the second divided body 520. Therefore, the positional displacements in the thickness direction and the axial direction are prevented.

The spacer 500 can fulfill the function thereof even if the spacer 500 does not have the position adjusting structure because the spacer 500 is fitted to the outer surface of the sleeve, the inner surface of the hosel hole, etc. In comparison between the abutting surfaces m1 and the abutting surfaces m2, the abutting surfaces m2 which prevent the positional displacement in the axial direction is more effective. This is because the spacer 500 is fitted to the outer surface of the sleeve, the inner surface of the hosel hole, etc., and thus the positional displacement in the thickness direction is less likely to occur. In this respect, the position adjusting structure preferably includes the abutting surfaces m2 which prevent the positional displacement in the axial direction, and more preferably includes the abutting surfaces m2 which prevent the positional displacement in the axial direction, and the abutting surfaces m1 which prevent the positional displacement in the thickness direction.

As shown in FIG. 9(*a*), the divisional line d1 of the spacer 500 includes a first divisional line d11 and a second divisional line d12. The first divisional line d11 is a divisional line on which the connecting parts 530 are not present. The second divisional line d12 is a divisional line on which the connecting parts 530 are present. In FIG. 9(*a*), the above-described position adjusting structure provided on the first divisional line d11 is shown. Preferably, the position adjusting structure is provided also on the second divisional line d12.

FIG. 9(*b*) shows another position adjusting structure. In this position adjusting structure, a projection of a first member Pt1 and a recess of a second member Pt2 are butted against each other. The center side in a thickness direction of the first member Pt1 is overlapped with an inner side and an outer side in a thickness direction of the second member Pt2. The first member Pt1 is either one of the first divided body 510 and the second divided body 520. The second member Pt2 is the other of the first divided body 510 and the second divided body 520.

FIG. 9(*c*) shows another position adjusting structure. In this position adjusting structure, a projection of a first member Pt1 and a recess of a second member Pt2 are butted against each other. The section of the projection of the first member Pt1 is constituted by slopes. The section of the recess of the second member Pt2 is constituted by slopes. The center side in a thickness direction of the first member Pt1 is overlapped with an inner side and an outer side in a thickness direction of the second member Pt2. The first member Pt1 is either one of the first divided body 510 and the second divided body 520. The second member Pt2 is the other of the first divided body 510 and the second divided body 520.

The position adjusting structures shown in FIG. 9(*b*) and FIG. 9(*c*) can also prevent the positional displacement in the axial direction in addition to the positional displacement in the thickness direction. For example, when such a position adjusting structure as shown in FIG. 9(*b*) or FIG. 9(*c*) is adopted only at a part of the axial direction, an abutting surface capable of preventing the positional displacement in the axial direction can be formed at a termination position of the position adjusting structure. Therefore, the positional displacement in the axial direction can be prevented.

Figure 10:
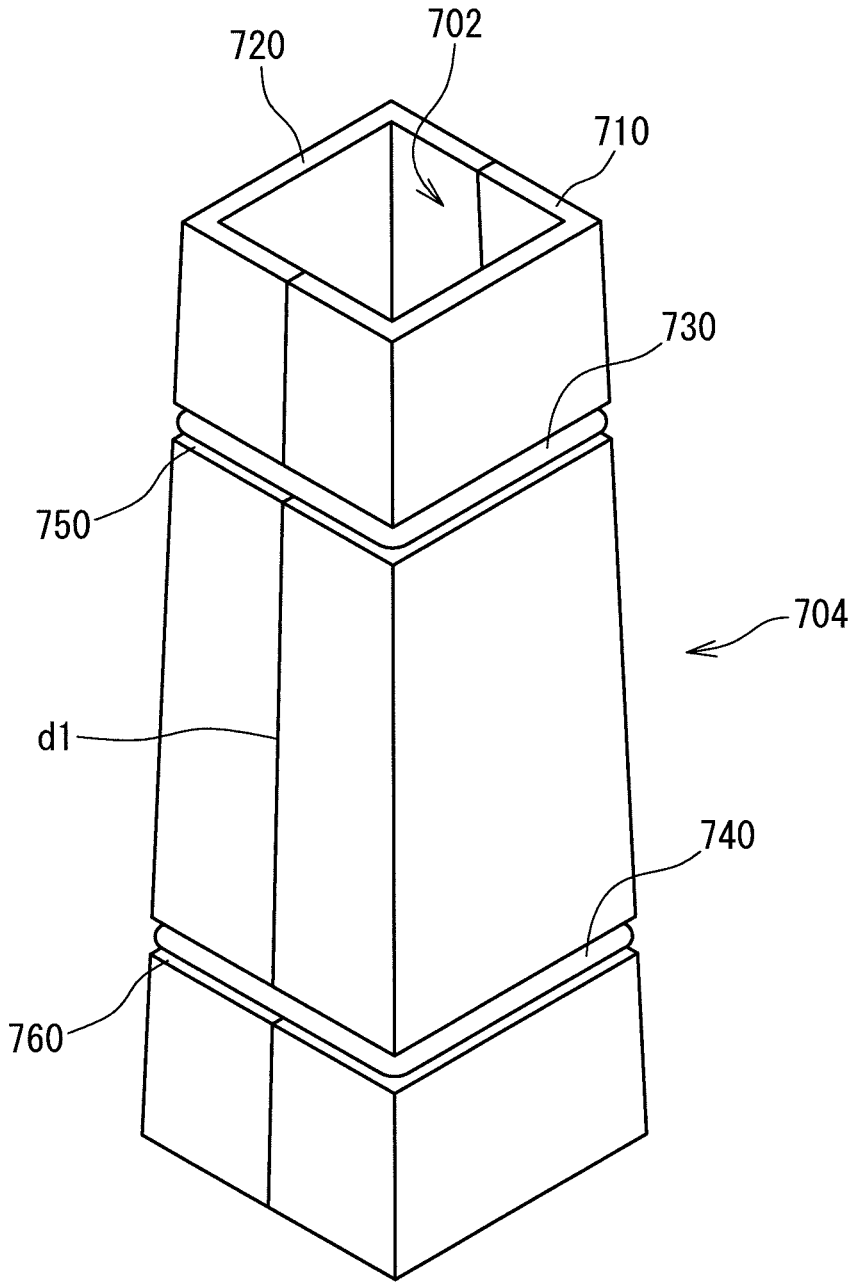
FIG. 10 is a perspective view of a spacer according to a modification example.

FIG. 10 is a perspective view of a spacer 700 according to another modification example. The spacer 700 has an inner surface 702 and an outer surface 704.

The spacer 700 has a divided structure. The spacer 700 has a first divided body 710 and a second divided body 720. A divisional line d1 is shown in FIG. 10. The divisional line d1 is a boundary between the first divided body 710 and the second divided body 720.

The spacer 700 has ring-shaped elastic bodies 730 and 740. The spacer 700 further has circumferential grooves 750 and 760. The elastic bodies 730 and 740 are fitted to the circumferential grooves 750 and 760, respectively. The elastic bodies 730 and 740 are not projected outside the outer surface 704. The elastic bodies 730 and 740 do not hamper contact between the outer surface 704 and a reverse-tapered surface to which the outer surface 704 is fitted. The reverse-tapered surface to which the outer surface 704 is fitted is the reverse-tapered hole of the head or an inner surface of another spacer. The elastic bodies 730 and 740 are an example of a connecting part capable of maintaining a connected state in which the first divided body 710 and the second divided body 720 are connected to each other.

The elastic bodies 730 and 740 can be removed by applying an external force to stretch the elastic bodies 730 and 740. The first divided body 710 and the second divided body 720 can be separated from each other by removing the elastic bodies 730 and 740. On the contrary, the elastic bodies 730 and 740 can be attached after butting the first divided body 710 and the second divided body 720 against each other. The elastically contractile force of the elastic bodies 730 and 740 biases the divided bodies 710 and 720 so that the two divided bodies 710 and 720 are abutted against each other. For example, this spacer 700 also enables to replace a spacer.

Thus, the spacer 500 and the spacer 700 each have the divided structure. The spacer 500 and the spacer 700 each have the first divided body and the second divided body. The spacer 500 and the spacer 700 each have the connecting part capable of maintaining the connected state in which the first divided body is connected to the second divided body. In the spacer 500 and the spacer 700, the mutual transition between the connected state in which the first divided body and the second divided body are connected to each other, and a separated state in which a gap is formed between the first divided body and the second divided body is enabled. In the separated state, the sleeve can be disposed inside the spacer by allowing the sleeve to pass through the gap. In the separated state, the spacer can be detached from or attached to the shaft 300 to which the sleeve 400 is fixed.

Figure 11:
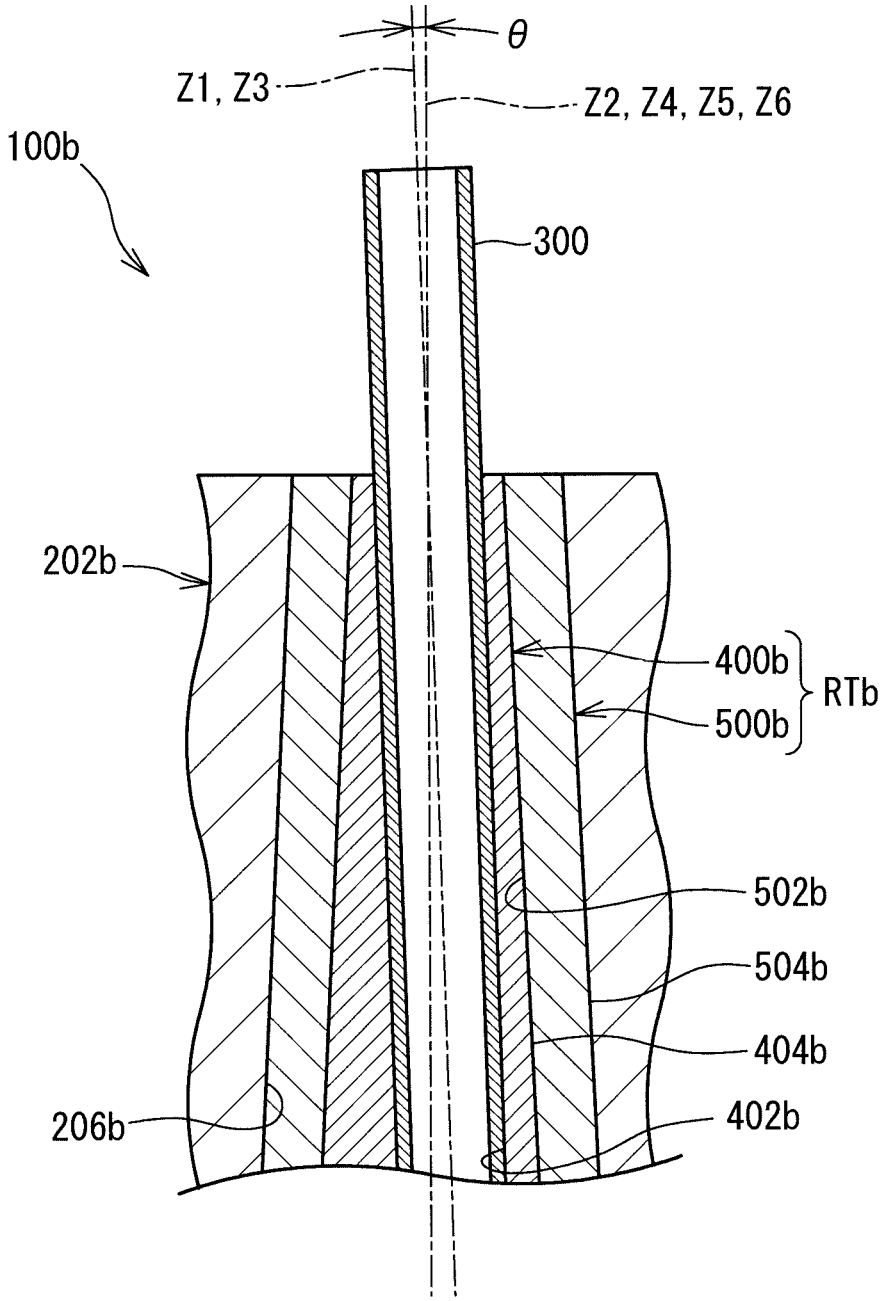
FIG. 11 is a sectional view of a golf club according to a modification example.

FIG. 11 is a sectional view of a golf club 100*b* according to another embodiment. FIG. 11 is an enlarged sectional view of the vicinity of a tip engagement part RTb.

In the present embodiment, a center line Z1 of an inner surface 402*b* of a sleeve 400*b* is inclined with respect to a center line Z2 of an outer surface 404*b* of the sleeve 400*b*. The inclination angle is θ degree. The center line Z3 of the shaft 300 is inclined with respect to the center line Z2 of the outer surface 404*b* of the sleeve 400*b*. The inclination angle is θ degree. A center line Z4 of an inner surface 502*b* of a spacer 500*b* is not inclined with respect to a center line Z5 of an outer surface 504*b* of the spacer 500*b*. The center line Z4 conforms to the center line Z5. The center line Z4 of the inner surface 502*b* of the spacer 500*b* is not inclined with respect to a center line Z6 of a reverse-tapered hole 206*b* of a head 200*b*. The center line Z4 conforms to the center line Z6. The center line Z3 of the shaft 300 is inclined with respect to the center line Z6 of the reverse-tapered hole 206*b*. The inclination angle is θ degree.

Thus, in the embodiment of FIG. 11, the center line Z1 of the inner surface 402*b* of the sleeve 400*b* is inclined with respect to the center line Z6 of the reverse-tapered hole 206*b*. Therefore, a loft angle and a lie angle can be changed based on a rotation position of the sleeve 400*b*. The embodiment of FIG. 11 has an angle adjusting function.

The center line Z4 of the inner surface 502*b* of the spacer 500*b* may be inclined with respect to the center line Z5 of the outer surface 504*b* of the spacer 500*b*. The inclination between the center line Z1 of the inner surface 402*b* of the sleeve 400*b* and the center line Z2 of the outer surface 404*b* is defined as an inclination A, and the inclination between the center line Z4 of the inner surface 502*b* of the spacer 500*b* and the center line Z5 of the outer surface 504*b* is defined as an inclination B. The inclination A and the inclination B may be used alone or in combination. This combination enhances the degree of freedom of angle adjustment.

Although not shown in the drawings, the sleeve 400*b* also has a sleeve-side connection part. In the present embodiment, the position of the sleeve-side connection part changes because of the inclination. To address the change, a sleeve including an adjustment mechanism in which the sleeve-side connection part is movable with respect to the sleeve body may be used, for example. Such a sleeve will be described later.

[Rotation Position of Sleeve]

The sleeve can be rotated about the center line of the sleeve itself. The rotation position of the sleeve is changed by the rotation. In the engagement state, the sleeve can take a plurality of rotation positions. The number of the rotation positions which can be taken is set based on the shape of the outer surface of the sleeve.

[Rotation Position of Spacer]

The spacer can be rotated about the center line of the spacer itself. The rotation position of the spacer is changed by the rotation. In the engagement state, the spacer can take a plurality of rotation positions. The number of the rotation positions which can be taken is set based on the shape of the outer surface of the spacer.

[Adjustment of Position and Direction of Center Line of Shaft]

The center line of the shaft hole (the center line of the shaft) can be displaced with respect to the center line of the outer surface of the sleeve. These center lines may be inclined with respect to each other, or may be displaced in parallel to each other (parallel and eccentric). Inclination and eccentricity may be combined. In this case, the direction and/or the position of the center line of the shaft can be changed by the rotation position of the sleeve.

The center line of the inner surface of the spacer can be displaced with respect to the center line of the outer surface of the spacer. These center lines may be inclined with respect to each other, or may be displaced in parallel to each other (parallel and eccentric). Inclination and eccentricity may be combined. In this case, the direction and/or the position of the center line of the shaft can be changed by the rotation position of the spacer.

The rotation position of the spacer can be selected independently of the rotation position of the sleeve. In addition, when a plurality of spacers are used, rotation positions of the respective spacers can be selected independently of each other. The degree of freedom of the adjustment is enhanced by the spacer. The degree of freedom of the adjustment is further enhanced by using a plurality of spacers. In these respects, the number of the spacers which are stacked is preferably one or two or more. In view of complexity of adjustment and downsizing of the hosel part, the number of the spacers which are stacked is preferably one or two.

FIG. 12 to FIG. 17 are plan views showing the position of a lower end surface of the tip engagement part. The illustration of the sleeve-side connection part is omitted in these plan views. Changes in the position and the direction of the center line of the shaft will be explained using these plan views.

In FIG. 12 to FIG. 17, the following abbreviations are used.

LI: lie angle
LF: loft angle
FP: face progression
DC: distance of the center of gravity
L: large
M: medium
S: small FIG. 12 to FIG. 15 show an embodiment A in which the number of the spacers is one. In this embodiment, a sleeve sv1 and a spacer sp1 are used. A position Zs of the center line of the shaft at the lower end of the hosel hole is shown by the intersection point of solid lines. The intersection point of one-dot chain lines shows a position of the center line of the shaft at the upper end of the hosel hole. In this embodiment, the position of the center line of the shaft at the upper end of the hosel hole is not changed regardless of the rotation positions of the sleeve sv1 and the spacer sp1.

The embodiment A shown in FIG. 12 to FIG. 15 satisfies the following (A1) and (A2).

(A1) A center line of an inner surface of the sleeve sv1 (that is, the center line of the shaft) is inclined with respect to a center line of an outer surface of the sleeve sv1.

(A2) A center line of an inner surface of the spacer sp1 is inclined with respect to a center line of an outer surface of the spacer sp1.

In the embodiment A, the outer surface of the sleeve sv1 is a four-sided pyramid surface, each of the inner surface and the outer surface of the spacer sp1 is also a four-sided pyramid surface, and a reverse-tapered hole is also a four-sided pyramid surface. Therefore, the number of the rotation positions of the sleeve sv1 is four, and the number of the rotation positions of the spacer sp1 is also four. In the embodiment A, the number of kinds of combinations of the rotation positions of the sleeve sv1 and the rotation positions of the spacer sp1 is: 4×4=16. A golf club according to the embodiment A is excellent in degree of freedom of adjustment. FIG. 12 to FIG. 15 show all the 16 kinds of combinations.

Figure 12:
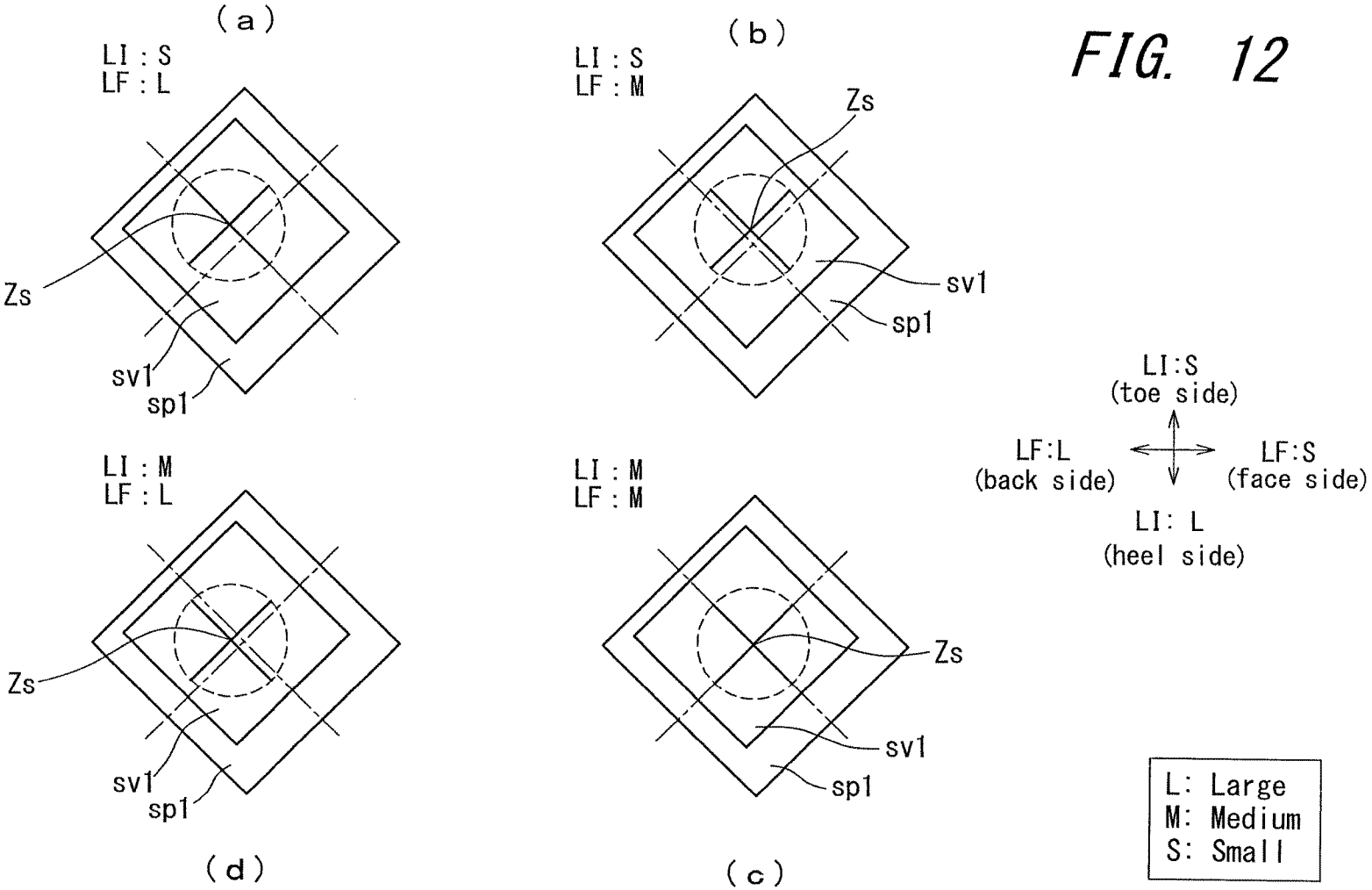
FIG. 12 is plan views showing the position of a lower end surface of the tip engagement part, and shows variations of a position of a center line of the shaft.

In state (a) of FIG. 12, the rotation position of the sleeve sv1 is a first position, and the rotation position of the spacer sp1 is a first position. In state (b) of FIG. 12, the rotation position of the sleeve sv1 is a second position, and the rotation position of the spacer sp1 is the first position. In state (c) of FIG. 12, the rotation position of the sleeve sv1 is a third position, and the rotation position of the spacer sp1 is the first position. In state (d) of FIG. 12, the rotation position of the sleeve sv1 is a fourth position, and the rotation position of the spacer sp1 is the first position.

Figure 13:
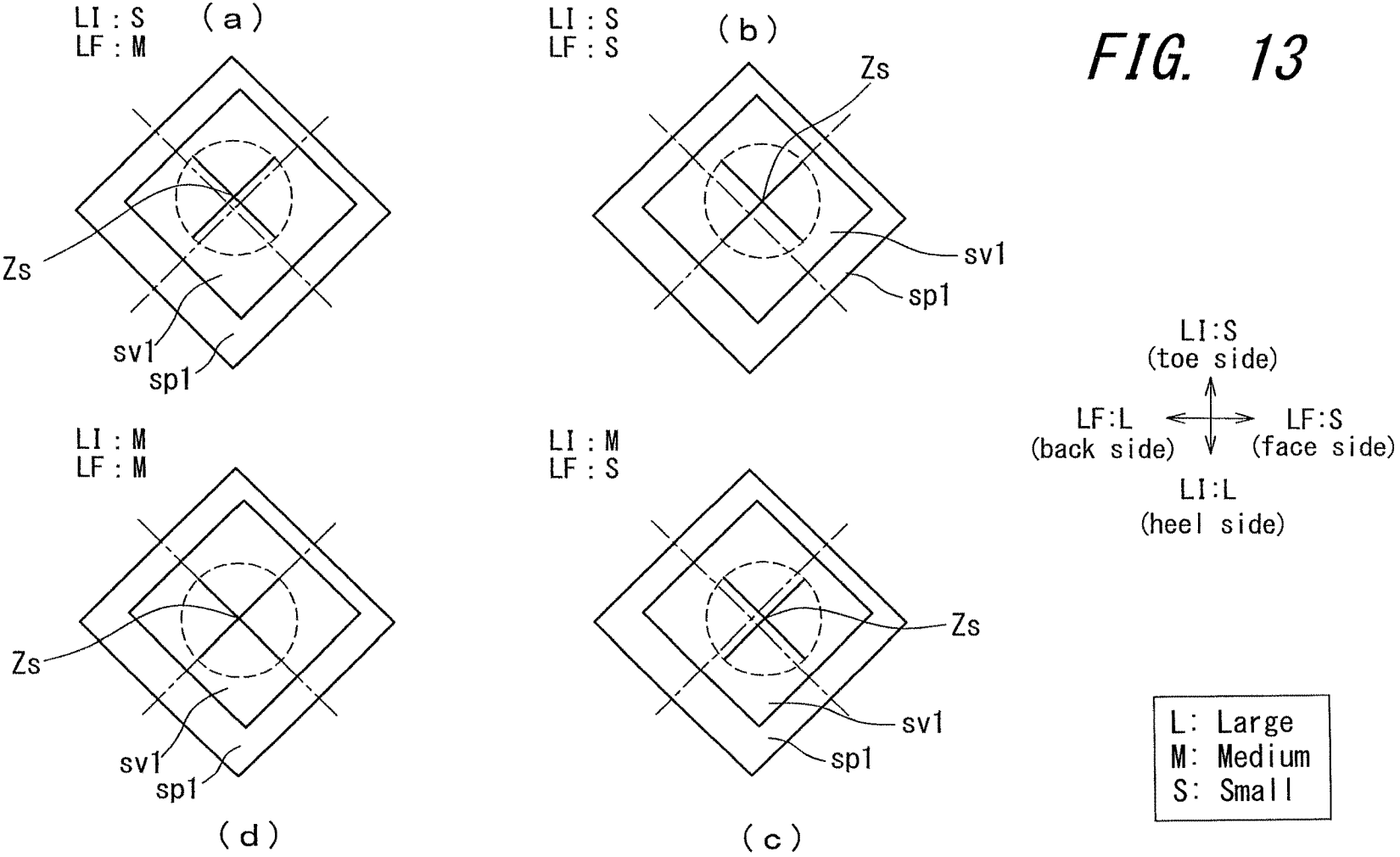

In state (a) of FIG. 13, the rotation position of the sleeve sv1 is the first position, and the rotation position of the spacer sp1 is a second position. In state (b) of FIG. 13, the rotation position of the sleeve sv1 is the second position, and the rotation position of the spacer sp1 is a second position. In state (c) of FIG. 13, the rotation position of the sleeve sv1 is the third position, and the rotation position of the spacer sp1 is the second position. In state (d) of FIG. 13, the rotation position of the sleeve sv1 is the fourth position, and the rotation position of the spacer sp1 is the second position.

Figure 14:
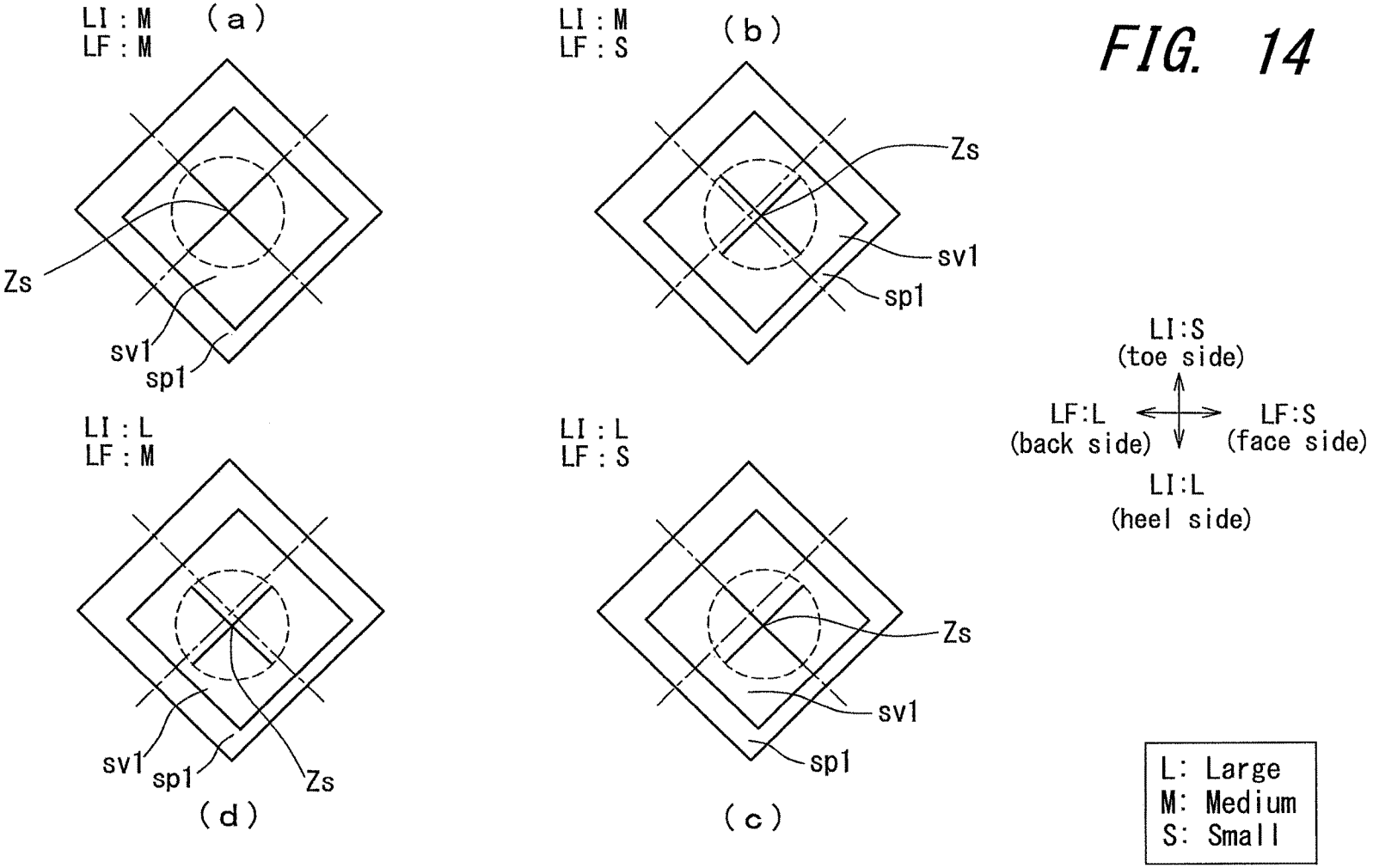

In state (a) of FIG. 14, the rotation position of the sleeve sv1 is the first position, and the rotation position of the spacer sp1 is a third position. In state (b) of FIG. 14, the rotation position of the sleeve sv1 is the second position, and the rotation position of the spacer sp1 is the third position. In state (c) of FIG. 14, the rotation position of the sleeve sv1 is the third position, and the rotation position of the spacer sp1 is the third position. In state (d) of FIG. 14, the rotation position of the sleeve sv1 is the fourth position, and the rotation position of the spacer sp1 is the third position.

Figure 15:
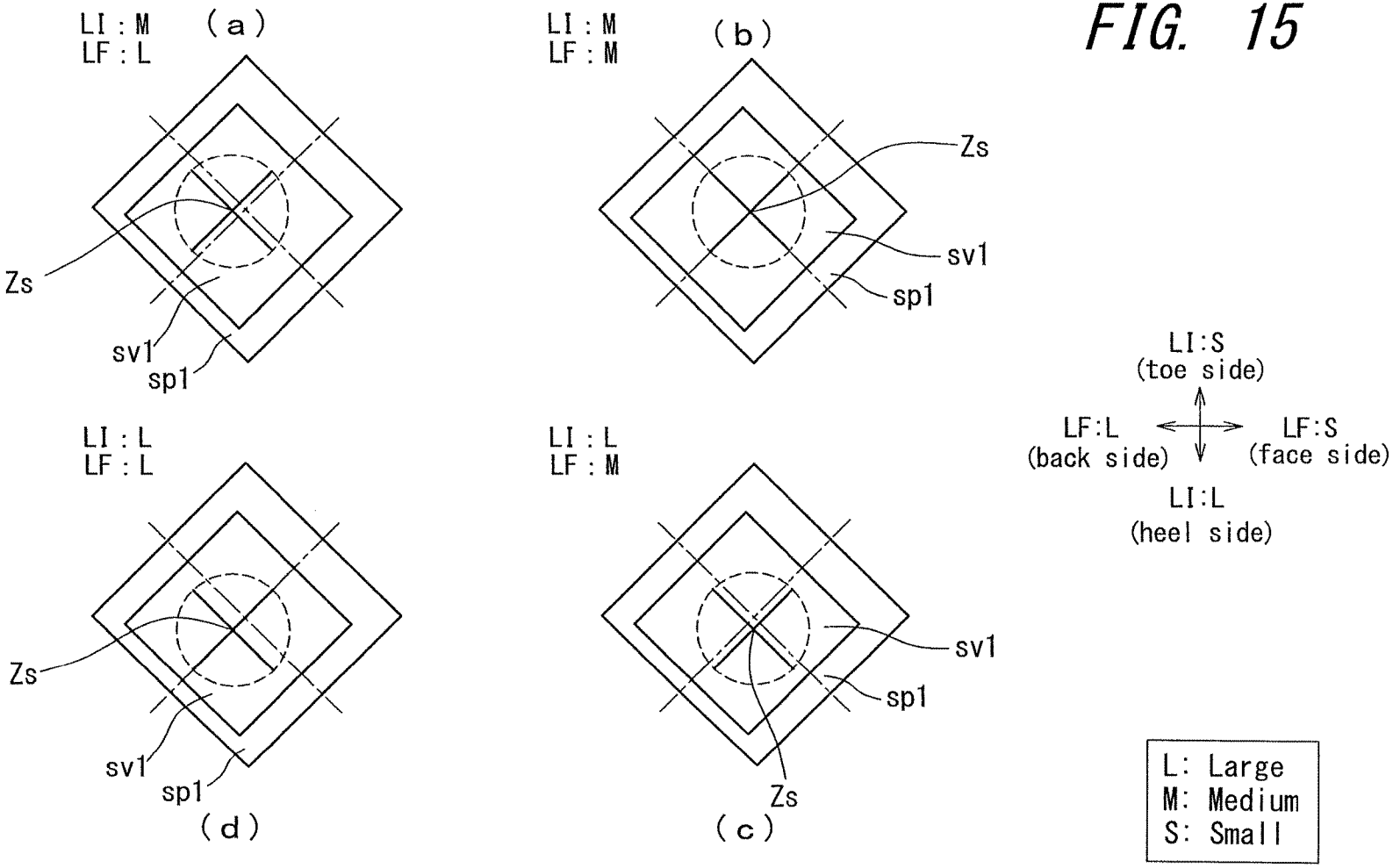

In state (a) of FIG. 15, the rotation position of the sleeve sv1 is the first position, and the rotation position of the spacer sp1 is a fourth position. In state (b) of FIG. 15, the rotation position of the sleeve sv1 is the second position, and the rotation position of the spacer sp1 is the fourth position. In state (c) of FIG. 15, the rotation position of the sleeve sv1 is the third position, and the rotation position of the spacer sp1 is the fourth position. In state (d) of FIG. 15, the rotation position of the sleeve sv1 is the fourth position, and the rotation position of the spacer sp1 is the fourth position.

These 16 kinds of combinations include 9 kinds of positions Zs. That is, the center line of the shaft can take nine different positions.

In FIG. 12 to FIG. 15, the transverse direction of the drawing is a face-back direction. The right side of the drawing is a face side, and the left side of the drawing is a back side. As the position Zs is closer to the rightmost side, the loft angle is smaller. As the position Zs is closer to the leftmost side, the loft angle is larger. The golf club according to the present embodiment is right-handed.

In FIGS. 12 to 15, the lengthwise direction of the drawing is a toe-heel direction. The upper side of the drawing is a toe side, and the lower side of the drawing is a heel side. As the position Zs is closer to the uppermost side, the lie angle is smaller. As the position Zs is closer to the lowermost side, the lie angle is larger.

According to the 9 kinds of positions of the center line of the shaft, specifications of the combinations of the loft angles and the lie angles are the following 9 kinds.

(Specification 1) The lie angle is small and the loft angle is small.

(Specification 2) The lie angle is small and the loft angle is medium.

(Specification 3) The lie angle is small and the loft angle is large.

(Specification 4) The lie angle is medium and the loft angle is small.

(Specification 5) The lie angle is medium and the loft angle is medium.

(Specification 6) The lie angle is medium and the loft angle is large.

(Specification 7) The lie angle is large and the loft angle is small.

(Specification 8) The lie angle is large and the loft angle is medium.

(Specification 9) The lie angle is large and the loft angle is large.

In the golf club according to the embodiment A, an independent variability of the loft angle is achieved. In the golf club according to the embodiment A, an independent variability of the lie angle is achieved. In the embodiment A, the direction (phase) of the reverse-tapered hole (hosel hole) is set so that the independent variability of the loft angle and the independent variability of the lie angle are achieved.

For example, among the specifications 1, 2, and 3, the loft angle is changed without changing the lie angle. This is one example of the independent variability of the loft angle. The same independent variability is provided also among the specifications 4, 5, and 6. The same independent variability is provided also among the specifications 7, 8, and 9.

For example, among the specifications 1, 4, and 7, the lie angle is changed without changing the loft angle. This is one example of the independent variability of the lie angle. The same independent variability is provided also among the specifications 2, 5, and 8. The same independent variability is provided also among the specifications 3, 6, and 9.

The independent variability of the loft angle means that the loft angle is changed without substantially changing the lie angle. The phrase "without substantially changing" means that change in the lie angle is equal to or less than 20% based on the amount of change in the loft angle. The independent variability of the lie angle means that the lie angle is changed without substantially changing the loft angle. The phrase "without substantially changing" means that change in the loft angle is equal to or less than 20% based on the amount of change in the lie angle.

Figure 16:
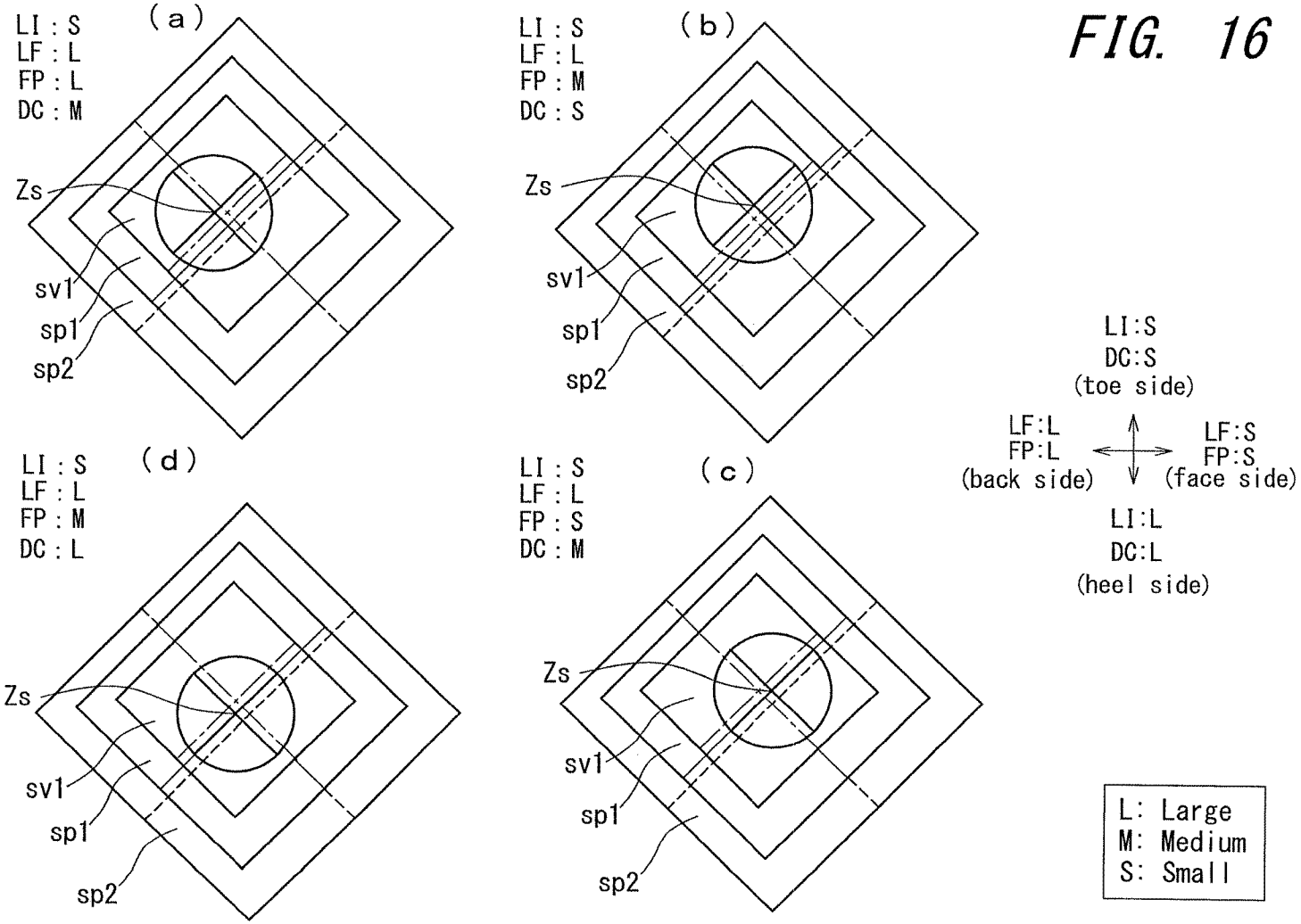
FIG. 16 is plan views showing the position of the lower end surface of the tip engagement part, and shows variations of the position of the center line of the shaft.
Figure 17:
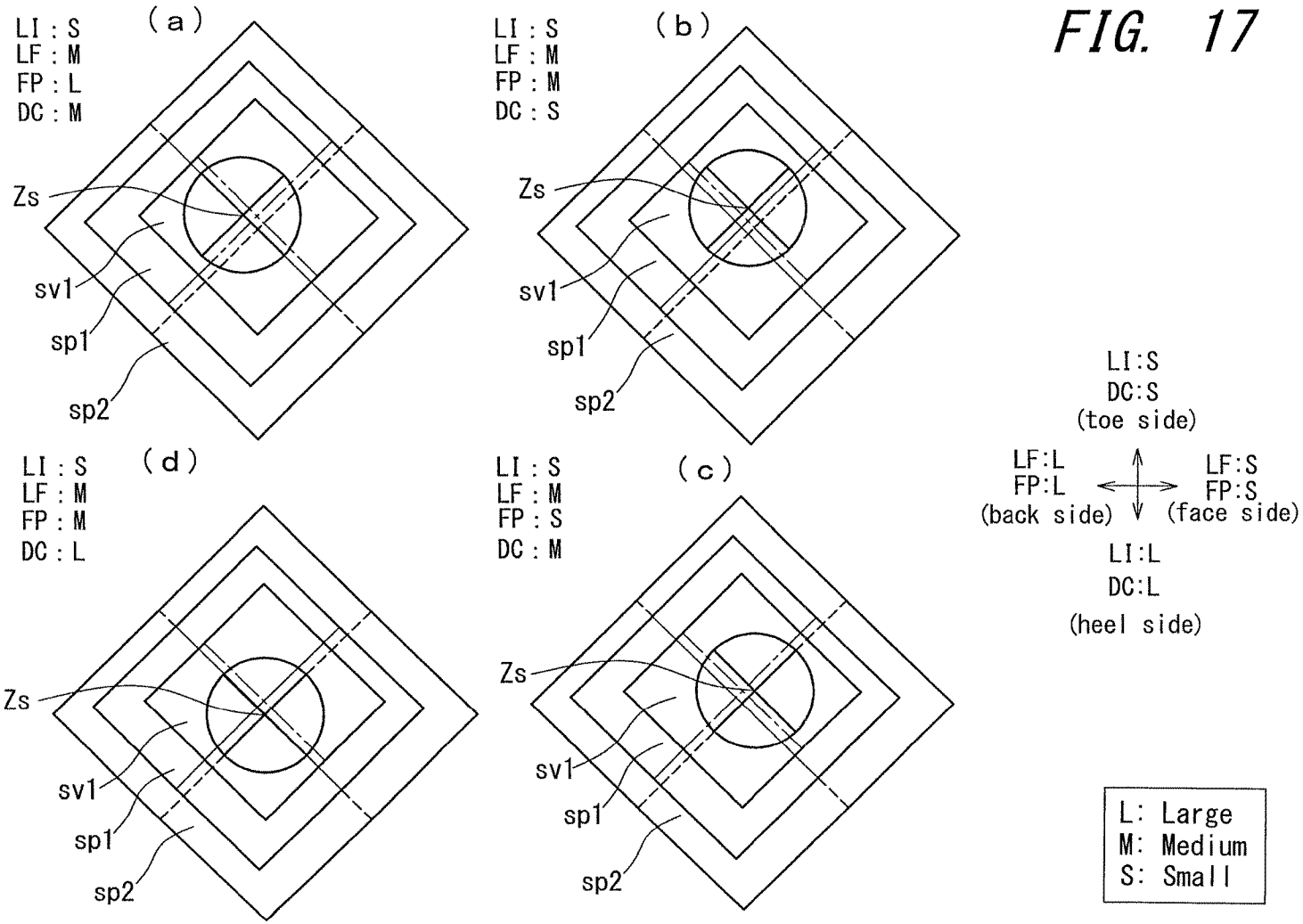

FIG. 16 and FIG. 17 show an embodiment B in which the number of the spacers is 2 (double-layered). In the present embodiment, a sleeve sv1, a first spacer sp1, and a second spacer sp2 are used. A position Zs of the center line of the shaft at the lower end of the hosel hole is shown by the intersection point of thick solid lines. The intersection point of one-dot chain lines shows the position of the center line of the outer surface of the sleeve sv1 at the lower end of the hosel hole. The intersection point of thin solid lines shows the position of the center line of the outer surface of the spacer sp1 at the lower end of the hosel hole. The intersection point of dashed lines shows the position of the center line of the outer surface of the spacer sp2 at the lower end of the hosel hole. Regardless of the rotation positions of the sleeve sv1, the spacer sp1, and the spacer sp2, the three center lines cross at one point at the position of the upper end of the hosel hole.

In the embodiment B, the outer surface of the sleeve sv1 is a four-sided pyramid surface. Each of inner and outer surfaces of the first spacer sp1 is also a four-sided pyramid surface, and each of inner and outer surfaces of the second spacer sp2 is also a four-sided pyramid surface. A reverse-tapered hole is also a four-sided pyramid surface. Therefore, the number of the rotation positions of the sleeve sv1 is four, the number of the rotation positions of the first spacer sp1 is also four, and the number of the rotation positions of the second spacer sp2 is also four. In the embodiment B, the number of kinds of combinations of the three members' rotation positions is $4\times4\times4=64$. A golf club according to the embodiment B has an excellent degree of freedom of adjustment.

The embodiment B shown in FIG. 16 and FIG. 17 satisfies the following (B1) to (B3).

(B1) A center line of an inner surface of the sleeve sv1 (that is, the center line of the shaft) is parallel and eccentric to a center line of the outer surface of the sleeve sv1.

(B2) A center line of the inner surface of the first spacer sp1 is inclined with respect to a center line of the outer surface of the first spacer sp1.

(B3) A center line of the inner surface of the second spacer sp2 is inclined with respect to a center line of the outer surface of the second spacer sp2.

The phrase "parallel and eccentric" means eccentricity in which center lines are parallel to each other.

The relation between the first spacer sp1 and the second spacer sp2 in the embodiment B is the same as the relation between the sleeve sv1 and the spacer sp1 in the above-mentioned embodiment A. Therefore, 9 kinds of combinations of the loft angles and the lie angles are achieved by the first spacer sp1 and the second spacer sp2. Furthermore, in the embodiment B, adjustment because of the sleeve sv1 is added. Since the sleeve sv1 is parallel and eccentric, each of the nine positions of the shaft axis can be further moved in parallel. The parallel movement of the shaft axis can change face progression. The parallel movement can achieve the movement of the shaft axis in the face-back direction. Furthermore, the parallel movement can achieve the movement of the shaft axis in the toe-heel direction. In the embodiment B, the degree of freedom of adjustment of the shaft axis is further improved by the two spacers.

FIG. 16 and FIG. 17 show only eight kinds of the above-mentioned 64 kinds.

In states (a) to (d) in FIG. 16, the rotation position of the first spacer sp1 is a first position, and the rotation position of the second spacer sp2 is also the first position. In states (a) to (d) in FIG. 16, only the rotation position of the sleeve sv1 is changed without changing the rotation positions of the first spacer sp1 and the second spacer sp2. In state (a) in FIG. 16, the rotation position of the sleeve sv1 is a first position. In state (b) in FIG. 16, the rotation position of the sleeve sv1 is a second position. In state (c) in FIG. 16, the rotation position of the sleeve sv1 is a third position. In state (d) in FIG. 16, the rotation position of the sleeve sv1 is a fourth position.

In states (a) to (d) in FIG. 17, the rotation position of the first spacer sp1 is the second position, and the rotation position of the second spacer sp2 is the first position. Also in states (a) to (d) in FIG. 17, only the rotation position of the sleeve sv1 is changed without changing the rotation positions of the first spacer sp1 and the second spacer sp2. In state (a) in FIG. 17, the rotation position of the sleeve sv1 is the first position. In state (b) in FIG. 17, the rotation position of the sleeve sv1 is the second position. In state (c) in FIG. 17, the rotation position of the sleeve sv1 is the third position. In state (d) in FIG. 17, the rotation position of the sleeve sv1 is the fourth position.

In comparing FIG. 16 with FIG. 17, in states (a) to (d) in FIG. 16, the rotation position of the first spacer sp1 is the first position, in contrast, in states (a) to (d) in FIG. 17, the rotation position of the first spacer sp1 is the second position. Because of the difference, the loft angle in each of states (a) to (d) in FIG. 17 is decreased to medium as compared with the large loft angle in each of states (a) to (d) in FIG. 16.

In states (a) to (d) in FIG. 16, the rotation position of the sleeve sv1 changes from the first position to the fourth position. Because of the change, face progression (FP), which is an index showing the position of the center line of the shaft in the face-back direction, changes in order from large (L), medium (M), small (S), to medium (M). Simultaneously, the distance of the center of gravity which is an index showing the position of the center line of the shaft in the toe-heel direction changes in order from medium (M), small (S), medium (M), to large (L). The distance of the center of gravity is a distance between the center of gravity of the head and the center line of the shaft. The distance is measured in an image projected to a plane which is parallel to the toe-heel direction and includes the center line of the shaft.

Therefore, for example, in comparison between state (a) and state (c) in FIG. 16, the position of the center line of the shaft (the position of the center line of the shaft at the upper end of the hosel hole) moves in the face-back direction while maintaining the inclination of the center line of the shaft so that the lie angle is small and the loft angle is large. In addition, in state (a) and state (c) of FIG. 16, the distance of the center of gravity is medium without change.

In comparison between state (b) and state (d) in FIG. 16, the position of the center line of the shaft (the position of the center line of the shaft at the upper end of the hosel hole) moves in the toe-heel direction while maintaining the inclination of the center line of the shaft so that the lie angle is small and the loft angle is large. In addition, in state (b) and state (d) of FIG. 16, the face progression is medium without change.

Also in states (a) to (d) in FIG. 17, the rotation position of the sleeve sv1 changes from the first position to the fourth position. Because of the change, the face progression changes in order from large, medium, small, to medium. Simultaneously, the distance of the center of gravity changes in order from medium, small, medium, to large.

Therefore, for example, in comparison between state (a) and state (c) in FIG. 17, the position of the center line of the shaft (the position of the center line of the shaft at the upper end of the hosel hole) moves in the face-back direction while maintaining the inclination of the center line of the shaft so that the lie angle is small and the loft angle is medium. In addition, in state (a) and state (c) of FIG. 17, the distance of the center of gravity is medium without change.

In comparison between state (b) and state (d) in FIG. 17, the position of the center line of the shaft (the position of the center line of the shaft at the upper end of the hosel hole) moves in the toe-heel direction while maintaining the inclination of the center line of the shaft so that the lie angle is small and the loft angle is medium. In addition, in state (b) and state (d) of FIG. 17, the face progression is medium without change.

Although the axis displacement of the sleeve sv1 is parallel eccentricity in the present embodiment, the axis displacement may be naturally inclination, for example. Of course, parallel eccentricity may be adopted for the spacer.

As shown in FIG. 12 to FIG. 17, the position of the center line of the shaft on the sole side can be variously changed. Since the present embodiment eliminates the need for screw fixation, the degrees of freedom of the position and the inclination of the center line of the shaft are high. Therefore, the range of angle adjustment can be increased. The range of adjustment for the loft angle, the lie angle, the face angle, the face progression, etc., can be increased.

Figure 18:
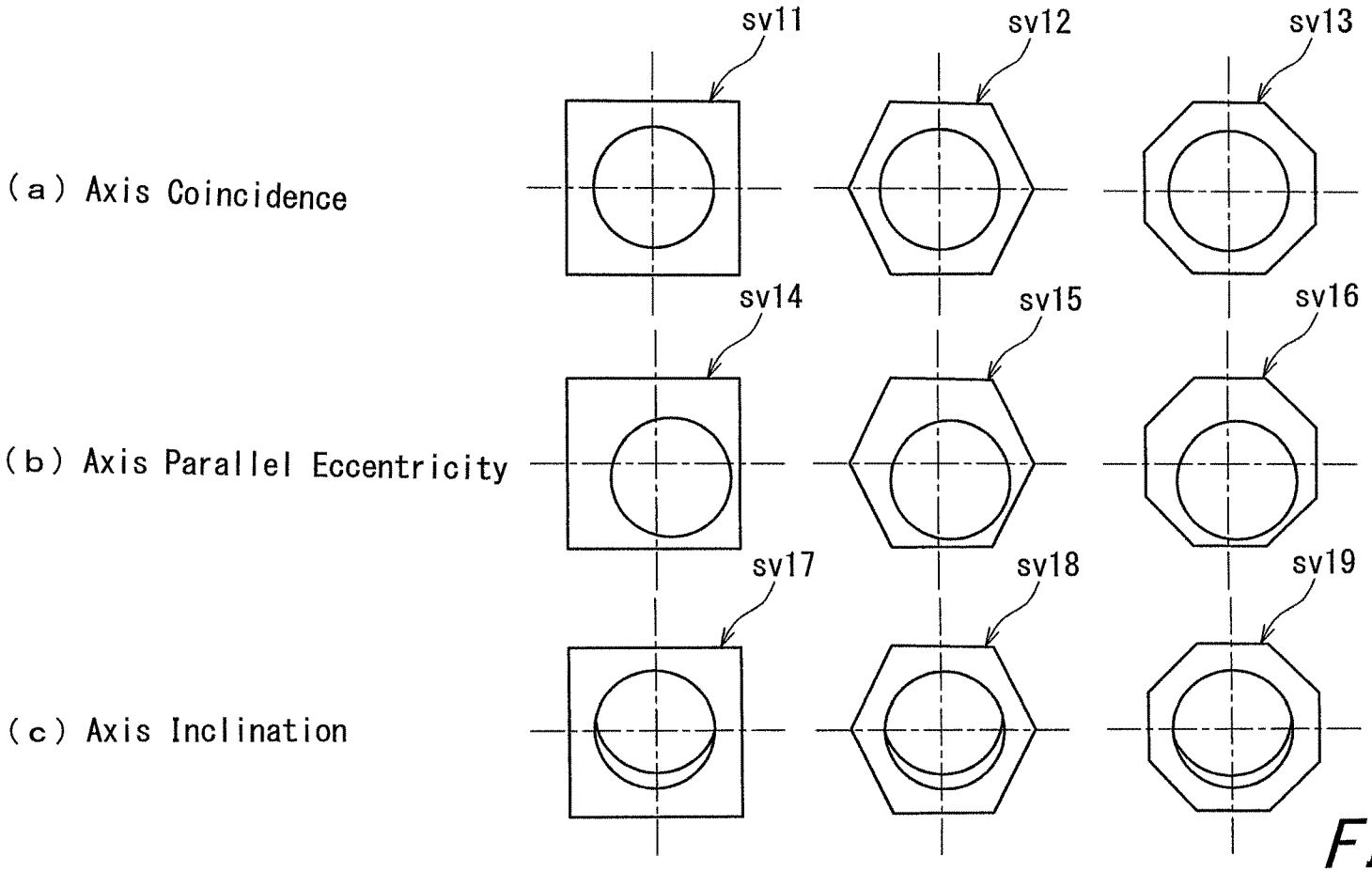
FIG. 18 is plan views of nine sleeves.

Each of nine drawings shown in FIG. 18 is a plan view (drawing viewed from above) of the sleeve which can be applied to the present embodiment. In FIG. 18, examples of the sectional shape of the outer surface of the sleeve include a tetragon (square), a hexagon (regular hexagon), and an octagon (regular octagon). Axis coincidence, axis parallel eccentricity, and axis inclination are shown as the form of the axis displacement of the sleeve in FIG. 18.

In a sleeve sv11, the sectional shape of the outer surface of the sleeve is tetragon (square); the outer surface of the sleeve is a four-sided pyramid surface; and the center line of the inner surface of the sleeve (the center line of the shaft) coincides with the center line of the outer surface of the sleeve. In a sleeve sv12, the sectional shape of the outer surface of the sleeve is a hexagon (regular hexagon); the outer surface of the sleeve is a six-sided pyramid surface; and the center line of the inner surface of the sleeve (the center line of the shaft) coincides with the center line of the outer surface of the sleeve. In a sleeve sv13, the sectional shape of the outer surface of the sleeve is an octagon (regular octagon); the outer surface of the sleeve is an eight-sided pyramid surface; and the center line of the inner surface of the sleeve (the center line of the shaft) coincides with the center line of the outer surface of the sleeve.

In a sleeve sv14, the sectional shape of the outer surface of the sleeve is a tetragon (square); the outer surface of the sleeve is a four-sided pyramid surface; and the center line of the inner surface of the sleeve (the center line of the shaft) is parallel and eccentric to the center line of the outer surface of the sleeve. In a sleeve sv15, the sectional shape of the outer surface of the sleeve is a hexagon (regular hexagon); the outer surface of the sleeve is a six-sided pyramid surface; and the center line of the inner surface of the sleeve (the center line of the shaft) is parallel and eccentric to the center line of the outer surface of the sleeve. In a sleeve sv16, the sectional shape of the outer surface of the sleeve is an octagon (regular octagon); the outer surface of the sleeve is an eight-sided pyramid surface; and the center line of the inner surface of the sleeve (the center line of the shaft) is parallel and eccentric to the center line of the outer surface of the sleeve.

In a sleeve sv17, the sectional shape of the outer surface of the sleeve is a tetragon (square); the outer surface of the sleeve is a four-sided pyramid surface; and the center line of the inner surface of the sleeve (the center line of the shaft) is inclined with respect to the center line of the outer surface of the sleeve. In a sleeve sv18, the sectional shape of the outer surface of the sleeve is a hexagon (regular hexagon); the outer surface of the sleeve is a six-sided pyramid surface; and the center line of the inner surface of the sleeve (the center line of the shaft) is inclined with respect to the center line of the outer surface of the sleeve. In a sleeve sv19, the sectional shape of the outer surface of the sleeve is an octagon (regular octagon); the outer surface of the sleeve is an eight-sided pyramid surface; and the center line of the inner surface of the sleeve (the center line of the shaft) is inclined with respect to the center line of the outer surface of the sleeve.

Thus, various sleeves may be used. Of course, these sleeves shown in FIG. 18 are merely exemplified. Similarly, various forms may be adopted also for the spacer.

From the viewpoint of preventing an excessively large hosel, the amount of eccentricity of parallel eccentricity in the sleeve is preferably equal to or less than 5 mm, more preferably equal to or less than 2 mm, and still more preferably equal to or less than 1.5 mm. From the viewpoint of adjusting properties, the amount of eccentricity of parallel eccentricity in the sleeve is preferably equal to or greater than 0.5 mm, and more preferably equal to or greater than 1.0 mm.

From the viewpoint of preventing an excessively large hosel, the inclination angle θ1 of the center line of the shaft with respect to the center line of the outer surface of the sleeve is preferably equal to or less than 5 degrees, more preferably equal to or less than 3 degrees, and still more preferably equal to or less than 2 degrees. From the viewpoint of adjusting properties, the inclination angle θ1 is preferably equal to or greater than 0.5 degrees, more preferably equal to or greater than 1 degree, and still more preferably equal to or greater than 1.5 degrees.

From the viewpoint of preventing an excessively large hosel, the amount of eccentricity of parallel eccentricity in the spacer is preferably equal to or less than 5 mm, more preferably equal to or less than 2 mm, and still more preferably equal to or less than 1.5 mm. From the viewpoint of adjusting properties, the amount of eccentricity of parallel eccentricity in the spacer is preferably equal to or greater than 0.5 mm, and more preferably equal to or greater than 1.0 mm.

From the viewpoint of preventing an excessively large hosel, the inclination angle θ2 of the center line of the inner surface of the spacer with respect to the center line of the outer surface of the spacer is preferably equal to or less than 5 degrees, more preferably equal to or less than 3 degrees, and still more preferably equal to or less than 2 degrees. From the viewpoint of adjusting properties, the inclination angle θ2 is preferably equal to or greater than 0.5 degrees, more preferably equal to or greater than 1 degree, and still more preferably equal to or greater than 1.5 degrees.

An engagement releasing direction and an engaging direction are defined in the present application. In the present application, the engagement releasing direction is a direction in which the tip engagement part RT moves toward the sole side with respect to the reverse-tapered hole 206. In other words, the engagement releasing direction means a direction in which the reverse-tapered hole 206 moves toward the grip side with respect to the tip engagement part RT. If the tip engagement part RT is moved in the engagement releasing direction, the tip engagement part RT comes out of the reverse-tapered hole 206. On the other hand, the engaging direction in the present application means a direction in which the tip engagement part RT moves toward the grip side with respect to the reverse-tapered hole 206. In other words, the engaging direction means a direction in which the reverse-tapered hole 206 moves toward the sole side with respect to the tip engagement part RT.

In the golf club in the engagement state, the reverse-tapered fitting is formed between the tip engagement part RT and the reverse-tapered hole 206. A force in the engaging direction cannot release the reverse-tapered fitting, and on the contrary, enhances the contact pressure of the reverse-tapered fitting. The force in the engaging direction further ensures the engagement between the tip engagement part RT and the reverse-tapered hole 206.

A large force acting on the head is a centrifugal force during swinging, and an impact shock force upon impact. Of the forces, the centrifugal force is the above-mentioned force in the engaging direction. Because of a loft angle of the head, a component force of the impact shock force in the axial direction is also the force in the engaging direction. Therefore, the centrifugal force and the impact shock force cannot release the engagement between the tip engagement part RT and the reverse-tapered hole 206, and further ensures the engagement conversely. Since each of the tip engagement part RT and the reverse-tapered hole 206 has a non-circular sectional shape, relative rotation between the two cannot occur. As a result, although the tip engagement part RT and the reverse-tapered hole 206 are not fixed by an adhesive or the like, retention and anti-rotation required as a golf club are achieved. The structure of the reverse-tapered fitting can achieve both holding properties and attaching/detaching easiness.

Therefore, the screw member 600 is not necessarily needed.

However, the result of the studies made by the inventor has demonstrated the effectiveness of the screw member 600. It has been found that high dimensional accuracy is required to bring the outer surface of the tip engagement part RT into complete surface-contact with the inner surface of the hosel hole 204. It has been found that even a slight dimensional error could cause backlash. The backlash results in a sense of discomfort during hitting.

It has been found that as a result of the screw member 600 pressing the tip engagement part RT in the engaging direction, elastic deformation occurs in the tip engagement part RT and/or the hosel hole 204, thus eliminating the backlash.

Furthermore, the inventor has found another effect of the screw member 600. The tip engagement part RT pressed by the screw member 600 is firmly engaged with the hosel hole 204 with elastic deformation. It has been found that the tip engagement part RT that has been fitted with elastic deformation is less likely to come out from the hosel hole 204. As described above, the sleeve 400 is connected to the screw member 600, and therefore, moves together with the screw member 600. When the screw member 600 is moved to the lower side as the screw-connection is released, the sleeve 400 is pulled to the lower side. As a result, by simply rotating the screw member 600 in the second direction DR2, the tip engagement part RT is pulled to the lower side, and is pulled out from the hosel hole 204. Thus, the screw member 600 facilitates the removal of the shaft 300.

In situations other than swinging, a force in the engagement releasing direction may act on the golf club. Examples of the situations include a state where the golf club is inserted into a golf bag. In this state, the golf club is stood with the head up. In this case, the gravity acting on the head acts as the force in the engagement releasing direction. The screw member 600 can prevent the falling-off of the head.

From the viewpoint of the Golf Rules, the screw member 600 is preferably configured so as not to be rotated by bare hands. From the viewpoint of the Golf Rules, it is preferable that a special tool is required for rotating the screw member 600.

The golf club may be configured such that its club length can be adjusted. For example, a plurality of spacers having different wall thicknesses may be prepared. By replacing the spacer, the wall thickness of the spacer is changed, and the axial direction position of the tip engagement part RT is changed. Therefore, the club length can be adjusted. In this case, extending the axial installation range of the female screw part enables the screw member to follow the change of the axial direction position of the tip engagement part RT.

Figure 19:
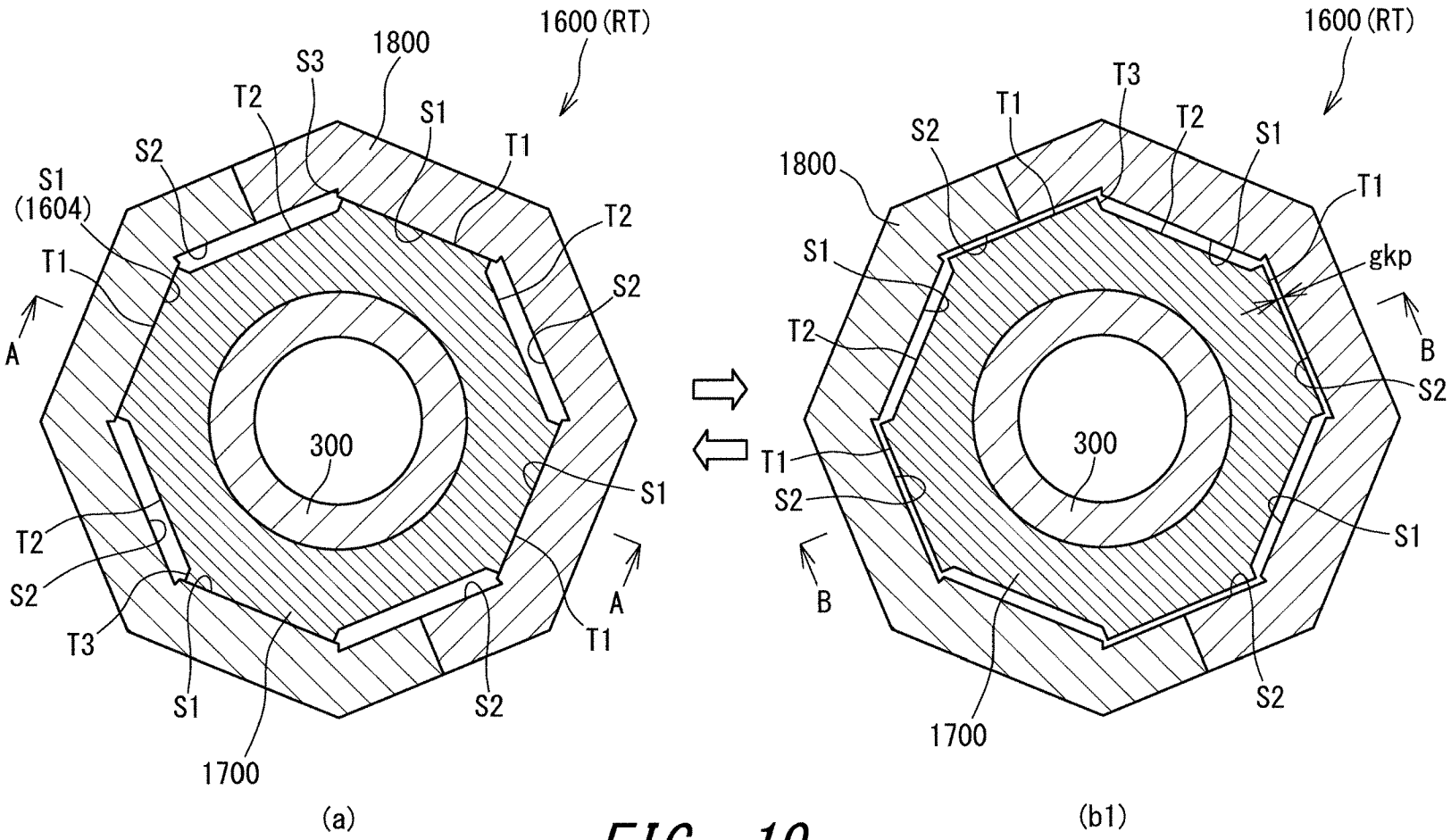
FIG. 19 is sectional views (radial-direction sectional views) for illustrating a club length adjustment mechanism by changing a rotation position.

FIG. 19 is sectional views of a golf club 1600 according to another embodiment. In the golf club 1600, the club length can be changed without replacing a spacer.

FIG. 19 shows two states of the golf club 1600. A state (a) in FIG. 19 shows a first state of the golf club 1600. A state (b1) in FIG. 19 shows a second state of the golf club 1600. The club length of the golf club 1600 in the first state is shorter than the club length of the golf club 1600 in the second state. In the golf club 1600, two kinds of length can be selected.

Figure 20:
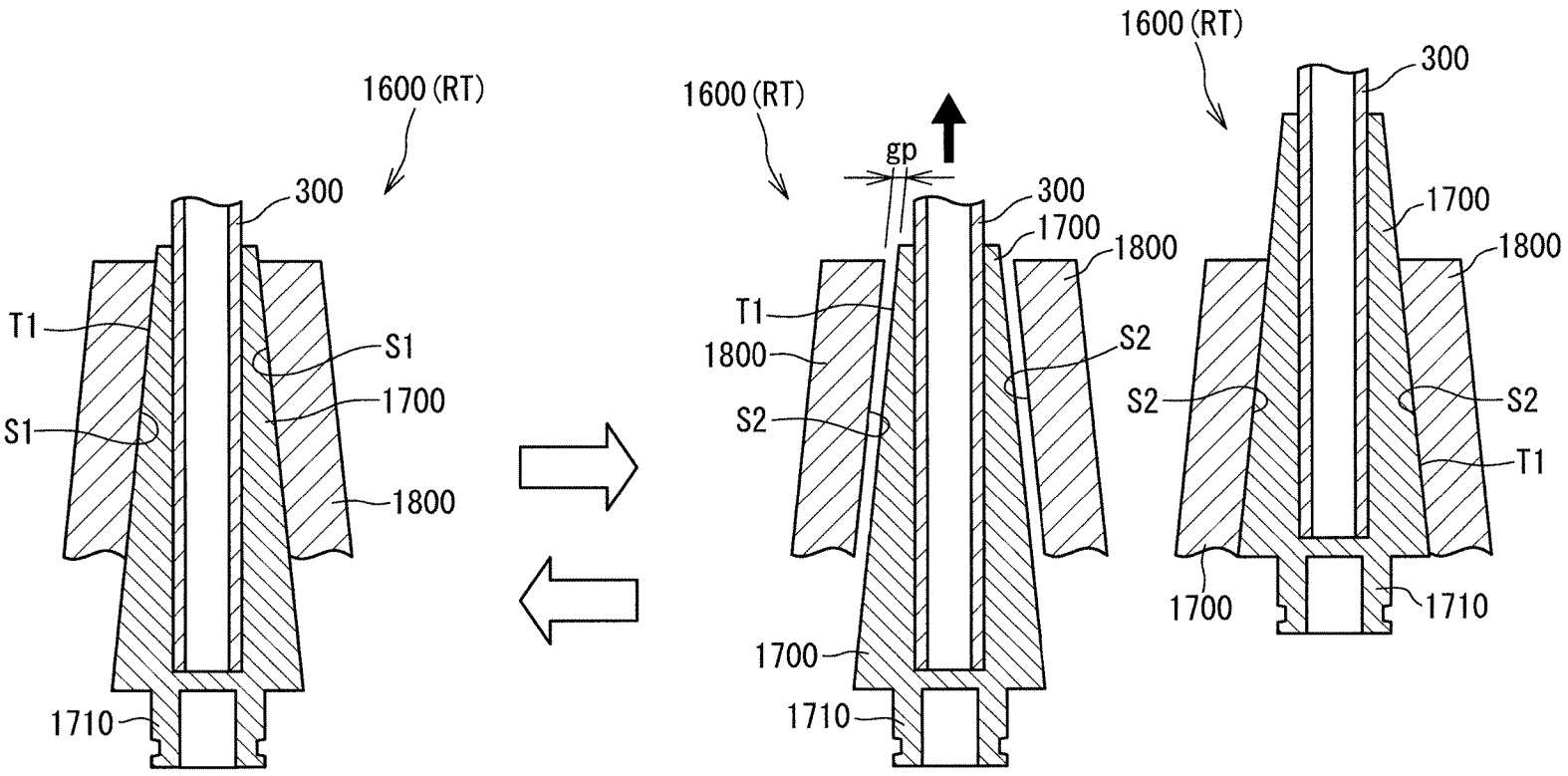
FIG. 20 is sectional views (axial-direction sectional views) for illustrating the club length adjustment mechanism by changing the rotation position.

FIG. 20 is sectional views at a tip engagement part RT of the golf club 1600, which illustrates a length adjustment mechanism.

A state (a) in FIG. 20 is a sectional view in the first state (short state). As shown in the state (a) of FIG. 20, the tip engagement part RT of the golf club 1600 includes a sleeve 1700 and a spacer 1800.

The sleeve 1700 has a sleeve-side connection part 1710. The structure of the sleeve-side connection part 1710 is the same as that of the above-described sleeve-side connection part 410. The sleeve 1700 is bonded to the tip end portion of the shaft 300. In the golf club 1600, the above-described screw member 600 is also used.

The spacer 1800 has a divided structure. The sleeve 1700 can be made to pass through a hosel hole (not shown in the drawing). The golf club 1600 can be assembled by the procedure shown in FIG. 4.

As shown in FIG. 19, the inner surface of the spacer 1800 has a first abutting face S1 and the second abutting face S2.

A plurality of (four) first abutting faces S1 are provided on the inner surface of the spacer 1800. A plurality of (four) second abutting faces S2 are provided on the inner surface of the spacer 1800. The first abutting faces S1 and the second abutting faces S2 are alternately arranged. In the present embodiment, the number of the first abutting faces S1 is four, and the number of the second abutting faces S2 is four. The sum of the number of the first abutting faces S1 and the number of the second abutting faces S2 is eight.

As shown in the state (a) of FIG. 19, the first abutting faces S1 coincide with respective alternate sides of a regular polygon (regular octagon). The regular polygon (regular octagon) coinciding with the first abutting faces S1 is defined as a first virtual regular polygon (not shown in the drawing). As shown in the state (a) in FIG. 19, the second abutting faces S2 coincide with respective alternate sides of a regular polygon (regular octagon). The regular polygon (regular octagon) coinciding with the second abutting faces S2 is defined as a second virtual regular polygon (not shown in the drawing).

A radial direction position of the second abutting faces S2 is outside with respect to a radial direction position of the first abutting faces S1. The first virtual regular polygon (virtual regular octagon) is smaller than the second virtual regular polygon (virtual regular octagon). The first virtual regular polygon (virtual regular octagon) and the second virtual regular polygon (virtual regular octagon) have the common central point and the same phase.

Thus, the first abutting faces S1 and the second abutting faces S2 are alternately arranged along respective sides of a regular polygon (regular octagon), and the radial direction position of the first abutting faces S1 is (slightly) inside of the radial direction position of the second abutting faces S2. A step surface S3 is formed on each boundary between the first abutting faces S1 and the second abutting faces S2. The step surface S3 may not be present.

As shown in the state (a) in FIG. 19, the outer surface of the sleeve 1700 includes an abutting engagement face T1 and a non-abutting engagement face T2.

A plurality of (four) abutting engagement faces T1 are provided on the outer surface of the sleeve 1700. A plurality of (four) non-abutting engagement faces T2 are provided on the outer surface of the sleeve 1700. The abutting engagement faces T1 and the non-abutting engagement faces T2 are alternately arranged. In the present embodiment, the number of the abutting engagement faces T1 is four, and the number of the non-abutting engagement faces T2 is four. The sum of the number of the abutting engagement faces T1 and the number of the non-abutting engagement faces T2 is eight.

As shown in the state (a) in FIG. 19, the abutting engagement faces T1 coincide with respective alternate sides of a regular polygon (regular octagon). The regular polygon (regular octagon) coinciding with the abutting engagement faces T1 is defined as a third virtual regular polygon (not shown in the drawing). As shown in the state (a) in FIG. 19, the non-abutting engagement faces T2 coincide with respective alternate sides of a regular polygon (regular octagon). The regular polygon (regular octagon) coinciding with the non-abutting engagement faces T2 is defined as a fourth virtual regular polygon (not shown in the drawing).

A radial direction position of the abutting engagement faces T1 is outside with respect to a radial direction position of the non-abutting engagement faces T2. Therefore, the third virtual regular polygon (virtual regular octagon) is greater than the fourth virtual regular polygon (virtual regular octagon). The third virtual regular polygon (virtual regular octagon) and the fourth virtual regular polygon (virtual regular octagon) have the common central point and the same phase.

Thus, the abutting engagement faces T1 and the non-abutting engagement faces T2 are alternately arranged along respective sides of a regular polygon (regular octagon), and the radial direction position of the abutting engagement faces T1 is (slightly) outside of the radial direction position of the non-abutting engagement faces T2. A step surface T3 is formed on each boundary between the abutting engagement faces T1 and the non-abutting engagement faces T2. The step surface T3 may not be present.

The state (a) in FIG. 19 is a sectional view in the first state (a state where the club length is short). In the first state, the sleeve 1700 is set on a first rotation position.

In the first state, the abutting engagement faces T1 abut on the respective first abutting faces S1. In the first state, the abutting engagement faces T1 are opposed to the respective first abutting faces S1, and the non-abutting engagement faces T2 are opposed to the respective second abutting faces S2. While the abutting engagement faces T1 abut on the respective first abutting faces S1, the non-abutting engagement faces T2 do not abut on the respective second abutting faces S2. A gap is formed each between the non-abutting engagement faces T2 and the respective second abutting faces S2.

A state (b1) in FIG. 19 is a sectional view showing a shifting state for shifting to the second state. In the state (b1) of FIG. 19, the sleeve 1700 is set on a second rotation position.

The shifting state for shifting to the second state means a state in which the sleeve 1700 is rotated by a predetermined angle θ (45 degrees) without changing the axial direction position of the sleeve 1700 with respect to the spacer 1800. The shifting state is depicted in order to facilitate the understanding of the length adjustment mechanism. When the rotation of the predetermined angle θ is actually performed, the rotation can be made after once moving the tip engagement part RT in the engagement releasing direction. The rotation position of the sleeve 1700 is shifted to the second rotation position from the first rotation position by rotating the sleeve 1700 by the predetermined angle θ.

In the shifting state, the abutting engagement faces T1 are opposed to the respective second abutting faces S2, and the non-abutting engagement faces T2 are opposed to the respective first abutting faces S1. In this state, the abutting engagement faces T1 do not abut on the respective second abutting faces S2. As a matter of course, the non-abutting engagement faces T2 do not abut on the respective first abutting faces S1, either. A width of each gap gp between the abutting engagement face T1 and the second abutting face S2 is smaller than a width of each gap between the non-abutting engagement face T2 and the first abutting face S1.

The fact that the abutting engagement faces T1 do not abut on the respective second abutting faces S2 in the state (b1) (shifting state) of FIG. 19 indicates the feasibility of two kinds of club lengths. That is, the gap gp realizes a second club length (greater club length). This point is explained below by using FIG. 20.

A state (a) in FIG. 20 is a sectional view taken along line A-A in the state (a) of FIG. 19. A state (b1) in FIG. 20 is a sectional view taken along line B-B in the state (b1) of FIG. 19. As also shown in the state (b1) in FIG. 20, in the shifting state, a gap gp is present between the abutting engagement faces T1 and the respective second abutting faces S2. For eliminating the gap to make the abutting engagement faces T1 abut on the respective second abutting faces S2, the shaft 300 to which the sleeve 1700 is fixed should be moved to the axial-direction upper side. That is, the abutting engagement faces T1 abut on the respective second abutting faces S2 by moving the sleeve 1700 in the shifting state to the axial-direction upper side with respect to the spacer 1800. As a result, the second state is realized. A state (b2) in FIG. 20 shows the second state.

As described above, in the golf club 1600, the axial direction position of the sleeve 1700 with respect to the spacer 1800 in the first state is different from that of the second state. The first state in which the club length is short and the second state in which the club length is long are realized by the difference. In the golf club 1600, a mutual shifting between the first state and the second state is enabled by rotating the sleeve 1700 with respect to the spacer 1800.

Extending the axial installation range of the female screw part enables the screw member to follow the change of the axial direction position of the sleeve-side connection part 1710.

Thus, in the present embodiment, the sleeve 1700 having a reverse-tapered outer surface and the spacer 1800 having a reverse-tapered inner surface are used. Either one of the reverse-tapered outer surface and the reverse-tapered inner surface includes the abutting engagement faces T1. The other of the reverse-tapered outer surface and the reverse-tapered inner surface includes the first abutting faces S1 and the second abutting faces S2. The first state in which the abutting engagement faces T1 abut on the respective first abutting faces S1 is formed when the reverse-tapered outer surface is set on the first rotation position. In addition, the second state in which the abutting engagement faces T1 abut on the respective second abutting faces S2 is formed when the reverse-tapered outer surface is set on the second rotation position. An axial direction position of the reverse-tapered outer surface with respect to the reverse-tapered inner surface in the first state is different from that of the second state, and a club length is adjusted by the difference. Preferably, the reverse-tapered outer surface includes the non-abutting engagement faces T2 in addition to the abutting engagement faces T1. Preferably, the reverse-tapered outer surface is a pyramid outer surface, and the abutting engagement faces and the non-abutting engagement faces are alternately arranged on the pyramid outer surface. Preferably, the radial direction position of the abutting engagement faces is located outside with respect to the radial direction position of the non-abutting engagement faces. Preferably, the reverse-tapered inner surface may be a pyramid inner surface corresponding to the pyramid outer surface, and the first abutting faces and the second abutting faces are alternately arranged on the pyramid inner surface. Preferably, the pyramid outer surface is an eight-sided pyramid surface. Preferably, the pyramid inner surface is an eight-sided pyramid surface.

Figure 21:
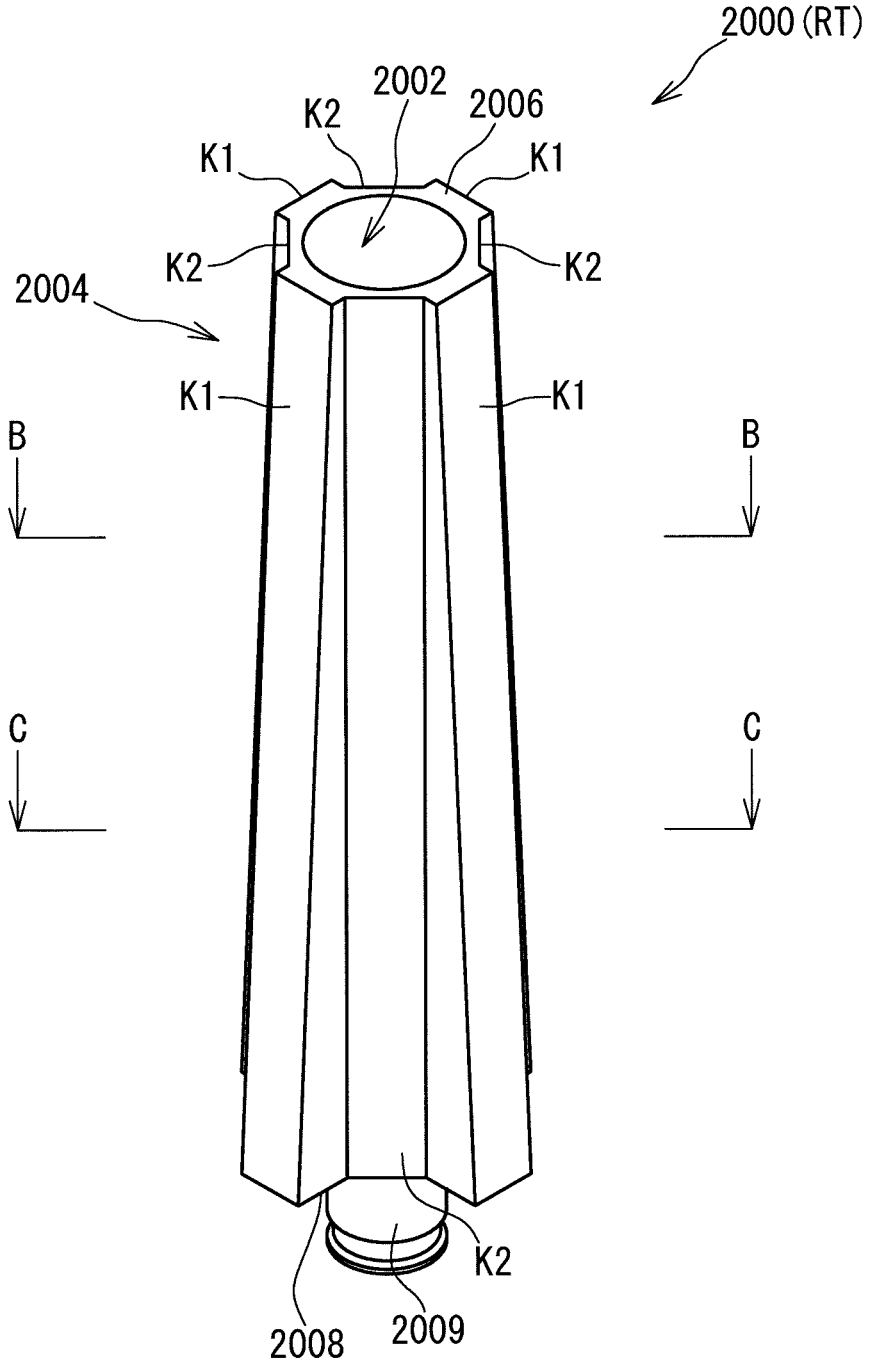
FIG. 21 is a perspective view of a sleeve according to another embodiment.
Figure 22A:
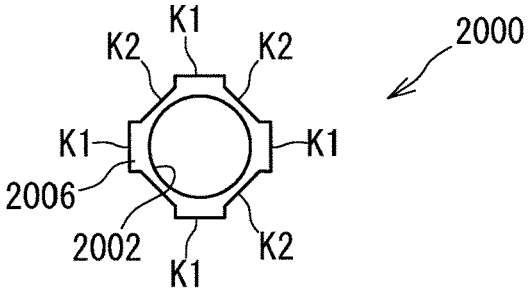
FIG. 22(*a*) is a top view of the sleeve shown in FIG. 21, FIG. 22(*b*) is a sectional view taken along line B-B in FIG. 21, FIG. 22(*c*) is a sectional view taken along line C-C in FIG. 21, and FIG. 22(*d*) is a bottom view of the sleeve.
Figure 22B:
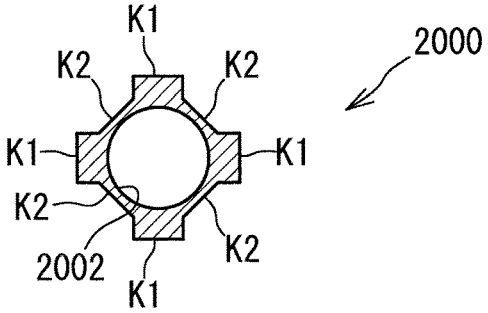
Figure 22C:
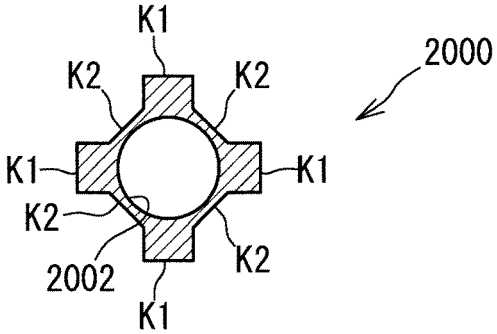
Figure 22D:
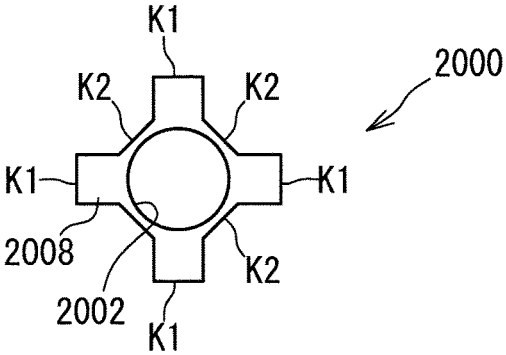
Figure 23A:
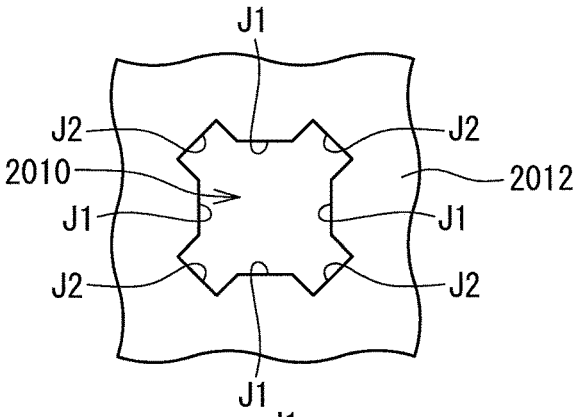
FIG. 23(*a*) to FIG. 23(*d*) show a hosel hole corresponding to the sleeve shown in FIG. 21, FIG. 23(*a*) is a plan view of an upper end of the hosel hole, FIG. 23(*b*) and FIG. 23(*c*) are sectional views of the hosel hole, and FIG. 23(*d*) is a plan view of a lower end of the hosel hole.
Figure 23B:
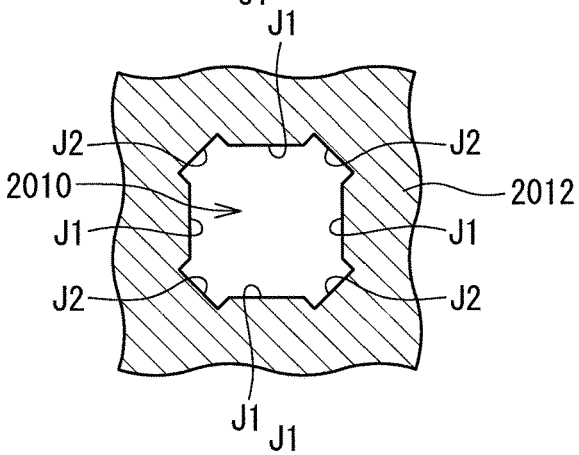
Figure 23C:
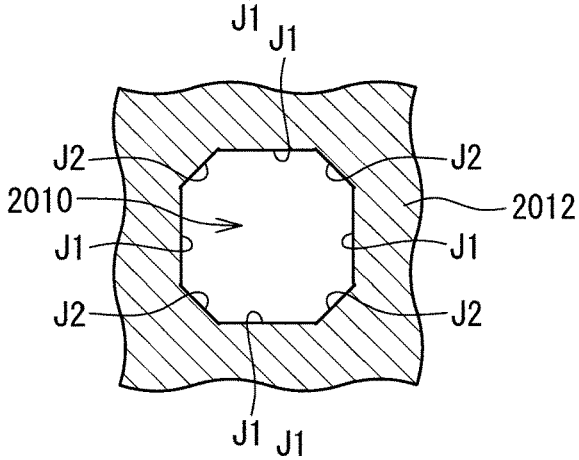
Figure 23D:
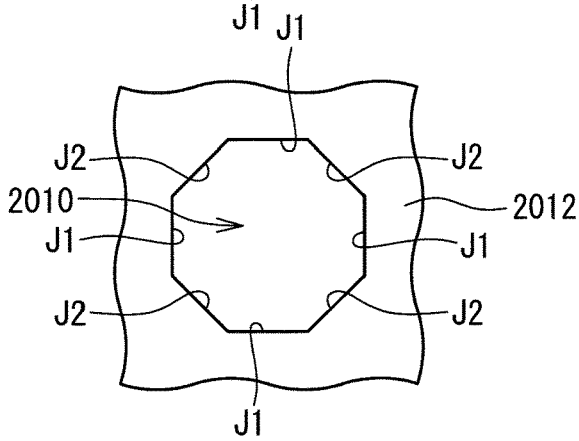

FIG. 21 is a perspective view of a sleeve 2000 according to another embodiment. FIG. 22(*a*) is a plan view of the sleeve 2000. FIG. 22(*b*) is a sectional view taken along line B-B in FIG. 21. FIG. 22(*c*) is a sectional view taken along line C-C in FIG. 21. FIG. 22(*d*) is a bottom view of the sleeve 2000.

The sleeve 2000 has an inner surface 2002, an outer surface 2004, an upper end surface 2006 and a lower end surface 2008. The inner surface 2002 is a circumferential surface. A shaft is bonded to the inner surface 2002.

The sleeve 2000 further has a sleeve-side connection part 2009. The configuration of the sleeve-side connection part 2009 is the same as that of the above-described sleeve-side connection part 410.

In the present embodiment, the above-described screw member 600 is also used. The screw member 600 can be connected to the sleeve-side connection part 2009.

The outer surface 2004 has reverse-tapered engagement faces K1. The reverse-tapered engagement faces K1 are arranged at a plurality of positions in the circumferential direction. The reverse-tapered engagement faces K1 are arranged at equal intervals in the circumferential direction. The reverse-tapered engagement faces K1 are arranged at intervals of a predetermined angle (90 degree) in the circumferential direction.

The outer surface 2004 has non-engagement faces K2. The non-engagement faces K2 are arranged at a plurality of positions in the circumferential direction. The non-engagement faces K2 are arranged at equal intervals in the circumferential direction. The non-engagement faces K2 are arranged at intervals of a predetermined angle (90 degree) in the circumferential direction.

The reverse-tapered engagement faces K1 and the non-engagement faces K2 are alternately arranged in the circumferential direction.

As understood from FIG. 22(*a*) to FIG. 22(*d*), the sectional area of the outer surface 2004 is increased as going to the lower end surface 2008 from the upper end surface 2006. In the sectional shape of the outer surface 2004, the reverse-tapered engagement faces K1 are shifted toward the radially outward direction as going to the lower side. As a result, the reverse-tapered engagement faces K1 becomes reverse-tapered surfaces (see FIG. 21).

The sectional shape of the non-engagement faces K2 is the same regardless of the axial direction position thereof. The sectional shape of the non-engagement faces K2 is along a polygon (regular polygon). The sectional shape of the non-engagement faces K2 is along an octagon (regular octagon). The sectional shape of the non-engagement faces K2 coincides with respective alternate sides of the regular polygon. The radial direction position of the non-engagement faces K2 remains the same at any axial direction position. At any axial direction position, the reverse-tapered engagement faces K1 are located outside of the non-engagement faces K2 in the radial direction.

The sectional shape of the outer surface 2004 has a rotation symmetric property at any axial direction position. At any axial direction position, the sectional shape of the outer surface 2004 has 4-fold rotation symmetry. When the sectional shape of the outer surface 2004 has n-fold rotation symmetry (n is an integer of equal to or greater than 2), n is preferably equal to or greater than 3 and equal to or less than 12, and more preferably equal to or greater than 4 and equal to or less than 8. In the present application, n means the maximum value in values n can take. For example, a square has 4-fold rotation symmetry, and also has 2-fold rotation symmetry. However, n of the square is the maximum value in the values n can take, that is, 4.

FIG. 23(*a*) to FIG. 23(*d*) shows a hosel hole 2010. FIG. 23(*a*) is a plan view of the hosel hole 2010, and shows the upper end surface of the hosel hole 2010. FIG. 23(*d*) is a bottom view of the hosel hole 2010, and shows the lower end surface of the hosel hole 2010. FIG. 23(*b*) and FIG. 23(*c*) are sectional views of the hosel hole 2010. FIG. 23(*b*) is a sectional view of the hosel hole 2010 at a position corresponding to line B-B in FIG. 21. FIG. 23(*c*) is a sectional view of the hosel hole 2010 at a position corresponding to line C-C in FIG. 21.

The hosel hole 2010 corresponds to the sleeve 2000. The sleeve 2000 is fixed to a tip end portion of a shaft (not shown in the drawings). The shaft to which the sleeve 2000 is fixed is fixed to the hosel hole 2010 of the head. The hosel hole 2010 is provided on a hosel part 2012 of the head.

The hosel hole 2010 has reverse-tapered hole faces J1. The reverse-tapered hole faces J1 are faces corresponding to the respective reverse-tapered engagement faces K1. The reverse-tapered hole faces J1 are arranged at a plurality of positions in the circumferential direction. The reverse-tapered hole faces J1 are arranged at equal intervals in the circumferential direction. The reverse-tapered hole faces J1 are arranged at intervals of a predetermined angle (90 degree) in the circumferential direction.

The hosel hole 2010 has interference-avoiding faces J2. The interference-avoiding faces J2 are arranged at a plurality of positions in the circumferential direction. The interference-avoiding faces J2 are arranged at equal intervals in the circumferential direction. The interference-avoiding faces J2 are arranged at intervals of a predetermined angle (90 degree) in the circumferential direction.

The reverse-tapered hole faces J1 and the interference-avoiding faces J2 are alternately arranged in the circumferential direction.

As understood from FIG. 23(*a*) to FIG. 23(*d*), the sectional area of the hosel hole 2010 is increased as going to the lower end surface from the upper end surface. In the sectional shape of the hose hole 2010, the reverse-tapered hole faces J1 are shifted toward the radially outward direction as going to the lower side. The reverse-tapered hole faces J1 are reverse-tapered surfaces.

The radial direction position and orientation of the interference-avoiding faces J2 are the same regardless of the axial direction position thereof. The sectional shape of the interference-avoiding faces J2 is along a polygon (regular polygon). The sectional shape of the interference-avoiding faces J2 is along an octagon (regular octagon). The sectional shape of the interference-avoiding faces J2 coincide with respective alternate sides of the regular polygon. The radial direction position of the interference-avoiding faces J2 remains the same at any axial direction position. At any axial direction position other than lower end surfaces of the interference-avoiding faces J2, the interference-avoiding faces J2 are positioned outside of the reverse-tapered hole faces J1 in the radial direction.

The sectional shape of the hosel hole 2010 has a rotation symmetric property at any axial direction position. At any axial direction position, the sectional shape of the hosel hole 2010 has 4-fold rotation symmetry. When the sectional shape of the hosel hole 2010 has n-fold rotation symmetry (n is an integer of equal to or greater than 2), n is preferably equal to or greater than 3 and equal to or less than 12, and more preferably equal to or greater than 4 and equal to or less than 8.

Figure 24A:
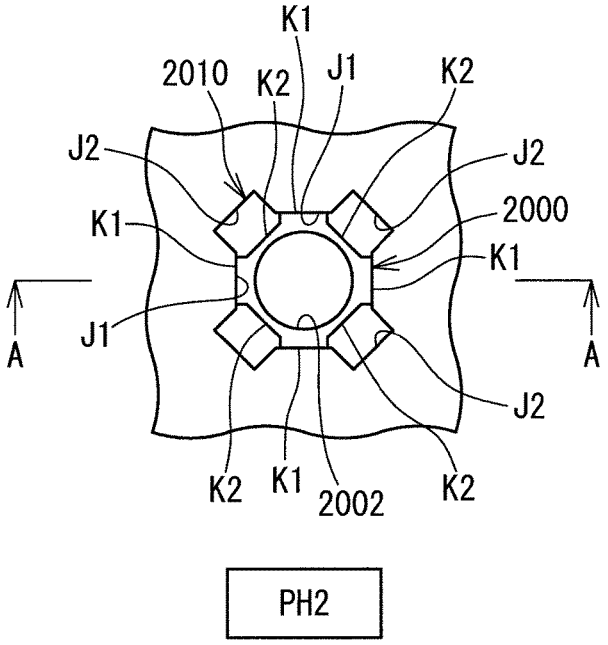
FIG. 24(*a*) is a plan view of a sleeve and a hosel hole in an engagement state (a second phase state), and FIG. 24(*b*) is a bottom view of the sleeve and the hosel hole in the engagement state (the second phase state)
Figure 24B:
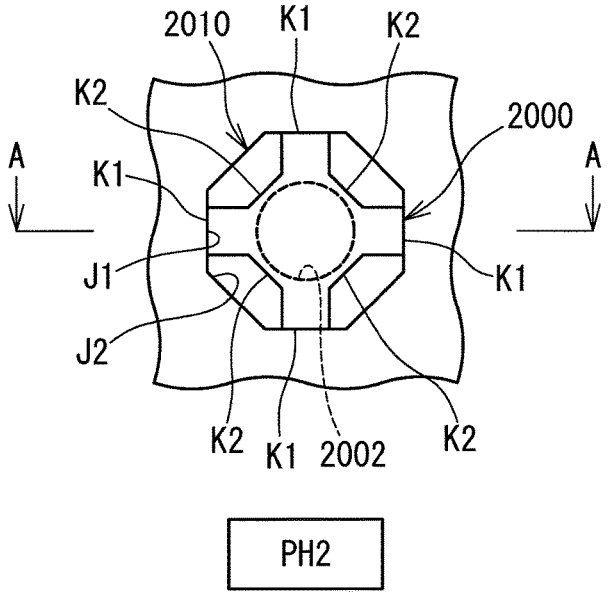
Figure 25:
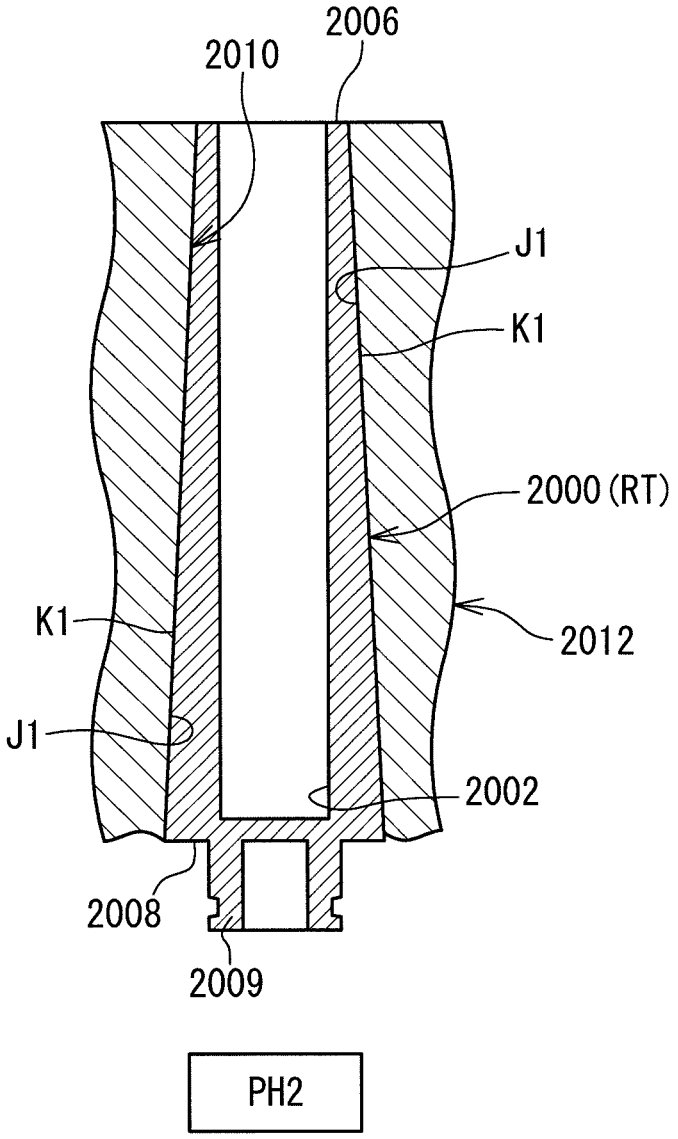
FIG. 25 is a sectional view taken along line A-A in FIG. 24(*a*)

FIG. 24(*a*) and FIG. 24(*b*) each show the sleeve 2000 and the hosel hole 2010 in the engagement state. FIG. 24(*a*) is a plan view as viewed from the upper side, and FIG. 24(*b*) is a bottom view as viewed from the lower side. FIG. 25 is a sectional view taken along line A-A in FIG. 24(*a*) and FIG. 24(*b*). The golf club according to the present embodiment becomes usable by the engagement state. In the bottom view in FIG. 24(*b*), the illustration of the sleeve-side connection part 2009 is omitted.

In the engagement state, the reverse-tapered engagement faces K1 abut on the respective reverse-tapered hole faces J1. All the reverse-tapered engagement faces K1 abut on the respective reverse-tapered hole faces J1. The reverse-tapered engagement faces K1 are fitted to the reverse-tapered hole faces J1.

In the engagement state, the non-engagement faces K2 are opposed to the respective interference-avoiding faces J2. All the non-engagement faces K2 are opposed to the respective interference-avoiding faces J2. A gap (space) is present each between the non-engagement faces K2 and the respective interference-avoiding faces J2.

Figure 26:
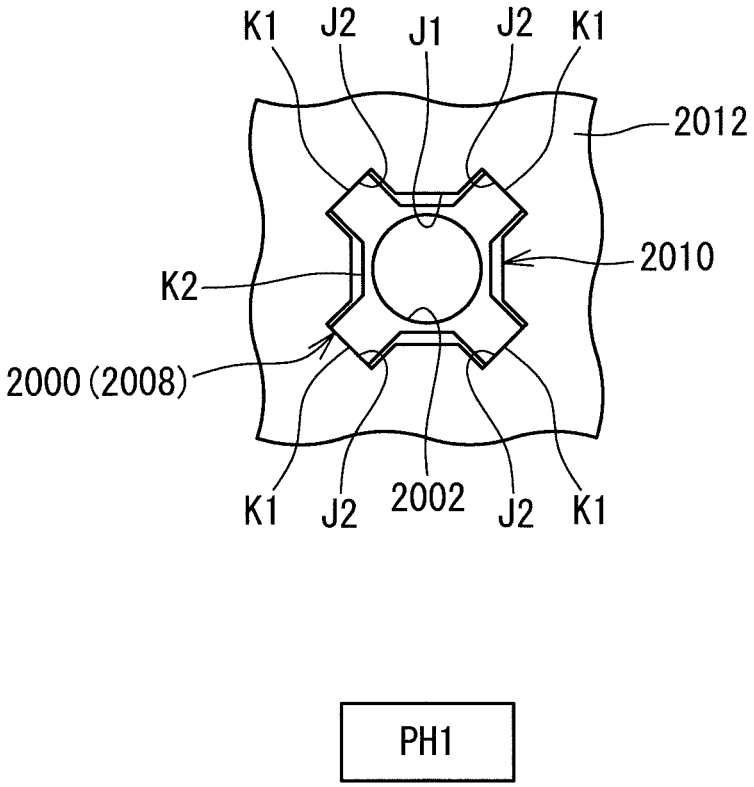
FIG. 26 is a plan view showing a relationship between a bottom surface of the sleeve the upper end of the hosel hole in a first-phase state.

FIG. 26 is a plan view showing the sleeve 2000 and the hosel hole 2010 in a process of passing the sleeve 2000 through the hosel hole 2010. FIG. 26 shows a state at a starting time of the passing process. FIG. 26 shows the upper end surface of the hosel hole 2010 (FIG. 23(*a*)) and the lower end surface 2008 of the sleeve 2000.

In the present embodiment, a spacer is not used. In the present embodiment, only the sleeve 2000 constitutes the tip engagement part RT.

As explained in FIG. 26, the tip engagement part RT can be made to pass through the hosel hole 2010. FIG. 26 shows the fact that the passing can be performed. The sleeve 2000 has the maximum sectional area at the lower end surface 2008 thereof. On the other hand, the hosel hole 2010 has the minimum sectional area at the upper end thereof. FIG. 26 shows that the lower end surface 2008 having the maximum sectional area can pass through the upper end of the hosel hole 2010 which has the minimum sectional area. The sleeve 2000 can pass through the hosel hole 2010. The sleeve 2000 can be inserted to the hosel hole 2010 from the upper side and can come out from the lower side of the hosel hole 2010.

In the present application, a first phase state PH1 and a second phase state PH2 are defined. The first phase state PH1 and the second phase state PH2 show relative phase relationships between the hosel hole 2010 and the sleeve 2000. A mutual shifting between the first phase state PH1 and the second phase state PH2 can be performed by rotating the sleeve 2000 with respect to the hosel hole 2010.

In the first phase state PH1, the reverse-tapered engagement faces K1 are opposed to the respective interference-avoiding faces J2. FIG. 26 shows the first phase state PH1. As described above, in the first phase state PH1 (FIG. 26), the hosel hole 2010 allows the tip engagement part RT (sleeve 2000) to pass through the hosel hole 2010. Although not clearly shown in FIG. 26, a (slight) clearance is present each between the reverse-tapered engagement faces K1 and the respective interference-avoiding faces J2.

In the first phase state PH1, the non-engagement faces K2 are opposed to the respective reverse-tapered hole faces J1. In the first phase state PH1, a gap is present each between the non-engagement faces K2 and the reverse-tapered hole faces J1.

In the second phase state PH2, the reverse-tapered engagement faces K1 are opposed to the respective reverse-tapered hole faces J1. FIG. 24(*a*) and FIG. 24(*b*) show the second phase state PH2. In the second phase state PH2, the engagement state is achieved. As described above, in the engagement state, the reverse-tapered engagement faces K1 are brought into surface-contact with the respective reverse-tapered hole faces J1. In the second phase state PH2, the reverse-tapered engagement faces K1 can be fitted to the respective reverse-tapered hole faces J1.

Thus, in assembling the golf club according to the present embodiment, the sleeve 2000 is fixed (bonded) to the tip end portion of a shaft. Next, the sleeve 2000 is inserted to the hosel hole 2010 from above, and is made to completely pass through the hosel hole 2010. By the passing, the sleeve 2000 reaches the lower side of the sole, and the shaft is inserted to the hosel hole 2010. In the passing process, the first phase state PH1 is adopted (see FIG. 26). Next, the sleeve 2000 fixed to the shaft is rotated so that the first phase state PH1 is shifted to the second phase state PH2. The sleeve 2000 is exposed to the outside, and thus can be freely rotated. In the present embodiment, the angle of the rotation is 45 degrees. Finally, the shaft to which the sleeve 2000 is fixed is pulled up, and the reverse-tapered engagement faces K1 are fitted to the respective reverse-tapered hole faces J1. This final state is shown in FIG. 24(*a*), FIG. 24(*b*) and FIG. 25.

Thus, the first phase state PH1 enables the sleeve 2000 to pass through the hosel hole 2010. The second phase state PH2 enables the sleeve 2000 to be fitted to the hosel hole 2010.

In the sleeve 2000, a center line of the sleeve inner surface 2002 is not inclined with respect to a center line of the sleeve outer surface. Of course, the center line of the sleeve inner surface 2002 may be inclined with respect to the center line of the sleeve outer surface. The center line of the sleeve inner surface 2002 may be parallel and eccentric with respect to the center line of the sleeve outer surface.

In the present embodiment, a spacer is not used. However, a spacer can be provided. For example, the shape of the sleeve 2000 can be formed by a spacer and a sleeve. In this case, the outer shape of the sleeve may be a regular eight-sided pyramid having a reverse-tapered shape. The spacer suited to the sleeve may have an inner shape of a regular eight-sided pyramid corresponding to the outer shape of the sleeve, and may have an outer shape which is the same as the shape of the sleeve 2000. When a spacer is used, an inclination angle can be set between the center line of the inner shape of the sleeve and the center line of the outer shape of the sleeve, and an inclination angle can be set between the center line of the inner shape of the spacer and the center line of the outer shape of the spacer. In this case, as described above, an independent variability of the loft angle and an independent variability of the lie angle can be attained.

A taper ratio of the reverse-tapered fitting is not limited. When the taper ratio is excessively small, it may be difficult to release the reverse-tapered fitting. Meanwhile, when the taper ratio is excessively large, the size of the fitting portion becomes large. An excessively large fitting portion deteriorates the degree of freedom of design of the golf club. In this respect, the taper ratio is preferably set within a predetermined range.

In the above-explained respects, the outer surface of the sleeve has a taper ratio of preferably equal to or greater than 0.2/30, more preferably equal to or greater than 0.5/30, and still more preferably equal to or greater than 1.0/30. In the above-explained respects, the taper ratio of the outer surface of the sleeve is preferably equal to or less than 5/30, more preferably equal to or less than 4/30, and still more preferably equal to or less than 3.5/30.

In the above-explained respects, the inner surface of the spacer has a taper ratio of preferably equal to or greater than 0.2/30, more preferably equal to or greater than 0.5/30, and still more preferably equal to or greater than 1.0/30. In the above-explained respects, the taper ratio of the inner surface of the spacer is preferably equal to or less than 5/30, more preferably equal to or less than 4/30, and still more preferably equal to or less than 3.5/30.

In the above-explained respects, the outer surface of the spacer has a taper ratio of preferably equal to or greater than 0.2/30, more preferably equal to or greater than 0.5/30, and still more preferably equal to or greater than 1.0/30. In the above-explained respects, the taper ratio of the outer surface of the spacer is preferably equal to or less than 10/30, more preferably equal to or less than 7/30, and still more preferably equal to or less than 5/30.

In the above-explained respects, the reverse-tapered hole has a taper ratio of preferably equal to or greater than 0.2/30, more preferably equal to or greater than 0.5/30, and still more preferably equal to or greater than 1.0/30. In the above-explained respects, the taper ratio of the reverse-tapered hole is preferably equal to or less than 10/30, more preferably equal to or less than 7/30, and still more preferably equal to or less than 5/30.

In the above-explained respects, the reverse-tapered engagement faces have a taper ratio of preferably equal to or greater than 0.2/30, more preferably equal to or greater than 0.5/30, and still more preferably equal to or greater than 1.0/30. In the above-explained respects, the taper ratio of the reverse-tapered engagement faces is preferably equal to or less than 10/30, more preferably equal to or less than 7/30, and still more preferably equal to or less than 5/30.

In the above-explained respects, the reverse-tapered hole faces have a taper ratio of preferably equal to or greater than 0.2/30, more preferably equal to or greater than 0.5/30, and still more preferably equal to or greater than 1.0/30. In the above-explained respects, the taper ratio of the reverse-tapered hole faces is preferably equal to or less than 10/30, more preferably equal to or less than 7/30, and still more preferably equal to or less than 5/30.

The definition of the taper ratio is as follows. When a length in an axial direction of the tapered surface is represented by Da, and a varied width in a direction perpendicular to the axial direction is represented by Db, then the taper ratio is Db/Da. In the taper ratio, varied amount in both sides, not an inclination (gradient) in one side, is considered. For example, in a case of a circular cone, the varied width Db is a varied amount of a diameter thereof, not a radius thereof. For example, in a case of a regular quadrangular pyramid, although the sectional shape of the regular quadrangular pyramid is a square, the varied width Db is a varied amount of the length of one side of the square.

The sectional area of the reverse-tapered hole is gradually increased toward the lower side (sole side). The sectional shape of the reverse-tapered hole is a non-circle. The sectional shape of the non-circle prevents relative rotation between the hosel hole and the tip engagement part. The non-circle includes all shapes other than a circle. For example, the non-circle may be a shape having a projection, a recess, or a flat portion at at least a part in the circumferential direction of a circle. The sectional shape of the reverse-tapered hole may be a polygon. Examples of the polygon include a triangle, a tetragon, a pentagon, a hexagon, a heptagon, an octagon, and a dodecagon. The polygon may be an N-sided polygon in which N is an even number, and examples of the N-sided polygon include the tetragon, the hexagon, the octagon, and the dodecagon. In light of anti-rotation, the tetragon, the hexagon and the octagon are preferable. The sectional shape of the reverse-tapered hole may be a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of anti-rotation, the regular tetragon, the regular hexagon, and the regular octagon are more preferable.

The reverse-tapered hole preferably includes a plurality of faces. Each of the faces may be a plane face, or may be a curved face. From the viewpoint of ensuring surface-contact with the tip engagement part, each of these faces is preferably a plane face. From the viewpoint of ensuring surface-contact with the tip engagement part, the reverse-tapered hole may be a pyramid surface. The pyramid surface means a part of the outer surface of a pyramid. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

When the reverse-tapered hole faces J1 are adopted as in the embodiment of FIG. 21 to FIG. 26, each of the reverse-tapered hole faces J1 may be a plane face, or may be a curved face. From the viewpoint of ensuring surface-contact with the reverse-tapered engagement faces K1, each of the reverse-tapered hole faces J1 is preferably a plane face. From the viewpoint of ensuring surface-contact with the reverse-tapered engagement faces K1, the reverse-tapered hole faces J1 may constitute a pyramid surface. The pyramid surface means a part of the outer surface of a pyramid. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface, and the eight-sided pyramid surface are more preferable.

The area of a figure formed by a sectional line of the outer surface of the sleeve is gradually increased toward the lower side (sole side). The sectional shape of the outer surface of the sleeve is a non-circle. The sectional shape of the non-circle prevents relative rotation between the sleeve and an abutting portion. The abutting portion is the inner surface of the spacer or the reverse-tapered hole. When a plurality of spacers are present, the abutting portion is the inner surface of the innermost spacer. The non-circle includes all shapes other than a circle. For example, the non-circle may be a shape having a projection, a recess, or a flat portion at at least a part in the circumferential direction of a circle. The sectional shape of the outer surface of the sleeve may be a polygon. Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of anti-rotation, the tetragon, the hexagon, and the octagon are preferable. The sectional shape of the outer surface of the sleeve may be a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of anti-rotation, the regular tetragon, the regular hexagon, and the regular octagon are more preferable.

The outer surface of the sleeve preferably includes a plurality of faces. Each of the faces may be a plane face, or may be a curved face. From the viewpoint of ensuring surface-contact with the abutting portion, each of these faces is preferably a plane face. From the viewpoint of ensuring surface-contact with the abutting portion, the outer surface of the sleeve is preferably a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

As described above, the golf club may have one or more spacers. The inner surface of the spacer has the same shape as the shape of an outer surface of a member (inner member) fitted inside the spacer. The inner member is the sleeve or another spacer.

The area of a figure formed by a sectional line of the inner surface of the spacer is gradually increased toward the lower side (sole side). The sectional shape of the inner surface of the spacer is a non-circle. The sectional shape of the non-circle prevents relative rotation between the spacer and the inner member. When a plurality of spacers are present, the inner member is another spacer. The non-circle includes all shapes other than a circle. For example, the non-circle may be a shape having a projection, a recess, or a flat portion at at least a part in the circumferential direction of a circle. The sectional shape of the inner surface of the spacer may be a polygon. Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of anti-rotation, the tetragon, the hexagon, and the octagon are preferable. The sectional shape of the inner surface of the spacer may be a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of anti-rotation, the regular tetragon, the regular hexagon, and the regular octagon are more preferable.

The inner surface of the spacer preferably includes a plurality of faces. Each of the faces may be a plane face, or may be a curved face. From the viewpoint of ensuring surface-contact with the inner member, each of these faces is preferably a plane face. From the viewpoint of ensuring surface-contact with the inner member, the inner surface of the spacer may be a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

As described above, the club of the present disclosure includes a tip engagement part. The tip engagement part may be constituted with only the sleeve, or may by constituted with the sleeve and one or more spacers. When the spacer is not used, the outer surface of the tip engagement part is the outer surface of the sleeve. When one spacer is used, the outer surface of the tip engagement part is the outer surface of the spacer. When two or more spacers are used, the outer surface of the tip engagement part is the outer surface of the outermost spacer.

The area of a figure formed by a sectional line of the outer surface of the tip engagement part is gradually increased toward the lower side (sole side). The sectional shape of the outer surface of the tip engagement part is a non-circle. The sectional shape of the non-circle prevents relative rotation between the tip engagement part and the reverse-tapered hole. The non-circle includes all shapes other than a circle. For example, the non-circle may be a shape having a projection, a recess, or a flat portion at at least a part in the circumferential direction of a circle. The sectional shape of the outer surface of the tip engagement part may be a polygon. Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of anti-rotation, the tetragon, the hexagon, and the octagon are preferable. The sectional shape of the outer surface of the tip engagement part may be a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of anti-rotation, the regular tetragon, the regular hexagon, and the regular octagon are more preferable.

The outer surface of the tip engagement part preferably includes a plurality of faces. Each of the faces may be a plane face, or may be a curved face. From the viewpoint of ensuring surface-contact with the reverse-tapered hole, each of these faces is preferably a plane face. From the viewpoint of ensuring surface-contact with the reverse-tapered hole, the outer surface of the tip engagement part may be a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

When the tip engagement part RT is the sleeve 2000 (FIG. 21), the outer surface of the reverse-tapered engagement faces K1 preferably includes a plurality of faces. Each of the faces may be a plane face, or may be a curved face. From the viewpoint of ensuring surface-contact with the reverse-tapered hole faces J1, each of these faces is preferably a plane face. From the viewpoint of ensuring surface-contact with the reverse-tapered hole faces J1, the outer surface of the reverse-tapered engagement faces K1 preferably constitutes a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

Each of the above-mentioned numbers N is preferably an integer of equal to or greater than 3.

Thus, the reverse-tapered fitting is formed by the sleeve and the reverse-tapered hole while the spacer is interposed as necessary.

Figure 27:
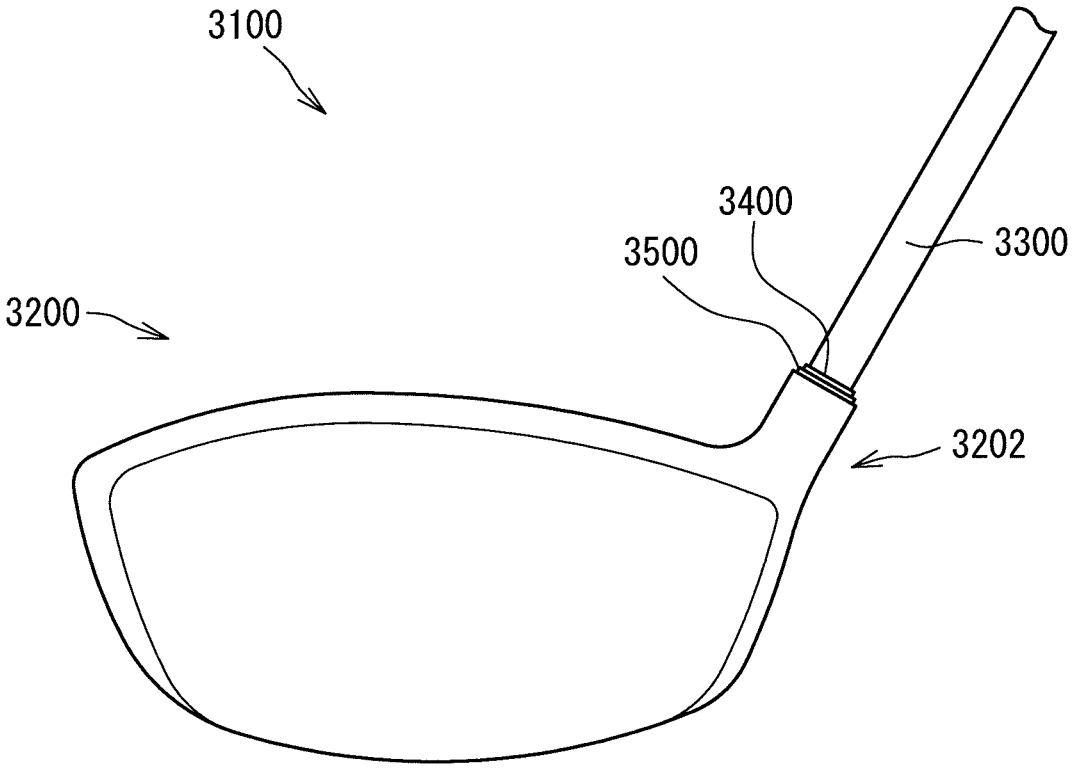
FIG. 27 is a front view of a golf club according to another embodiment.
Figure 28:
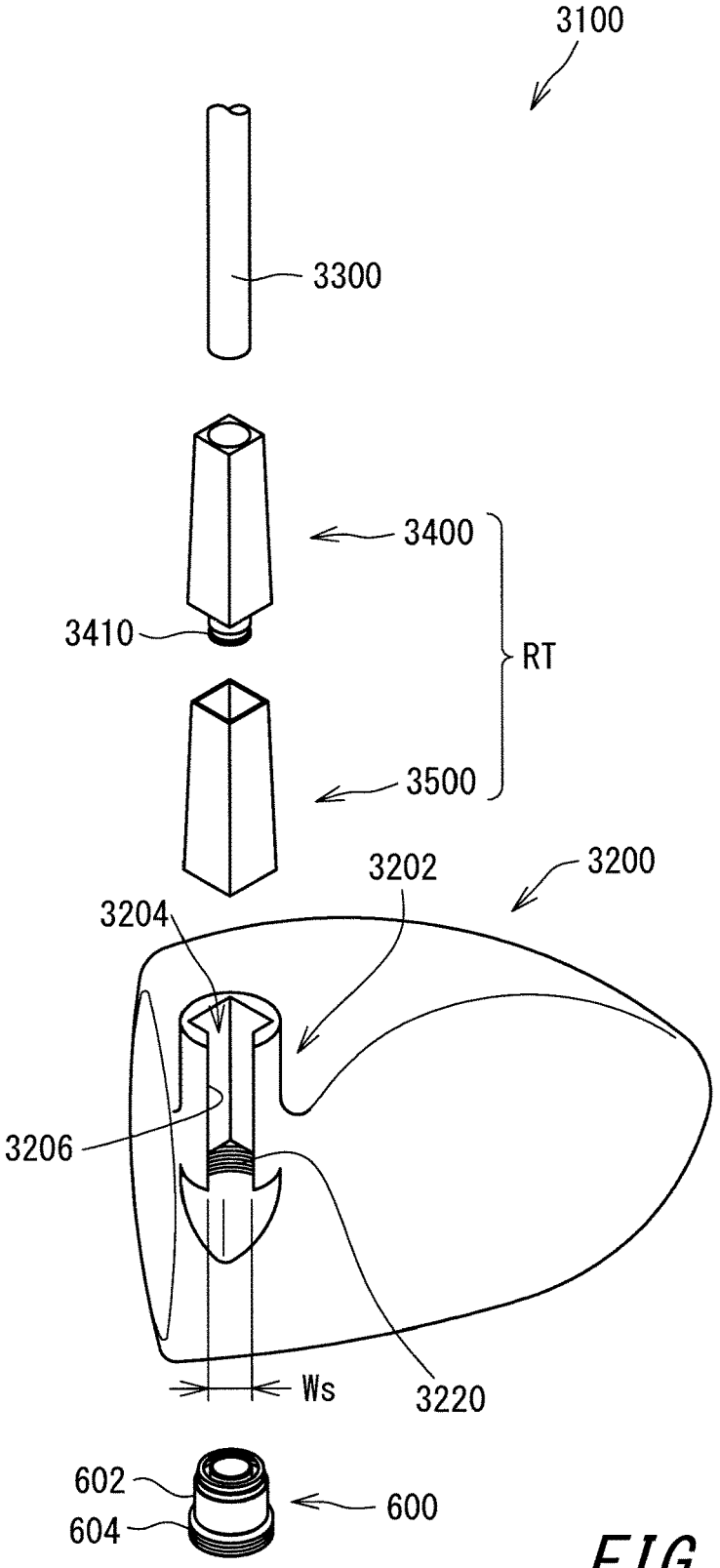
FIG. 28 is an exploded perspective view of the golf club in FIG. 27.

FIG. 27 shows a golf club 3100 which is another embodiment. FIG. 27 shows only the vicinity of a head of the golf club 3100. FIG. 28 is an exploded perspective view of the golf club 3100.

The golf club 3100 has a head 3200, a shaft 3300, a sleeve 3400, a spacer 3500, and a grip (not shown in the drawings). The sleeve 3400 and the spacer 3500 constitute a tip engagement part RT.

The head 3200 has a hosel part 3202. The hosel part 3202 has a hosel hole 3204. The hosel hole 3204 has a reverse-tapered hole 3206. The shape of the reverse-tapered hole 3206 corresponds to the shape of the outer surface of the tip engagement part RT. In other words, the shape of the reverse-tapered hole 3206 corresponds to the shape of the outer surface of the spacer 3500.

The hosel part 3202 has a hosel slit 3206. The hosel slit 3206 is provided lateral to the hosel part 3202. The hosel slit 3206 is an opening formed between the inside of the hosel hole 3204 and the outside of the head. The hosel slit 3206 is opened to the axial-direction upper side, and is also opened to the axial-direction lower side. The hosel slit 3206 is provided on a heel side of the hosel part 3202. Because of the hosel slit 3206, a part of the reverse-tapered hole 3206 is lacking.

The head 3200 has a female screw part 3220. The female screw part 3220 is provided on the lower side of the hosel part 3202. The female screw part 3220 is provided on the lower side of the hosel hole 3204.

Because of the presence of the slit 3206, a part in the circumferential direction of the female screw part 3220 is lacking. However, the lack does not affect the screw-connection to the screw member 600. The female screw part 3220 can be screw-connected to the male screw part 604 of the screw member 600. The screw member 600 can be connected to the sleeve 3400 (sleeve-side connection part 3410).

FIG. 28 shows a width Ws of the hosel slit 3206. The width Ws is larger than the diameter of the shaft 3300. The width Ws is larger than at least the diameter of the thinnest portion of the shaft 3300. Therefore, the hosel slit 3206 allows the shaft 3300 to pass therethrough. The hosel slit 3206 allows the shaft 3300 moving in the axial perpendicular direction to pass therethrough.

Because of the hosel slit 3206, a part in the circumferential direction of the hosel hole 3204 is lacking. From the viewpoint of enhancing the retention for the tip engagement part RT, the width Ws is preferably small. For example, the width Ws may be larger than the diameter of the thinnest portion of an exposed part of the shaft 3300. The exposed part means a part to which a sleeve and a grip are not attached, and is exposed to the outside. Needless to say, the width Ws is set so as not to allow passage of the tip engagement part RT. The tip engagement part RT cannot pass through the hosel slit 3206.

The sleeve 3400 is the same as the above-described sleeve 400. The sleeve 3400 has a sleeve-side connection part 3410. The sleeve-side connection part 3410 is the same as the above-described sleeve-side connection part 410. The sleeve 3400 is fixed to a tip end portion of the shaft 3300. An adhesive is used for the fixation.

The shape of the spacer 3500 is the same as that of the above-described spacer 500. However, the spacer 3500 does not have a divided structure. The spacer 3500 is an integral body as a whole.

Figure 29:
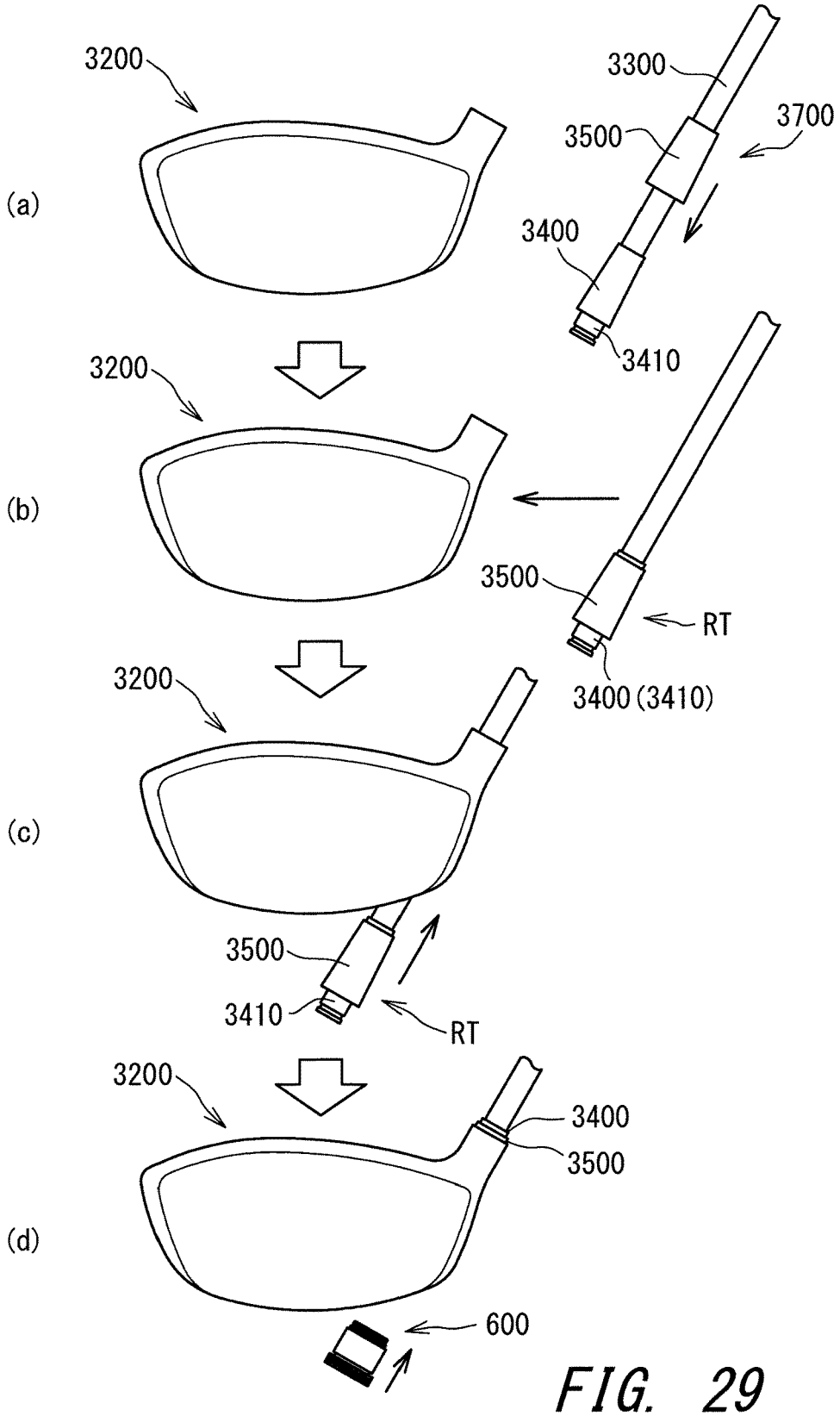
FIG. 29 is an assembling process view of the golf club in FIG. 27.

FIG. 29 shows a procedure of mounting the shaft 3300 of the golf club 3100 to the head 3200.

In the mounting procedure, a shaft assembly 3700 is prepared first (step (a) in FIG. 29). The shaft assembly 3700 has a shaft 3300, a sleeve 3400, and a spacer 3500. After the shaft 3300 has been inserted to the spacer 3500, the sleeve 3400 is fixed to the tip end portion of the shaft 3300, whereby the shaft assembly 3700 is obtained. In the shaft assembly 3700, the sleeve 3400 is fixed to the shaft 3300, but the spacer 3500 is not fixed to the shaft 3300. In a state in which the shaft 3300 is inserted, the spacer 3500 can be moved in the axial direction (see step (a) in FIG. 29). However, because of the presence of the sleeve 3400, the spacer 3500 will not fall off from the shaft 3300.

Next, in the shaft assembly 3700, the spacer 3500 is moved until it abuts on the outer surface of the sleeve 3400 (step (b) in FIG. 29). That is, the spacer 3500 is moved to the most distal side of the shaft assembly 3700. This movement causes the spacer 3500 to be engaged with the sleeve 3400, whereby the tip engagement part RT is formed.

Next, the shaft 3300 is made to pass through the hosel slit 3206, whereby the shaft 3300 is moved to the inside of the reverse-tapered hole 3206 (step (c) in FIG. 29). As a result of the movement of the shaft 3300, the tip engagement part RT is moved to the sole side of the head 3200.

Next, the shaft 3300 (shaft assembly 3700) is moved to the grip side along the axial direction, whereby the tip engagement part RT is fitted to the reverse-tapered hole 3206 (step (d) of FIG. 29).

Finally, the screw member 600 is screwed to the female screw part 3220. The male screw part 604 of the screw member 600 is screw-connected to the female screw part 3220. By the screw-connection, the screw member 600 presses the tip engagement part RT to the upper side, whereby the engagement state is ensured. In addition, the screw member 600 is automatically connected to the sleeve 3400.

In the present embodiment, the hosel slit 3206 is provided, and the shaft 3300 can pass through the hosel slit 3206. Therefore, the sleeve 3400 may not be allowed to pass through the hosel hole 3204. The spacer 3500 may not have a divided structure.

Figure 30:
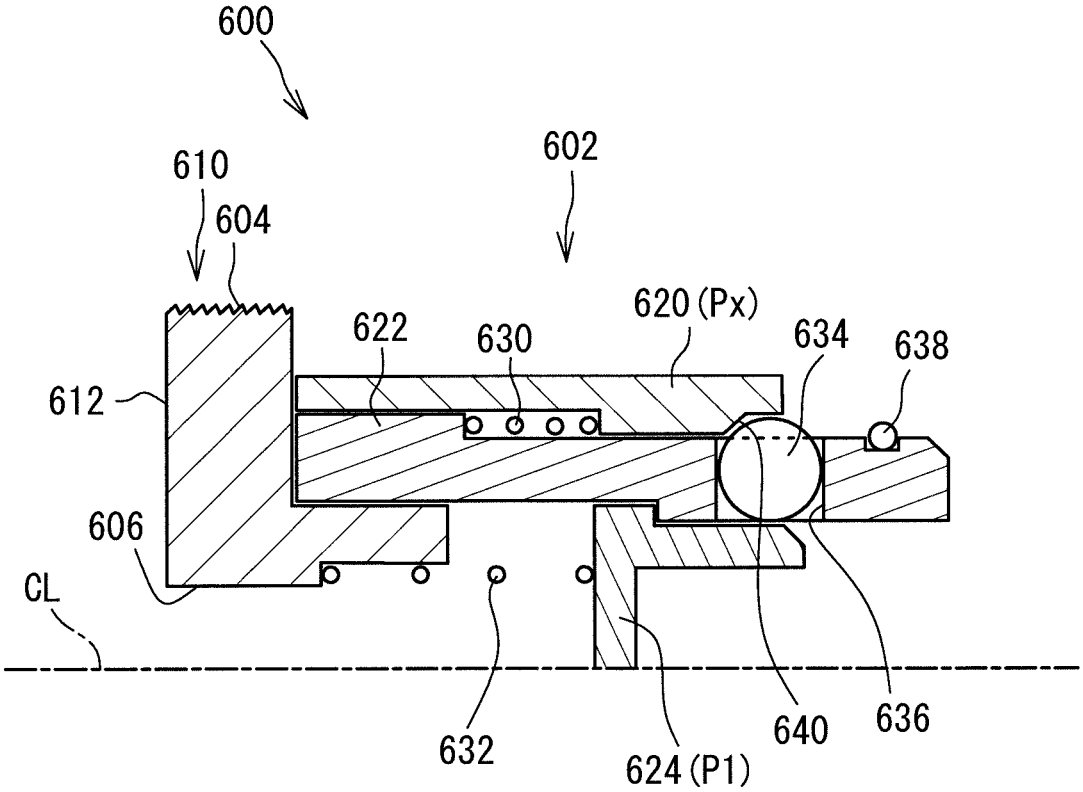
FIG. 30 is a sectional view of a screw member according to a first embodiment.
Figure 31:
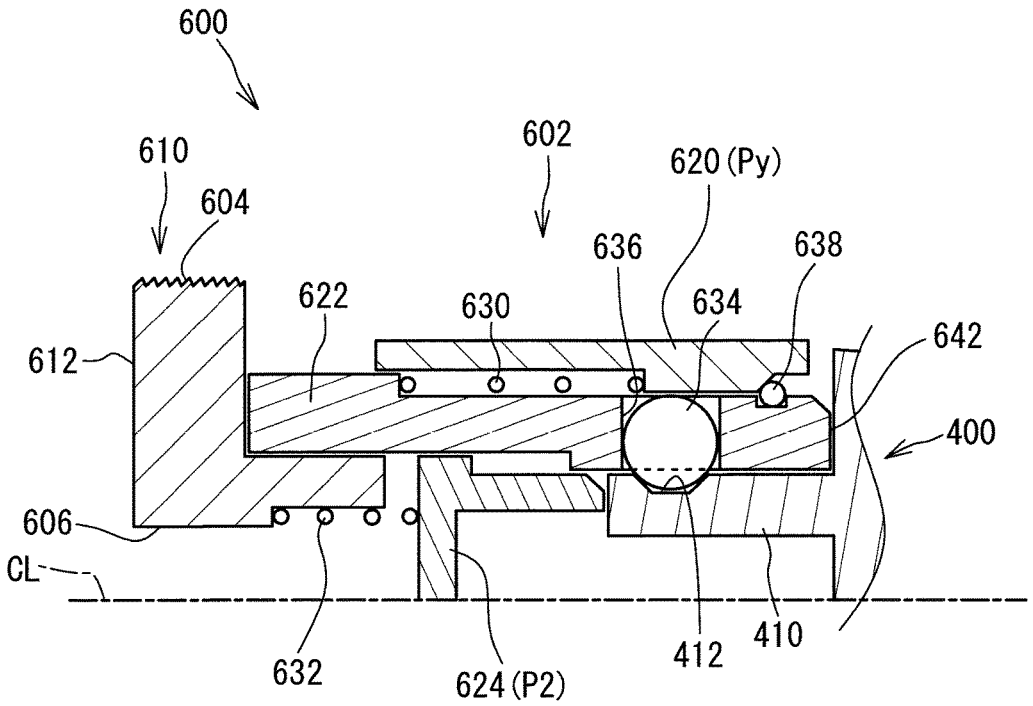
FIG. 31 is a sectional view when the screw member in FIG. 30 is brought into a connected state.

FIG. 30 is a sectional view of the screw member 600. FIG. 31 is a sectional view showing a state in which the screw member 600 is connected to the sleeve 400. In these sectional views, a center line CL of the screw member 600 is indicated by a one-dot chain line, and the illustration of portions on the lower side of the center line CL is omitted. The actual sectional views are line-symmetric about the center line CL as an axis of symmetry.

As described above, the screw member 600 has the screw-side connection part 602, the male screw part 604, and the rotating engagement part 606. A detailed structure of the screw member 600 will be explained below.

The screw member 600 has a screw body 610. A male screw part 604 is formed on an outer circumferential surface of the screw body 610. The rotating engagement part 606 is provided on a bottom surface 612 of the screw body 610. The rotating engagement part 606 is a recess having a non-circular sectional shape. By inserting a wrench to the rotating engagement part 606, the screw body 610 can be rotated about the center line CL. The wrench preferably has a torque limiter. With the torque limiter, the force with which the screw member 600 presses the tip engagement part RT can be adjusted. From the viewpoint of the Golf Rules, the wrench is preferably used exclusively for the screw member 600.

The screw-side connection part 602 has a first member 620, a second member 622, and a third member 624. The first member 620, the second member 622, and the third member 624 each have a cylindrical shape as a whole. The first member 620 is exposed to the outside. The second member 622 is positioned inside the first member 620. The second member 622 is fixed to the screw body 610. The second member 622 may be integral with the screw body 610. The second member 622 rotates with the rotation of the screw body 610. The third member 624 is positioned inside the second member 622. The first member 620 can be slidably moved with respect to the second member 622. The third member 624 can be slidably moved with respect to the second member 622.

The screw-side connection part 602 has a first elastic body 630 and a second elastic body 632. The first elastic body 630 is a coil spring. The first elastic body 630 is a compression spring. The second elastic body 632 is a coil spring. The second elastic body 632 is a compression spring.

The screw-side connection part 602 has a ball 634. The ball 634 is a steel ball. In the present application, the ball 634 is also referred to as an engagement ball.

The second member 622 has a ball housing hole 636. The ball housing hole 636 is a through hole. The engagement ball 634 is disposed in the ball housing hole 636. The diameter of the ball housing hole 636 is substantially equal to the diameter of the ball 634. The engagement ball 634 can pass through the ball housing hole 636.

The diameter of the ball 634 is larger than the depth of the ball housing hole 636. For this reason, the ball 634 housed in the ball housing hole 636 is in a state of being projected inside or outside the second member 622. In FIG. 30, the ball 634 is projected outside the second member 622.

Although not shown in the drawings, the ball housing holes 636 are provided at a plurality of positions in the circumferential direction. The ball housing holes 636 are uniformly arranged in the circumferential direction. In the present embodiment, four ball housing holes 636 are arranged at 90° intervals. One ball 634 is disposed in each of the ball housing holes 636. Here, the circumferential direction means the circumferential direction of the screw member 600.

The second member 622 has a stopper 638. The stopper 638 is an annular member disposed in a circumferential groove provided on the outer circumferential surface of the second member 622. A circlip is used as the annular member.

The first elastic body 630 is disposed between (a step surface of) the first member 620 and (a step surface of) the second member 622. The first elastic body 630 biases the first member 620 to a sleeve side (the right side in FIG. 30) with respect to the second member 622.

The second elastic body 632 is disposed between (a step surface of) the screw body 610 and (a bottom surface of) of the third member 624. The second elastic body 632 biases the third member 624 to the sleeve side (the right side in FIG. 30) with respect to the screw body 610.

In the following, the state of the screw member 600 shown in FIG. 30 is also referred to as a non-connected state, and the state of the screw member 600 shown in FIG. 31 is also referred to as a connected state. The sleeve side is also referred to as an upper side, and the sole side is also referred to as a lower side. The right side in FIG. 30 and FIG. 31 is the upper side, and the left side in FIG. 30 and FIG. 31 is the lower side.

In the non-connected state (FIG. 30), the third member 624 is pressed to the upper side by the second elastic body 632, and is located at a position P1 on a relatively front side. In the position P1, the third member 624 abuts on the step surface of the second member 622.

The third member 624 located at the position P1 has a portion positioned inside the ball housing hole 636. The third member 624 located at the position P1 prevents the ball 634 from being projected inside. Therefore, in the non-connected state, the ball 634 is projected outside the second member 622.

In the non-connected state (FIG. 30), the first member 620 is pressed to the upper side by the first elastic body 630, but its movement to the upper side is regulated by the ball 634 being projected outside. As a result, in the non-connected state, the first member 620 is located at a position Px on a relatively lower side.

The first member 620 has an inclined surface 640. The inclined surface 640 is a conical concave surface. The inclined surface 640 is inclined so as to extend toward the radially outward direction as going to the upper side. The radial direction means the radial direction of the screw member 600. In the non-connected state, the inclined surface 640 abuts on the ball 634.

When the male screw part 604 of the screw body 610 is screwed into the female screw part 220 (see FIG. 5) of the head by rotating the screw member 600 (screw body 610) in the first direction, the screw body 610 is moved to the upper side, and the second member 622 is also positioned on the upper side by being pressed by the screw body 610. As a result, the entire screw member 600 is moved to the upper side.

When the movement of the screw member 600 to the upper side progresses as the rotation of the crew member 600 in the first direction is continued, the sleeve-side connection part 410 of the sleeve 400 is inserted inside the screw member 600. More specifically, the sleeve-side connection part 410 is inserted inside the second member 622. In the insertion, (a lower end surface of) the sleeve-side connection part 410 presses the third member 624 to the lower side against the biasing force of the second elastic body 632. By the insertion of the sleeve-side connection part 410, the third member 624 is moved to a position P2 on a relatively lower side.

By this movement, the abutment between the third member 624 and the ball 634 is released. In place of the third member 624, the engagement recess 412 of the sleeve-side connection part 410 reaches the same axial direction position as that of the ball 634.

As described above, the ball 634 receives a pressing force from the inclined surface 640 by the biasing force of the first elastic body 630, and the pressing force includes a component force to the inner side in the radial direction. Accordingly, the ball 634 falls in the engagement recess 412 that has been moved to the inner side in the radial direction of the ball 634 (FIG. 31). A part of the ball 634 is located within the engagement recess 412, and the other parts thereof are located within the ball housing hole 636. Therefore, the ball 634 locks the sleeve-side connection part 410 to the screw-side connection part 602.

When the ball 634 falls in the engagement recess 412, the abutment between the ball 634 and the first member 620 is released. As a result, the first member 620 is moved to a second position Py on a relatively upper side by the biasing force of the first elastic body 630. At the second position Py, the first member 620 abuts on the stopper 638. The connected state is achieved by the movement of the first member 620.

As shown in FIG. 31, the first member 620 located at the second position Py prevents the ball 634 from being projected outside. Therefore, the state in which the ball 634 falls in the engagement recess 412 is maintained. That is, the connected state is maintained. As long as the second position Py of the first member 620 is maintained, it is not possible to pull out the sleeve-side connection part 410 from the screw member 600.

Thus, by simply rotating the screw member 600 in the first direction with respect to the female screw part 220, the sleeve 400 and the screw member 600 are automatically connected to each other, whereby the connected state is achieved (FIG. 31). In the connected state, the third member 624 is located at the position P2, the first member 620 is located at the position Py, and the ball 634 is engaged with the engagement recess 412.

In the connected state, the screw member 600 presses the sleeve 400 to the upper side. Specifically, an upper end surface 642 of the second member 622 presses the sleeve 400. As a result, the screw member 600 presses the sleeve 400 in the engaging direction. Therefore, the tip engagement part RT including the sleeve 400 is reliably fitted to the hosel hole 204, whereby backlash resulting from the dimensional error can be eliminated.

Elimination of backlash is accompanied by the elastic deformation of the tip engagement part RT or the hosel hole 204. Once fitting accompanied by the elastic deformation has been achieved, it will be difficult to release the fitting. That is, the tip engagement part RT is fitted into the hosel hole 204, and thus is difficult to be pulled out from the hosel hole 204. The connection between the screw member 600 and the sleeve 400 can solve this problem. When the screw member 600 is rotated in the second direction while maintaining the connected state, the screw member 600 is moved to the lower side, and the sleeve 400 is pulled in the engagement releasing direction by the screw member 600. As a result, the tip engagement part RT including the sleeve 400 is pulled out from the hosel hole 204.

As described above, the connection is maintained unless the first member 620 located at the second position Py is moved. Therefore, the connection is maintained when the screw member 600 is simply rotated in the second direction. The pulling-out of the tip engagement part RT is achieved by simply rotating the screw member 600 in the second direction.

To release the connection, the first member 620 may be moved to the lower side. The connected state can be released by moving the first member 620 to the position Px so as to bring about a state in which the ball 634 can be projected outside. The movement of the first member 620 is achieved by an external force. For example, the connected state can be released by simply moving the first member 620 to the lower side by fingers. The first member 620 can be moved by applying an external force greater than the biasing force of the first elastic body 630.

Thus, the connection can be easily released. The connection may be released upon confirmation of pulling out of the tip engagement part RT including the sleeve 400 from the hosel hole 204.

As explained above, in the present embodiment, by the rotation in the first direction DR1, the screw member 600 presses the tip engagement part RT in the engaging direction, and the sleeve-side connection part 410 is inserted to the screw-side connection part 602. The connection between the sleeve-side connection part 410 and the screw-side connection part 602 is automatically completed by the sleeve-side connection part being inserted to the screw-side connection part. Therefore, by simply screwing the screw member 600, the backlash between the tip engagement part RT and the head is eliminated, and the above-described connection that is effective for pulling out the tip engagement part RT is completed simultaneously.

In the present embodiment, the screw member 600 includes the screw body 610 having the male screw part 604; the first member 620 constituting an outer circumferential surface of the screw-side connection part 602; the second member 622 positioned inside the first member 620; and the third member 624 positioned inside the second member 622. The screw member 600 further includes the first elastic body 630 that is disposed between the first member 620 and the second member 622, and biases the first member 620 to the sleeve side (upper side) with respect to the second member 622; the second elastic body 632 that biases the third member 624 to the sleeve side (upper side); and the engagement ball 634 disposed in the ball housing hole 636. The sleeve-side connection part 410 has the engagement recess 412. In a non-connected state, the ball 634 is projected outside the second member 622 by the third member 624 being positioned inside the ball 634, and by the projected ball 634, the first member 620 is located at a first position Px at which movement thereof to the sleeve side is regulated. In a connected state in which the connection has been achieved, the third member 624 is moved to a position at which the third member 624 is removed from inside of the engagement ball 634 by the sleeve-side connection part 410, the engagement ball 634 falls in the engagement recess 412, and the movement regulation on the first member 620 by the engagement ball 634 is released, whereby the first member 620 is moved to a second position Py at which the first member 620 prevents the engagement ball 634 from projecting to the outside. Therefore, the above-described automatic connection is reliably achieved, and the connection can be easily released.

A mechanism used for a fluid coupling or an instant coupling may be adopted as the connecting structure of the screw-side connection part and the sleeve-side connection part. This mechanism is disclosed in Japanese Unexamined Utility Model Application Publication No. 60-108888, for example. Such a mechanism achieves connection by simply inserting one member into the other member, and the connection can be easily released, and therefore can be applied to the golf club according to the present disclosure.

Figure 32:
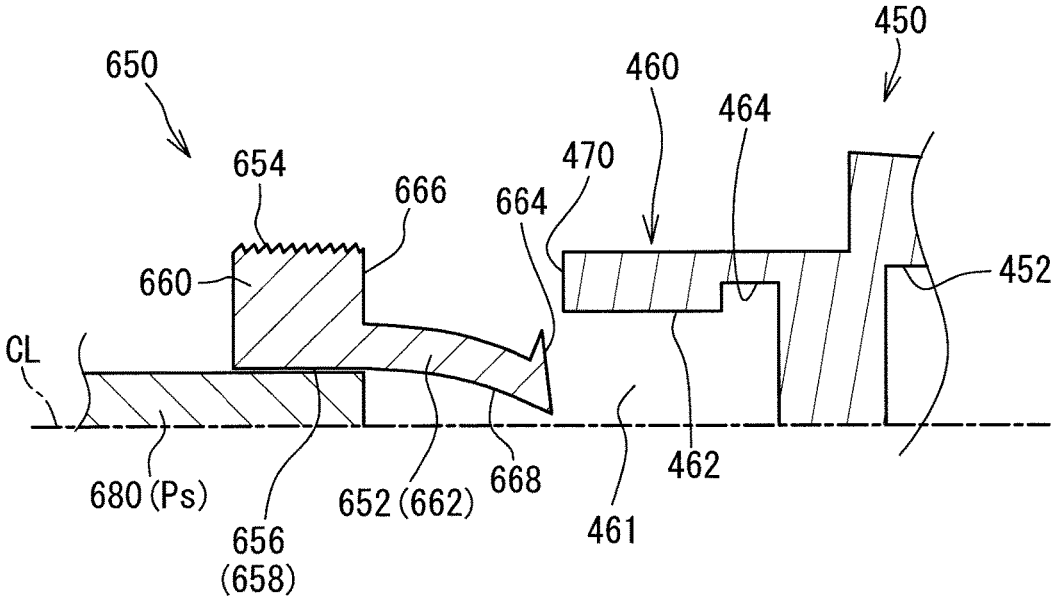
FIG. 32 is a sectional view showing a screw member and a sleeve according to another embodiment.
Figure 33:
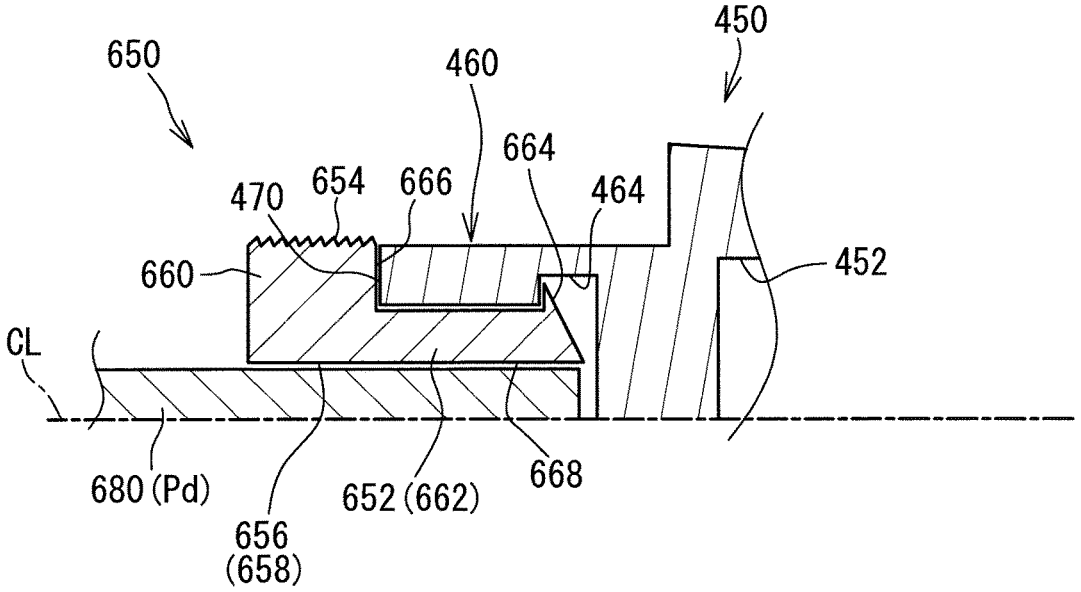
FIG. 33 is a sectional view when the screw member and the sleeve in FIG. 32 are brought into the connected state.

FIG. 32 and FIG. 33 are sectional views showing a screw member 650 according to another embodiment, and a sleeve 450 corresponding to the screw member 650. FIG. 32 shows a non-connected state, and FIG. 33 shows a connected state.

In FIG. 32 and FIG. 33, a center line CL of the screw member 650 is indicated by a one-dot chain line, and the illustration of portions on the lower side of the center line CL is omitted. The actual sectional views are line-symmetric about the center line CL as an axis of symmetry.

The screw member 650 has a cylindrical shape as a whole. The screw member 650 includes a screw-side connection part 652 and a male screw part 654. The screw member 650 further includes a rotating engagement part 656. The rotating engagement part 656 is a hole coaxial with the center line CL. The sectional shape of the hole is a non-circle. The rotating engagement part 656 penetrates the screw member 650.

The screw member 650 includes a screw body part 660 and an elastic deformation part 662. The elastic deformation part 662 has an engagement projection 664. The screw body part 660 has a cylindrical shape. The male screw part 654 is formed on the outer circumferential surface of the screw body part 660. The elastic deformation part 662 is positioned on the upper side of the screw body part 660.

The elastic deformation part 662 exhibits a shape resembling a bent bar as a whole. The elastic deformation part 662 extends from an upper end surface 666 of the screw body part 660 toward the upper side. The upper end (right end in FIG. 32) of the elastic deformation part 662 is a free end, and the engagement projection 664 is formed at the free end.

Although not shown in the drawings, the elastic deformation parts 662 are provided at a plurality of locations in the circumferential direction of the screw body part 660. In the present embodiment, the elastic deformation parts 662 are provided at four locations in the circumferential direction of the screw body part 660. All the elastic deformation parts 662 are bent so as to become closer to the center line of the screw member 650 with decreasing distance to the free end.

As described above, the rotating engagement part 656 penetrates the screw member 650. More specifically, the rotating engagement part 656 penetrates the screw body part 660. That is, the through hole penetrating the screw body part 660 constitutes a part of the rotating engagement part 656. Furthermore, an inner surface 668 of the elastic deformation part 662 also constitutes a part of the rotating engagement part 656. The inner surface 668 is continuous with the through hole penetrating the screw body part 660.

The sleeve 450 has a shaft hole 452. A shaft is inserted and bonded to the shaft hole 452. In FIG. 32 and FIG. 33, the illustration of the shaft is omitted.

The sleeve 450 has a sleeve-side connection part 460. The sleeve-side connection part 460 has a cylindrical shape. The sleeve-side connection part 460 has a hollow portion 461 and an inner surface 462. The hollow portion 461 is opened to the screw member 650 side. The inner side of the inner surface 462 constitutes the hollow portion 461. The inner surface 462 defines the hollow portion 461. The inner surface 462 is a circumferential surface. The inner surface 462 has an engagement recess 464. The engagement recess 464 is a circumferential groove.

FIG. 32 and FIG. 33 show a wrench 680 used for rotating the screw member 650. The sectional shape of the wrench 680 corresponds to the sectional shape of the rotating engagement part 656. The sectional shape of the wrench 680 is a tetragon (square). As shown in FIG. 32 and FIG. 33, the screw-connection between the male screw part 654 and the female screw part 220 is enabled by inserting the wrench 680 into the rotating engagement part 656 and rotating the wrench 680.

As shown in FIG. 32, in a state in which an external force is not applied, the elastic deformation part 662 is bent. The state in which an external force is not applied is also referred to as a natural state. In FIG. 32, the wrench 680 is shallowly inserted. The wrench 680 remains at the screw body part 660, and has not reached the inside of the elastic deformation part 662. Therefore, the wrench 680 does not abut on the elastic deformation part 662, and thus does not elastically deform the elastic deformation part 662. An insertion position at which the elastic deformation part 662 is not elastically deformed is also referred to as a first insertion position Ps.

On the other hand, as shown in FIG. 33, the elastic deformation part 662 abuts on the wrench 680 when the wrench 680 is deeply inserted. As a result, the elastic deformation part 662 is elastically deformed so as to extend along the wrench 680. The elastic deformation part 662 is straightened by the elastic deformation. The elastic deformation causes the engagement projection 664 of the elastic deformation part 662 to reach a position at which the engagement projection 664 is engaged with the engagement recess 464 of the sleeve-side connection part 460. An insertion position at which the engagement projection 664 is engaged with the engagement recess 464 is also referred to as a second insertion position Pd.

Although a gap is present between the elastic deformation part 662 and the wrench 680 in FIG. 33, the gap is not actually present. The elastic deformation part 662 is deformed to the outer side by abutting on the wrench 680, and is thereby straightened.

Such a screw member 650 can also fulfill the same function as that of the above-described screw member 600. To press the sleeve 450 in the engaging direction, the screw member 650 is screwed into the female screw part of the head. At this time, the wrench 680 is inserted shallowly. That is, the wrench 680 is positioned at the first insertion position Ps. While maintaining the shallow insertion (first insertion position Ps), the screw member 650 is rotated in the first direction DR1. Then, the screw-connection of the screw member 650 progresses while the natural state of the elastic deformation part 662 is maintained. In the elastic deformation part 662 in the natural state, the engagement projection 664 is positioned on the inner side of the inner surface 462. Therefore, the elastic deformation part 662 is smoothly inserted inside the sleeve-side connection part 460. Finally, a lower end surface 470 of the sleeve-side connection part 460 abuts on an abutting surface 666 of the screw member 650, whereby the sleeve 450 is pressed in the engaging direction.

To remove the screw member 650, the wrench 680 is inserted deeply. That is, the wrench 680 is positioned at the second insertion position Pd (FIG. 33). This insertion causes the elastic deformation part 662 to be elastically deformed, whereby the engagement projection 664 is engaged with (caught by) the engagement recess 464. That is, the screw member 650 is connected to the sleeve 450. While maintaining the deep insertion (second insertion position Pd), the screw member 650 is rotated in the second direction DR2. Then, the screw member 650 is moved to the lower side while the connection between the screw member 650 and the sleeve 450 is maintained. As a result, the tip engagement part RT including the sleeve 450 is pulled out from the hosel hole 204. The connection between the screw member 650 and the sleeve 450 can be easily released by inserting the wrench 680 shallowly.

Thus, the connection can be easily released. The connection may be released upon confirmation of pulling out of the tip engagement part RT including the sleeve 450 from the hosel hole 204.

As explained above, the screw member 650 includes: the screw body part 660 having the male screw part 654; the elastic deformation part 662 extending from the screw body part 660 to the sleeve side (upper side) and constituting the screw-side connection part 652; and the rotating engagement part 656 to which a wrench 680 for rotating the screw member 650 can be inserted. The rotating engagement part 656 has a through hole 658 penetrating the screw body part 660, and an inner surface 668 of the elastic deformation part 662 that extends continuously with the through hole 658. The elastic deformation part 662 has the engagement projection 664 at an end portion thereof on the sleeve side, and the end portion on the sleeve side is a free end. The sleeve-side connection part 460 has the hollow portion 461 opened on the screw member 650 side, the inner surface 462 defining the hollow portion 461, and the engagement recess 464 provided on the inner surface 462. In a natural state, the elastic deformation part 662 including the engagement projection 664 exhibits a shape that can be inserted to the hollow portion 461 with rotation of the screw member 650 in the first direction DR1. When the wrench 680 is inserted to a position at which the wrench 680 abuts on the inner surface 668 of the elastic deformation part 662, the elastic deformation part 662 is elastically deformed so as to be positioned at a position at which the engagement projection 664 of the elastic deformation part 662 can be engaged with the engagement recess 464.

With this configuration, the wrench 680 can be inserted shallowly when rotating the screw member 650 in the first direction DR1, whereby the pressing of the tip engagement part RT is enabled. The wrench 680 can be inserted deeply when rotating the screw member 650 in the second direction DR2, whereby the pulling out of the tip engagement part RT is enabled.

A modification example of the embodiment shown in FIG. 32 and FIG. 33 is also possible. In the present modification example, the configuration of the embodiment shown in FIG. 30 and FIG. 31 is applied to the embodiment shown in FIG. 32 and FIG. 33. In the present modification example, engagement using the engagement ball 634 is used in place of the engagement using the elastic deformation part 662 and the engagement projection 664. In the present modification example, the engagement ball 634 is disposed at the screw-side connection part 652. The engagement ball 634 is disposed at the position corresponding to the engagement projection 664. When the wrench 680 is inserted deeply, the engagement ball 634 is pressed by the wrench 680 from inside so as to be projected outside, and is thereby engaged with the engagement recess 464. By this engagement, the screw member 650 is connected to the sleeve 450. Therefore, when the screw member is rotated in the second direction DR2 while maintaining the deep insertion of the wrench 680, the sleeve 450 is pulled in the engagement releasing direction. When the wrench 680 is inserted shallowly, the abutment between the wrench 680 and the engagement ball 634 is released so as to bring about a state in which the engagement ball 634 can be retracted inside. By bringing about this state, the connection between the sleeve 450 and the screw member 650 can be released. The screw-side connection part 652 is configured such that the engagement ball 634 does not fall off from the screw-side connection part 652 even in a state in which the wrench 680 is not present. For example, the engagement ball 634 may be disposed in a ball housing hole 636 provided on the screw-side connection part 652, and (small) stoppers to prevent the falling-off of the engagement ball 634 may be provided on both sides of the ball housing hole 636.

As shown in FIG. 12 to FIG. 17 and so forth, the position of the sleeve on the sole side is changed by the above-described angle adjustment. That is, when a spacer that makes the sleeve inclined is used, the position of the lower end of the sleeve is changed. For this reason, the position of the sleeve-side connection part may also be changed. The connecting mechanism of the sleeve-side connection part and the screw member preferably has a mechanism capable of absorbing the position change of the lower end of the sleeve. The sleeve preferably has a displacement mechanism in which the sleeve-side connection part can be displaced with respect to the sleeve body so as to correspond to the position change of the lower end of the sleeve. The displacement mechanism is preferably configured to enable the connection between the sleeve-side connection part and the screw member over the entire movement range of the lower end of the sleeve.

Figure 34:
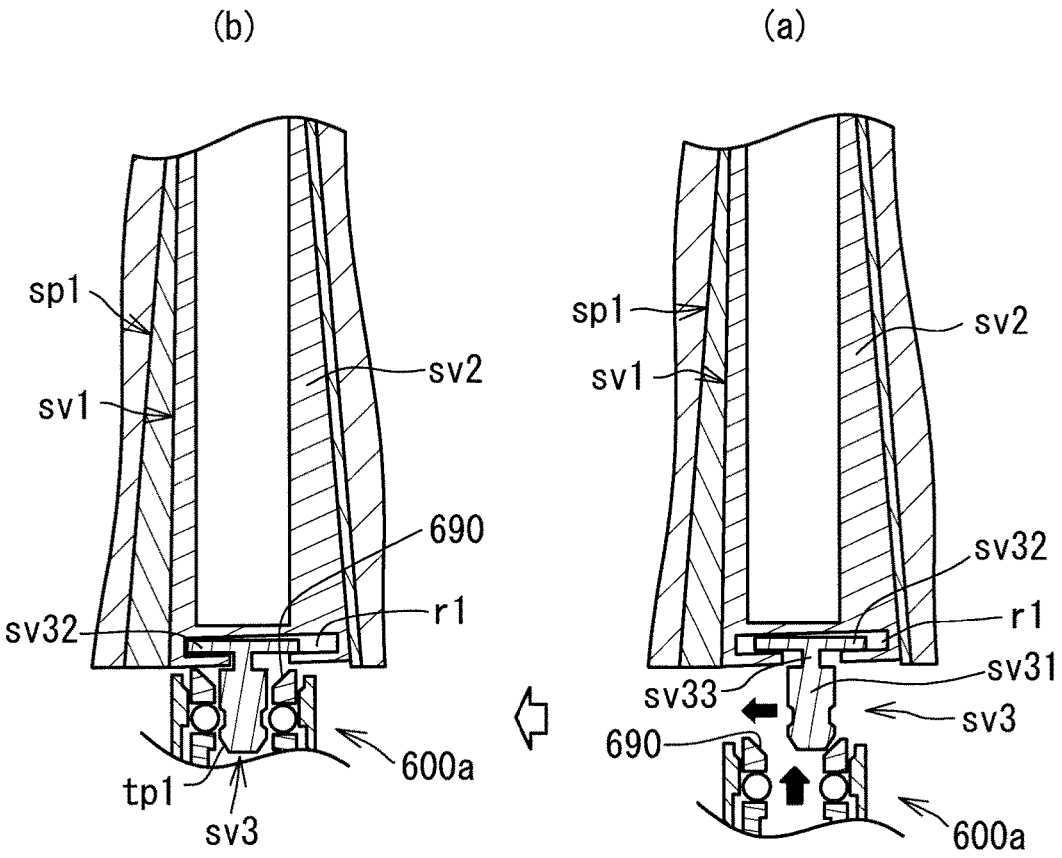
FIG. 34 is sectional views including a sleeve according to another embodiment, the sleeve according to FIG. 34 has a movable connection part, the movable connection part constitutes a sleeve-side connection part.
Figure 35:
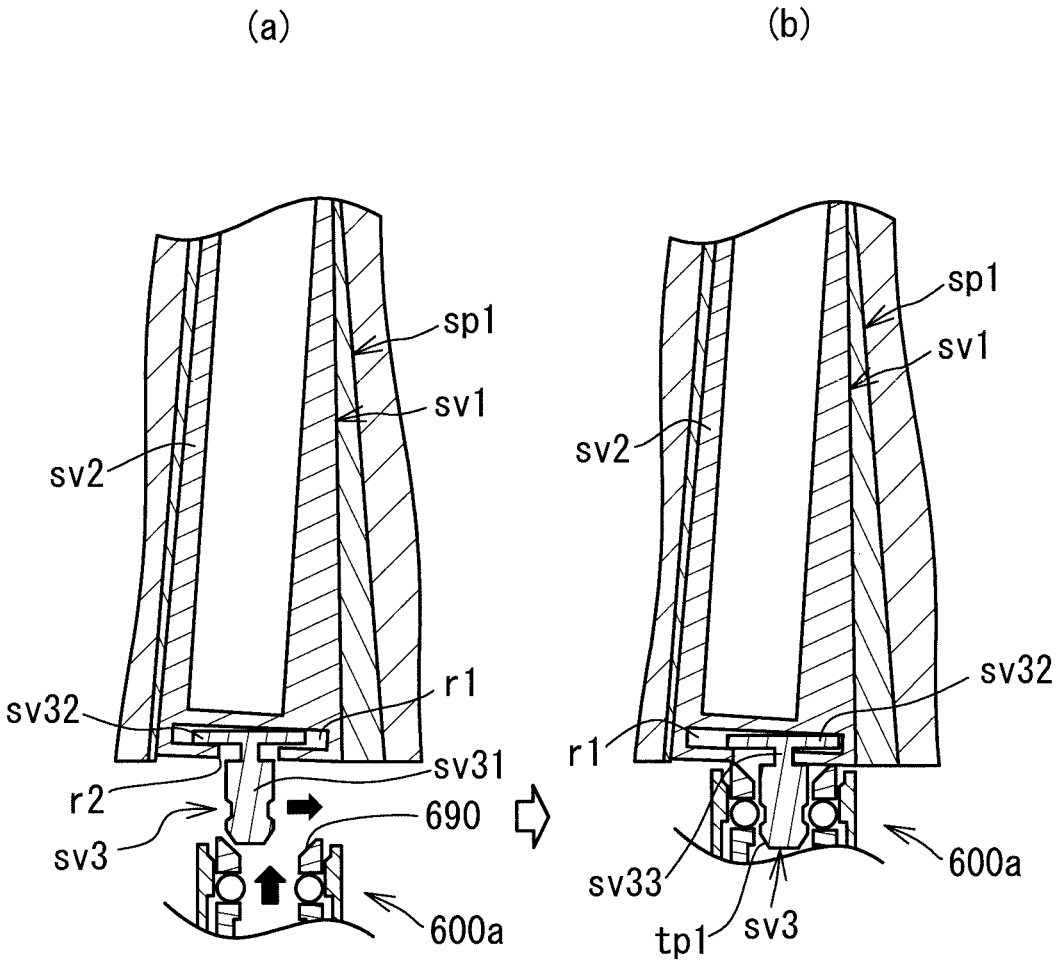
FIG. 35 is sectional views for illustrating movements of the movable connection part, as with FIG. 34.

FIG. 34 and FIG. 35 are sectional views of an embodiment including a sleeve sv1 having the above-described displacement mechanism and a screw member 600*a* corresponding to the sleeve sv1. In the present embodiment, one spacer sp1 is used.

The sleeve sv1 has a sleeve body sv2 and a movable connection part sv3. The sleeve body sv2 has a movable space r1. The sleeve body sv2 further has an opening r2 that allows communication between the movable space r1 and the outside. The movable space r1 and the opening r2 are provided at a bottom surface portion of the sleeve body sv2.

The movable connection part sv3 has a body sv31, a falling-off prevention part sv32, and a joining part sv33.

The body sv31 constitutes a sleeve-side connection part. The body sv31 has a tip tapered surface tp1. Except for the presence of the tip tapered surface tp1, the outer shape of the body sv31 is the same as that of the above-described sleeve-side connection part 410.

The falling-off prevention part sv32 is disposed in the movable space r1. The falling-off prevention part sv32 can move inside the movable space r1.

The joining part sv33 joins the body sv31 to the falling-off prevention part sv32.

The joining part sv33 penetrates the opening r2. The sectional area of the opening r2 is larger than the sectional area of the joining part sv33. The joining part sv33 can be moved inside the opening r2. The movable space r1 has a dimension that can ensure the necessary movement and inclination of the falling-off prevention part sv32. The falling-off prevention part sv32 has a size that cannot pass through the opening r2.

The movable connection part sv3 is held by the sleeve body sv2 in a state in which it hangs from the sleeve body sv2. The movable connection part sv3 can be moved relative to the sleeve body sv2 within a range that can follow the position change of the sleeve on the sole side. The movable connection part sv3 can be inclined relative to the sleeve body sv2 within a range that can follow the position change of the sleeve on the sole side.

The screw member 600*a* has a receiving slope 690. The receiving slope 690 is a conical concave surface. Except for the presence of the receiving slope 690, the screw member 600*a* is the same as the above-described screw member 600. The receiving slope 690 is provided at an upper end surface of the second member 622 (see FIG. 31). The receiving slope 690 is inclined outward as going to the upper side.

In state (a) in FIG. 34, the center line of the outer surface of the sleeve sv1 is shifted to the right side with respect to the center line of the screw member 600*a*. However, the movable connection part sv3 can be moved so as to absorb the shift between the center lines. As a result of the movement, the screw member 600*a* can be connected to the sleeve sv1. That is, state (b) in FIG. 34 is realized. The abutment between the tip tapered surface tp1 and the receiving slope 690 contributes to smooth movement of the movable connection part sv3.

In state (a) in FIG. 35, the center line of the outer surface of the sleeve sv1 is shifted to the left side with respect to the center line of the screw member 600*a*. In this case as well, the movable connection part sv3 can be moved so as to absorb the shift between the center lines. As a result of the movement, the screw member 600*a* can be connected to the sleeve sv1. That is, state (b) in FIG. 35 is realized. The abutment between the tip tapered surface tp1 and the receiving slope 690 contributes to smooth movement of the movable connection part sv3.

As explained above, the sleeve sv1 has a sleeve body sv2 and a movable connection part sv3, and the movable connection part sv3 is configured to be movable with respect to the sleeve body sv2. When the screw member 600*a* is rotated in the first direction, an upper end portion of the screw member and a lower end portion of the movable connection part abut on each other. By the abutment, the movable connection part is moved to a position at which it can be connected to the screw member 600*a*. Therefore, the sleeve and the screw member can be connected to each other even when the position of the lower end of the sleeve is changed.

Each of the above-described screw members plays the role (role A) of pressing the tip engagement part RT in the engaging direction, and the role (role B) of pulling the tip engagement part RT in the engagement releasing direction. These screw members can also be used to play only the role B. For example, the role A can be replaced by another screw member that does not have the connecting function to the sleeve. A screw member having the above-described connecting function can be used only when the tip engagement part RT is removed from the reverse-tapered hole. In this case, the screw member mounted to the golf club being used can be a screw member that does not have the connecting function, so that the weight of the golf club can be reduced.

The material of the sleeve is not limited. Preferable examples of the material include a titanium alloy, stainless steel, an aluminum alloy, a magnesium alloy, and a resin. From the viewpoint of strength and lightweight properties, for example, the aluminum alloy and the titanium alloy are more preferable. It is preferable that the resin has excellent mechanical strength. For example, the resin is preferably a resin referred to as an engineering plastic or a super-engineering plastic.

The material of the spacer is not limited. Preferable examples of the material include a titanium alloy, stainless steel, an aluminum alloy, a magnesium alloy, and a resin. From the viewpoint of strength and lightweight properties, for example, the aluminum alloy and the titanium alloy are more preferable. It is preferable that the resin has excellent mechanical strength. For example, the resin is preferably a resin referred to as an engineering plastic or a super-engineering plastic. From the viewpoint of moldability, the resin is preferable.

As described above, the golf clubs may include an adjusting mechanism capable of adjusting the position and/or angle of the center line of the shaft. The adjusting mechanism includes a connecting mechanism between a screw member and a sleeve. This mechanism preferably satisfies the Golf Rules defined by The R&A (The Royal and Ancient Golf Club of St Andrews). That is, the mechanism preferably satisfies requirements specified in "lb. Adjustability" in "1. Clubs" of "Appendix II. Design of Clubs" defined by The R&A. The requirements specified in "lb. Adjustability" are the following items (i), (ii), and (iii):

(i) the adjustment cannot be readily made;

(ii) all adjustable parts are firmly fixed and there is no reasonable likelihood of them becoming loose during a round; and (iii) all configurations of adjustment conform to the Rules.

The disclosure described above can be applied to all golf clubs such as a wood type golf club, a hybrid type golf club, an iron type golf club, and a putter.

The above description merely shows illustrative examples, and various modifications can be made.

What is claimed is:

1. A golf club comprising:

a head having a hosel part;

a shaft;

a tip engagement part having a reverse-tapered shape and being disposed at a tip end portion of the shaft; and a screw member, wherein the tip engagement part includes a sleeve having a reverse-tapered shape and being fixed to the tip end portion of the shaft, the hosel part includes a hosel hole, the hosel hole includes a reverse-tapered hole having a shape corresponding to a shape of an outer surface of the tip engagement part, the tip engagement part is fitted to the reverse-tapered hole, the sleeve has a sleeve-side connection part at a tip end portion thereof, the screw member has a screw-side connection part that can be detachably connected to the sleeve-side connection part, and a male screw part, the head has, on a lower side of the hosel hole, a female screw part that can be screw-connected to the male screw part, when the male screw part is rotated in a first direction with respect to the female screw part, the screw member presses the tip engagement part in an engaging direction, and, when the male screw part is rotated in a second direction with respect to the female screw part, while maintaining connection between the sleeve-side connection part and the screw-side connection part, the screw member pulls the tip engagement part in an engagement releasing direction.

2. The golf club according to claim 1, wherein, by the rotation in the first direction, the screw member presses the tip engagement part in the engaging direction, and the sleeve-side connection part is inserted to the screw-side connection part, and the connection is automatically completed by the sleeve-side connection part being inserted to the screw-side connection part.

3. The golf club according to claim 2, wherein the screw member includes:

a screw body having the male screw part;

a first member constituting an outer circumferential surface of the screw-side connection part;

a second member positioned inside the first member;

a third member positioned inside the second member;

a first elastic body that is disposed between the first member and the second member, and biases the first member to a sleeve side with respect to the second member;

a second elastic body that biases the third member to the sleeve side; and an engagement ball disposed in a ball housing hole penetrating between an inner surface and an outer surface of the second member, the sleeve-side connection part has an engagement recess, in a non-connected state, the engagement ball is projected outside the second member by the third member being positioned inside the engagement ball, and, by the projected engagement ball, the first member is located at a first position at which movement thereof to the sleeve side is regulated, and in a connected state in which the connection has been achieved, the third member is moved to a position at which the third member is removed from inside of the engagement ball by the sleeve-side connection part, the engagement ball falls in the engagement recess of the sleeve-side connection part, the movement regulation on the first member by the engagement ball is released, and the first member is moved to a second position at which the first member prevents the engagement ball from projecting to the outside.

4. The golf club according to claim 1, wherein the screw member includes:

a screw body part having the male screw part;

an elastic deformation part extending from the screw body part to a sleeve side and constituting the screw-side connection part; and a rotating engagement part to which a wrench for rotating the screw member can be inserted, and the rotating engagement part has a through hole penetrating the screw body part, and an inner surface of the elastic deformation part that extends continuously with the through hole, the elastic deformation part has an engagement projection at an end portion thereof on a sleeve side, and the end portion on the sleeve side is a free end, the sleeve-side connection part has a hollow portion opened on a side of the screw member, an inner surface defining the hollow portion, and an engagement recess provided on the inner surface, in a natural state, the elastic deformation part including the engagement projection exhibits a shape that can be inserted to the hollow portion with rotation of the screw member in the first direction, and when the wrench is inserted to a position at which the wrench abuts on the inner surface of the elastic deformation part, the elastic deformation part is elastically deformed so as to be positioned at a position at which the engagement projection of the elastic deformation part can be engaged with the engagement recess.

5. A screw member for use in a golf club including:

a head having a hosel part;

a shaft; and a tip engagement part having a reverse-tapered shape and being disposed at a tip end portion of the shaft, wherein the tip engagement part includes a sleeve having a reverse-tapered shape and being fixed to the tip end portion of the shaft, the hosel part includes a hosel hole, the hosel hole includes a reverse-tapered hole having a shape corresponding to a shape of an outer surface of the tip engagement part, the tip engagement part is fitted to the reverse-tapered hole, the sleeve has a sleeve-side connection part at a tip end portion thereof, the screw member has a screw-side connection part that can be detachably connected to the sleeve-side connection part, and a male screw part, the head has, on a lower side of the hosel hole, a female screw part that can be screw-connected to the male screw part, when the male screw part is rotated in a first direction with respect to the female screw part, the screw-side connection part is connected to the sleeve-side connection part with progression of the screw-connection, and, when the male screw part is rotated in a second direction with respect to the female screw part, while maintaining connection between the sleeve-side connection part and the screw-side connection part, the screw member pulls the tip engagement part in an engagement releasing direction.

6. The golf club according to claim 1, wherein the reverse-tapered hole has a sectional area being gradually increased toward a lower side, and the reverse-tapered hole has a non-circular sectional shape.

7. The golf club according to claim 6, wherein the reverse-tapered hole includes a plurality of faces.

8. The golf club according to claim 6, wherein the reverse-tapered hole constitutes a pyramid surface.

* * * * *